US009896860B2

(12) United States Patent
Bucknell et al.

(10) Patent No.: US 9,896,860 B2
(45) Date of Patent: Feb. 20, 2018

(54) STRUCTURAL SUPPORT SYSTEM AND METHODS OF USE

(71) Applicant: iSIMS LLC, Houston, TX (US)

(72) Inventors: Justin R. Bucknell, Houston, TX (US); Kaisheng Chen, Houston, TX (US)

(73) Assignee: iSIMS LLC, Houston, TX (US)

( * ) Notice: Subject to any disclaimer, the term of this patent is extended or adjusted under 35 U.S.C. 154(b) by 0 days.

(21) Appl. No.: 15/207,435

(22) Filed: Jul. 11, 2016

(65) Prior Publication Data

US 2017/0009480 A1 Jan. 12, 2017

Related U.S. Application Data

(60) Provisional application No. 62/191,476, filed on Jul. 12, 2015, provisional application No. 62/312,341, filed on Mar. 23, 2016.

(51) Int. Cl.
*E04H 12/10* (2006.01)
*E04B 1/19* (2006.01)
(Continued)

(52) U.S. Cl.
CPC ..... *E04H 12/10* (2013.01); *E02B 17/0004* (2013.01); *E02B 17/027* (2013.01);
(Continued)

(58) Field of Classification Search
CPC ..... E04H 12/10; E04H 12/342; E02B 17/027; E02B 17/0004; E02B 2017/006;
(Continued)

(56) References Cited

U.S. PATENT DOCUMENTS 3,528,254 A 9/1970 Graham
3,668,876 A 6/1972 Koehler
(Continued)

FOREIGN PATENT DOCUMENTS

EP 0231056 3/1990
JP 622187 1/1987
(Continued)

OTHER PUBLICATIONS

Kavazanjian, Jr., Edward, "A driven pile advantage: Batter piles", Pile Driver, Q4, 2006, 3 pages,
(Continued)

*Primary Examiner* — Patrick J Maestri
(74) *Attorney, Agent, or Firm* — Gordon G. Waggett, P.C.

(57) ABSTRACT

The present disclosure describes a base structural building module employing a core structural member having an array of upwardly and outwardly and downwardly and outwardly extending braces or arms extending therefrom. Tubular cans are mounted at the ends of each of the upper and lower arms to receive piles. One upper arm is aligned and paired with one lower arm and the pair's respective cans are aligned about their can axis. The modules employ flexible design by varying the lengths of the arms and their respective inclination or declination angles. Modules can be stacked one on top of another (and secured) to form multi-tiered structural building jackets for building vertical structures such as, for example, oil and gas platforms used onshore or offshore as well as other structures. Each tier can also comprise multiple modules joined laterally together to provide a wide variety of potential template configurations and building applications.

44 Claims, 47 Drawing Sheets

© 2015 iSIMS LLC

(51) Int. Cl.

| | |
|---|---|
| ***E04B 1/24*** | (2006.01) |
| ***E04H 12/34*** | (2006.01) |
| ***E21B 41/00*** | (2006.01) |
| ***E02D 27/52*** | (2006.01) |
| ***E02D 27/42*** | (2006.01) |
| ***E02B 17/00*** | (2006.01) |
| ***E02B 17/02*** | (2006.01) |

(52) U.S. Cl.
CPC ..... *E02D 27/425* (2013.01); *E02D 27/525* (2013.01); *E04B 1/1909* (2013.01); *E04B 1/24* (2013.01); *E04H 12/342* (2013.01); *E21B 41/00* (2013.01); *E02B 2017/006* (2013.01); *E02B 2017/0073* (2013.01); *E02B 2017/0091* (2013.01); *E04B 2001/1993* (2013.01); *E04B 2001/2421* (2013.01)

(58) Field of Classification Search
CPC .. E02B 2017/0091; E04B 1/24; E04B 1/1909; E04B 2001/2421; E02D 27/425; E02D 27/525
See application file for complete search history.

(56) References Cited

U.S. PATENT DOCUMENTS

| | | | | |
|---|---|---|---|---|
| 4,083,193 | A | 4/1978 | Evans | |
| 4,118,942 | A | 10/1978 | Liautaud | |
| 4,437,288 | A * | 3/1984 | Foissac | E04H 12/02 403/171 |
| 4,553,878 | A | 11/1985 | Willemse et al. | |
| 4,607,983 | A | 8/1986 | Meek et al. | |
| 4,639,166 | A | 1/1987 | Fern | |
| 4,669,918 | A | 6/1987 | Riles | |
| 4,721,416 | A | 1/1988 | Gracia | |
| 4,854,779 | A | 8/1989 | Luyties | |
| 5,051,036 | A | 9/1991 | Gomez de Rosas et al. | |
| 5,122,010 | A | 6/1992 | Burguieres, Jr. et al. | |
| 5,536,117 | A * | 7/1996 | Frame | E02B 17/027 405/202 |
| RE35,912 | E | 9/1998 | Gomez de Rosas et al. | |
| 6,299,385 | B1 * | 10/2001 | Barnes | E02B 17/021 405/195.1 |
| 6,997,260 | B1 | 2/2006 | Trader et al. | |
| 8,628,275 | B1 | 1/2014 | Trader et al. | |
| 8,661,752 | B2 | 3/2014 | Phuly | |
| 2010/0226785 | A1 | 9/2010 | Livingston et al. | |
| 2011/0135400 | A1 * | 6/2011 | Hall | E02D 27/42 405/228 |
| 2013/0064678 | A1 * | 3/2013 | Stiesdal | E02B 17/0004 416/244 R |
| 2014/0328632 | A1 * | 11/2014 | Lefranc | E02B 17/027 405/225 |

FOREIGN PATENT DOCUMENTS

| | | |
|---|---|---|
| KR | 1020140003834 | 1/2014 |
| WO | 2013057093 | 4/2013 |

OTHER PUBLICATIONS

VJTECH.CO.UK, "Dynamic Soil Structure of Offshore Wind Turbines and long term performance prediction: Linking scaled model test results to prototype prediction via element tests", online blog dated Nov. 20, 2014, 7 pages.
Arcam AB, brochure regarding Arcam Q20 EBM product. Nov. 2013, 4 pages.
Sciaky Inc.—"Electron Beam Additive Manufacturing (EBAM)". 2016, 5 pages.
EOS GmbH, EOS M 400 product brochure. Nov. 2015, 4 pages.
Optomec-Lens 850-R product brochure. Printed Mar. 23, 2016. 2 pages.
Sciaky Inc.—The EBAM 300 Series product brochure. 2016, 5 pages.
Sciaky Inc.—"Electron Beam Additive Manufacturing (EBAM)". 2016, 6 pages.
Sciaky Inc.—EBAM Systems product brochure. 2015, 2 pages.
Sciaky Inc.—EBAM Metal Additive Manufacturing—3D Printing product brochure. Dec. 15, 2015, 4 pages.
Kable—offshoretechnology.com—"North West Hutton Field, United Kingdom". 2015, 11 pages.
petrowiki.org—"Fixed steel and concrete gravity base structures", printed Jul. 6, 2016, 6 pages.
3DSYSTEMS—ProJet 5000 product brochure. Mar. 2015, 2 pages.
STRATASYS—Objet1000 Plus product brochure. 2015, 2 pages.
Voxeljet AG—VX400 product brochure. May 2015, 1 page.
ISA/KR—PCT/US2016/041815—International Search Report and Written Opinion in Applicant's counterpart PCT application. Oct. 19, 2016, 12 pages.

* cited by examiner

© 2015 iSIMS LLC

© 2015 iSIMS LLC

© 2015 iSIMS LLC

© 2015 iSIMS LLC

© 2015 iSIMS LLC

© 2015 iSIMS LLC

© 2015 iSIMS LLC

© 2015 iSIMS LLC

© 2015 iSIMS LLC

© 2015 iSIMS LLC

© 2015 iSIMS LLC

© 2015 iSIMS LLC

© 2015 iSIMS LLC

© 2015 iSIMS LLC

© 2015 iSIMS LLC

© 2015 iSIMS LLC

© 2015 iSIMS LLC

© 2015 iSIMS LLC

© 2015 iSIMS LLC

© 2015 iSIMS LLC

© 2015 iSIMS LLC

© 2015 iSIMS LLC

© 2015 iSIMS LLC

© 2015 iSIMS LLC

© 2015 iSIMS LLC

© 2015 iSIMS LLC

© 2015 iSIMS LLC

© 2015 iSIMS LLC

© 2015 iSIMS LLC

© 2015 iSIMS LLC

© 2015 iSIMS LLC

© 2015 iSIMS LLC

© 2015 iSIMS LLC

© 2015 iSIMS LLC

© 2015 iSIMS LLC

© 2015 iSIMS LLC

© 2015 iSIMS LLC

© 2015 iSIMS LLC

© 2015 iSIMS LLC

© 2015 iSIMS LLC

© 2015 iSIMS LLC

© 2015 iSIMS LLC

© 2015 iSIMS LLC

© 2015 iSIMS LLC

© 2015 iSIMS LLC

© 2015 iSIMS LLC

© 2015 iSIMS LLC

© 2015 iSIMS LLC

© 2015 iSIMS LLC

© 2015 iSIMS LLC

© 2015 iSIMS LLC

© 2015 iSIMS LLC

© 2015 iSIMS LLC

STRUCTURAL SUPPORT SYSTEM AND METHODS OF USE

CROSS-REFERENCE TO RELATED APPLICATIONS

This application claims the benefit of the filing date of and priority to: U.S. Provisional Application Ser. No. 62/191,476 entitled "Structural Support System and Methods of Use" and filed Jul. 12, 2015, Confirmation No. 8368; and U.S. Provisional Application Ser. No. 62/312,341 entitled "Structural Support System and Methods of Use" and filed Mar. 23, 2016, Confirmation No. 1025; said provisional applications are incorporated by reference herein in their entireties for all purposes.

COPYRIGHT AUTHORIZATION UNDER 37 CFR 1.71

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

STATEMENT REGARDING FEDERALLY SPONSORED RESEARCH OR DEVELOPMENT

Not Applicable.

BACKGROUND OF THE INVENTION

Field of the Invention

The present disclosure relates generally to the field of structural support systems used in the construction industry and related methods of use. As but one example, the present disclosure pertains to structural support systems used in the construction of offshore and onshore oil and gas platforms and wind energy and energy transmission platforms.

BRIEF SUMMARY OF INVENTION

In one embodiment of the present disclosure there is described a vertically-oriented structural building module comprising: (a) a central core member aligned along a central core vertical axis, the core structure comprising an upper end, a lower end, and an outer surface; (b) three or more upper structural arms each having lower and upper ends defining an upper arm length, the lower ends of the upper arms being fixably attached to the core outer surface in radially spaced relationship about the vertical axis, each upper arm extending outwardly and upwardly from the core its own vertical plane at a desired angle $\theta_u$ relative to the horizontal; (c) three or more lower structural arms each having lower and upper ends defining a lower arm length, the upper ends of the lower arms being fixably attached to the core outer surface in radially spaced relationship about the vertical axis, each lower arm extending outwardly and downwardly from the core at a desired angle $\theta_d$ relative to the horizontal; (d) upper tubular cans attached to the upper ends of the upper arms, the upper tubular cans each comprising an outer surface, an annular interior space oriented about a can axis and having an inner diameter, and upper and lower ends defining a can length, each of the upper tubular cans being attached to the upper arms in a substantially vertical orientation to align the annular interior space of each of the cans at a desired can angle $\theta_c$ relative to horizontal; and (e) lower tubular cans attached to the lower ends of the lower arms, the lower tubular cans each comprising an outer surface, an annular interior space oriented about a can axis and having an inner diameter, and upper and lower ends defining a can length, each of the lower tubular cans being attached to the lower arms in a substantially vertical orientation to align the annular interior space of each of the cans at a desired can angle $\theta_c$ relative to horizontal.

In this embodiment, each respective upper arm is aligned within the same vertical plane with a corresponding one of the respective lower arms to form an upper lower arm pair, and the upper and lower cans of each of the respective arm pairs is aligned about the same can axis to form an arm pair can axis.

In one embodiment, at least one arm pair can axis is substantially parallel with the core vertical axis. In another embodiment, at least one arm pair can axis is substantially vertical. In yet another embodiment, each arm pair can axis is substantially vertical. This provides the ability to create faces of the building module that are battered or non-battered.

In one embodiment of the building module, there are three upper structural arms and three lower structural arms; in another, there are four upper structural arms and four lower structural arms; in yet another, there are five upper structural arms and five lower structural arms, and in still another, there are six upper structural arms and six lower structural arms.

The core structure may be solid or may further comprise an annular interior space having an inner diameter, such as a tubular material.

The length of the arms can be varied to suit the structural needs. For example, one structure might employ upper arms that are all of the same length. The lower arms could also be all of the same length. In some embodiments, at least one of the upper arms is of a different length from the lengths of the other upper arms, and/or at least one of the lower arms is of a different length from the lengths of the other upper arms.

The basic single core building module can be modified by adding additional core members along the same horizontal plane and interconnecting the adjacent arms to share common cans. The basic single core building module can be used in the manufacture, installation, use and reuse of many diverse structures, such as, for example, onshore and offshore oil and gas platforms, wind energy and energy transmission platforms, and other structures benefitting from the use of these modular building units.

Also disclosed is a multi-tiered, vertically-oriented structural building jacket template for building a vertical structure comprising: (a) a bottom tier vertically-oriented structural building module having a lower end capable of resting on a foundation and an upper end opposite thereto; (b) one or more upper tier vertically-oriented structural building modules each having lower ends and upper ends, the lower end of a first of the one or more upper tier modules being fixably attached to the upper end of the bottom tier, the lower end of any additional one of the one or more upper tier modules being fixably attached to the upper end of the module in the tier immediately below; (c) wherein each vertically-oriented structural building module can be of the variety described herein; (d) connections connecting the lower cans of the lower end of the first of the one or more upper tier modules to the upper cans of the bottom tier; (e) connections connecting the lower end of any additional one of the one or more upper tier modules to the upper end of the module in the tier immediately below; and (f) an overall height defined as the distance from the bottom of the bottom tier to the top of the topmost of the upper tiers. In this embodiment, the upper and lower cans of each of the respectively attached module tiers remain aligned about the same respective can axis from the top of the jacket template to the bottom of the jacket template, and the central core members in each of the module tiers remain aligned along the central core vertical axis. This building jacket template may employ any number of tiers, such as 1, 2, 3, and 4 tiers as an example.

Additional structural material can be added to the top of the top tier for interfacing with additional structure to be mounted thereto. Ideally, the structural building jacket template employs can interior diameters sufficient to permit passage of a piles therethrough. The structural building jacket template can be mounted or otherwise installed onto any type of foundation, such as the seafloor, the ground, a concrete pad, or another structure, or the like.

In one embodiment, the structural building jacket template is employed in the construction of a vertical structure such as an onshore or offshore oil and gas platform. In other embodiments, the structural building jacket template may be employed in the construction of other vertical structures, such as wind energy and energy transmission platforms. These vertical structures can be premanufactured and then moved to the location of ultimate installation. The building modules could likewise be premanufactured and then moved to the location of ultimate installation where they could be joined with other modules to build the desired structure. The building modules could also be built onsite.

The structural building jacket template can also be modified to have differing footprints. For example, the building module may further comprise two or more adjacent central core members horizontally spaced apart from each other within the same horizontal plane so that one adjacent core member has an adjacent face facing an adjacent face of another adjacent core member. The upper tubular cans of two of the upper arms extending upwardly from one of the core member adjacent faces are connected to the respective upper ends of two of the upper arms extending upwardly from the adjacent face of the other core member so that these upwardly extending arms share common upper tubular cans. The lower tubular cans of two of the lower arms extending downwardly from one of the core member adjacent faces are connected to the respective lower ends of two of the lower arms extending downwardly from the adjacent face of the other core member so that these downwardly extending arms share common lower tubular cans. Further, the upper arms sharing common upper tubular cans are aligned with the lower arms sharing common lower tubular cans, and each respective upper arm sharing common upper tubular cans is aligned within the same vertical plane with a corresponding one of the respective lower arms sharing common lower tubular cans to form to form a shared upper lower arm pair.

There is also disclosed the various platforms that can be constructed using the exemplary jacket template of the present disclosure. One particularly suitable example is an oil and gas platform comprising: (a) a multi-tiered, vertically-oriented structural building jacket template as described herein having an upper end and a lower end, the lower end being secured to a foundation; (b) a deck structure mounted to the upper end of the jacket template; and (c) piles extending through the interior annular space of each of the top and bottom tubular cans that are aligned along each respective can axis, the piles having an upper end and a lower end defining a pile length sufficient to extend along each can axis from the upper end of the jacket template into the foundation to a desired depth. The platform can also employ skirt piles. The jacket template can be designed to create battered and/or non-battered faces.

Another advantageous use of the exemplary jacket template of the present disclosures is for an offshore wind energy platform. In this embodiment, there is described a wind energy platform comprising: (a) a multi-tiered, vertically-oriented structural building jacket template as described herein having an upper end and a lower end, the lower end being secured to a foundation; (b) a deck structure mounted to the upper end of the jacket template; and piles extending through the interior annular space of each of the top and bottom tubular cans that are aligned along each respective can axis, the piles having an upper end and a lower end defining a pile length sufficient to extend along each can axis from the upper end of the jacket template into the foundation to a desired depth. In one embodiment of this wind energy platform, the building module central core member further comprises a tubular material having an annular interior space having an inner diameter and wherein one or more of the vertically aligned central core members of adjacent modules at the top of the jacket receive a portion of a tower of a wind turbine. The platform can also employ skirt piles. The jacket template can be designed to create battered and/or non-battered faces.

There are also disclosed methods for installing platform structures that utilize the multi-tiered, vertically-oriented structural building jacket template vertical structures disclosed herein. In these methods, the jacket can be assembled at one location, and then delivered to the location of installation, or can be assembled at the site of the installation. Once assembled, the method includes vertically positioning the assembled jacket template structure so that its lower end rests on the foundation, such as the seabed in the example where the installation is offshore. The jacket template structure is then secured to the foundation by, e.g., installing piles extending through the interior annular space of each of the top and bottom tubular cans that are aligned along each respective can axis, the piles having an upper end and a lower end defining a pile length sufficient to extend along each can axis from the upper end of the jacket template into the foundation to a desired depth. The jacket template may further comprise deck structure mounted to the upper end of the jacket template during assembly, or after the jacket template has been installed. The assemble steps will vary depending on the configuration of the jacket template. For example, the building module may further comprise two or more adjacent central core members horizontally spaced apart from each other within the same horizontal plane so that one adjacent core member has an adjacent face facing an adjacent face of another adjacent core member as further described herein. The methods may further comprise the steps of installing desired equipment for using the platform as an oil and gas platform, a wind energy platform or other desired end use.

In one embodiment, the platform is installed in an offshore location where the deck structure is located above sea level and where the seabed serves as the foundation.

In addition to the use of these novel structures for their intended purposes, such as, for example, in offshore oil and gas, wind energy or energy transmission platforms, the methods described herein may further include the steps of inspecting the structure, including within the framework, below sea level using remotely operated vehicles or autonomous un-manned vehicles, and conducting any desired repairs.

The methods herein also include the decommissioning or moving of the structure from one location to another for reuse.

The building modules provide a wide range of flexibility with respect to designing and constructing a structure. Likewise the many exemplary template designs herein, constructed using the building modules disclosed herein, can be used for any number of diverse applications where prior art platform structures are employed, such as, for example, onshore and offshore oil and gas platform applications, onshore and offshore wind farming applications and the like. The modular, unique design provides benefits throughout the lifecycle of the platform structure, such as, the manufacturing of the structure, the installation of the structure, the ongoing use of the structure, the ongoing inspection and repair of the structure, the decommissioning or removal of the structure, and the moving of the structure for reuse at another location.

Other objects and advantages of the embodiments herein will become readily apparent from the following detailed description taken in conjunction with the accompanying drawings. In the drawings, like reference numerals refer to like elements.

DETAILED DESCRIPTION OF THE INVENTION

Figure 1A:
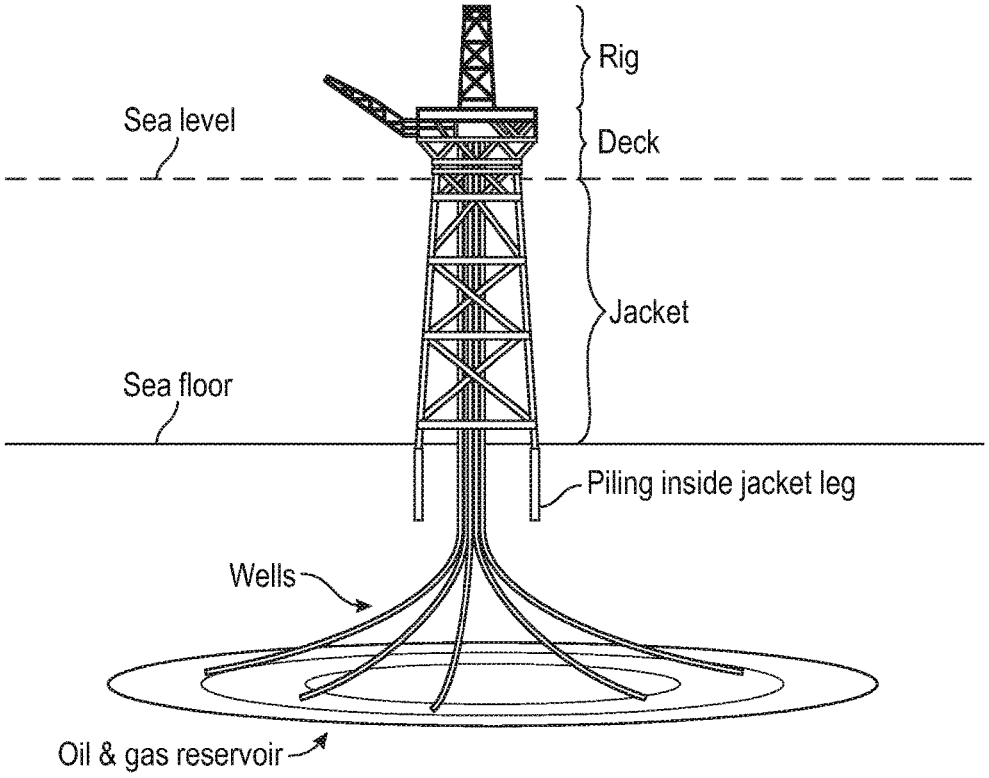
FIG. 1A (Prior Art)
FIG. 1A is a schematic depiction of a conventional, prior art offshore oil and gas platform.

Reference will now be made in detail to the description of the present subject matter, one or more examples of which are shown in figures. Each embodiment is provided to explain the subject matter and not a limitation. These embodiments are described in sufficient detail to enable a person skilled in the art to practice the invention, and it is to be understood that other embodiments may be utilized and that logical, physical, and other changes may be made within the scope of the embodiments. The following detailed description is, therefore, not be taken as limiting the scope of the invention, but instead the invention is to be defined by the appended claims.

Referring to the Figures, there is disclosed a structural concept for the provision of support to payloads and facilities used in both offshore and onshore structures. The design is unique as it does not need structural 'legs' seen on conventional fixed (i.e., not floating but fixed by some foundation system to the soil) structures, nor does it have the face framing used in conventional structures. Instead the structural concept 10 of the present disclosure consists of a series of structural bays 12. The bays 12 have a spider-like configuration where a central connection 30 supports a number of structural braces (upper 40 and lower 50) that frame out from the central connection 30 to connect to the foundation piles 2 or other structural element (depending on the configuration) of the structure 12. The bays 12 may be made of structural steel, aluminum other metals, fiber reinforced composites, light-weight cementitious or other structural materials.

Applications of the technology include support of offshore structures for oil and gas exploration and production and for generation of wind energy or other alternative energy sources. The technology is equally applicable to support of elevated facilities and equipment in the onshore environment. The design is also applicable as the truss component of floating structures e.g. Truss Spars.

Figure 1B:
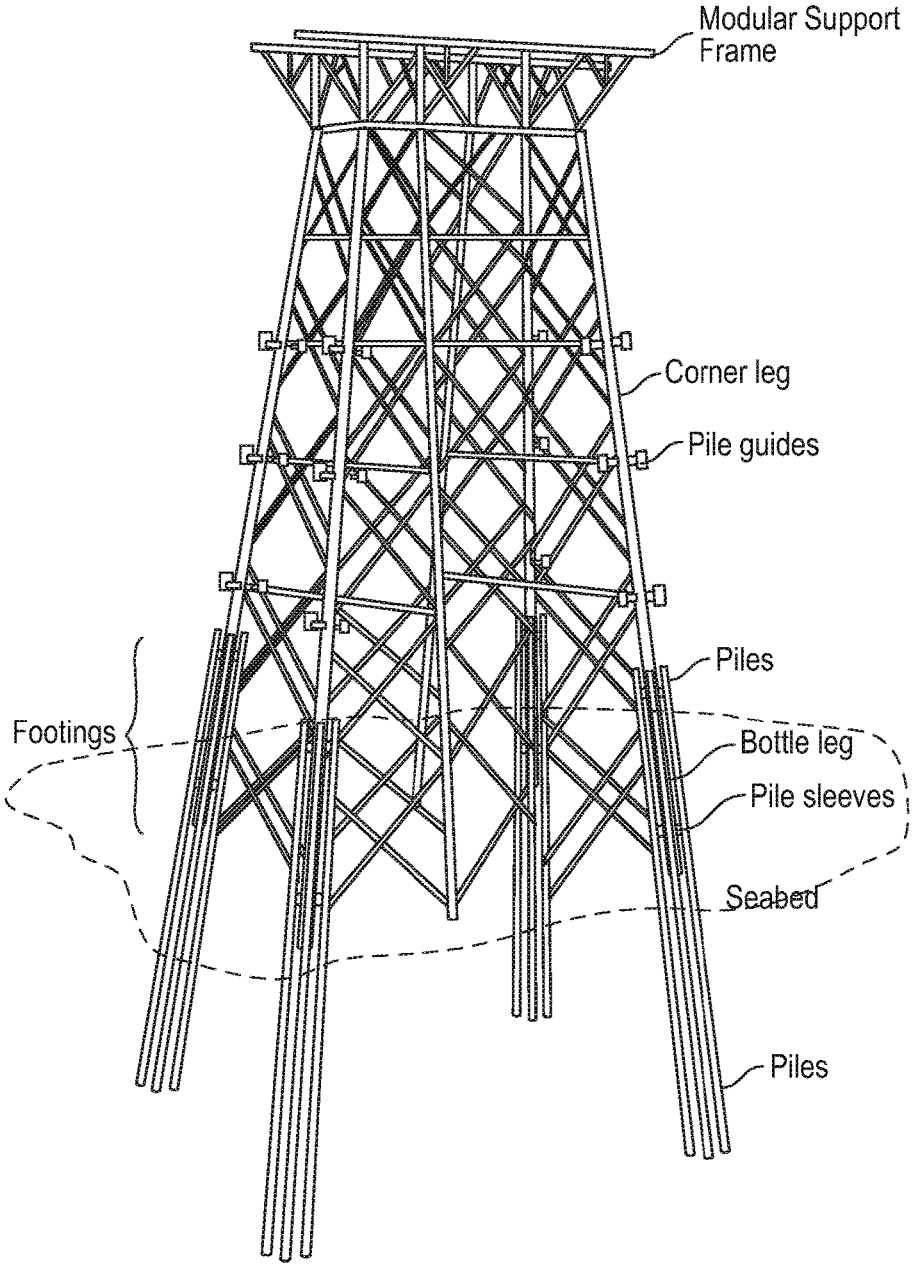
FIG. 1B (Prior Art)
FIG. 1B is a schematic depiction of a conventional, prior art offshore oil and gas platform jacket.
Figure 2A:
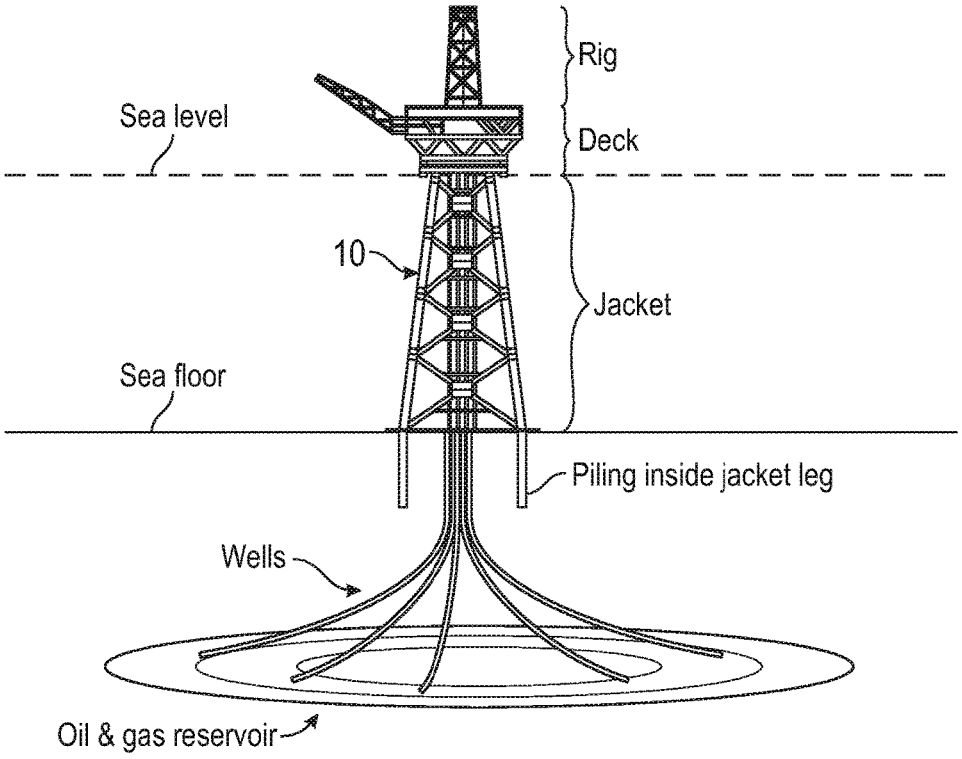
FIG. 2A is a schematic depiction of an installed platform structure (depicted here as an offshore oil and gas platform) employing a new jacket template structure according to one embodiment of the present disclosure.

FIG. 1A shows a schematic depiction of a conventional offshore oil and gas platform known in the art. Between the platform deck and the sea floor is a conventional structural jacket as is known in the art. FIG. 1B illustrates a typical conventional offshore oil and gas platform jacket. FIG. 2A provides an illustration where, with reference to the conventional platform depicted in FIG. 1A, a new jacket template structure 10 is depicted.

Figure 2B:
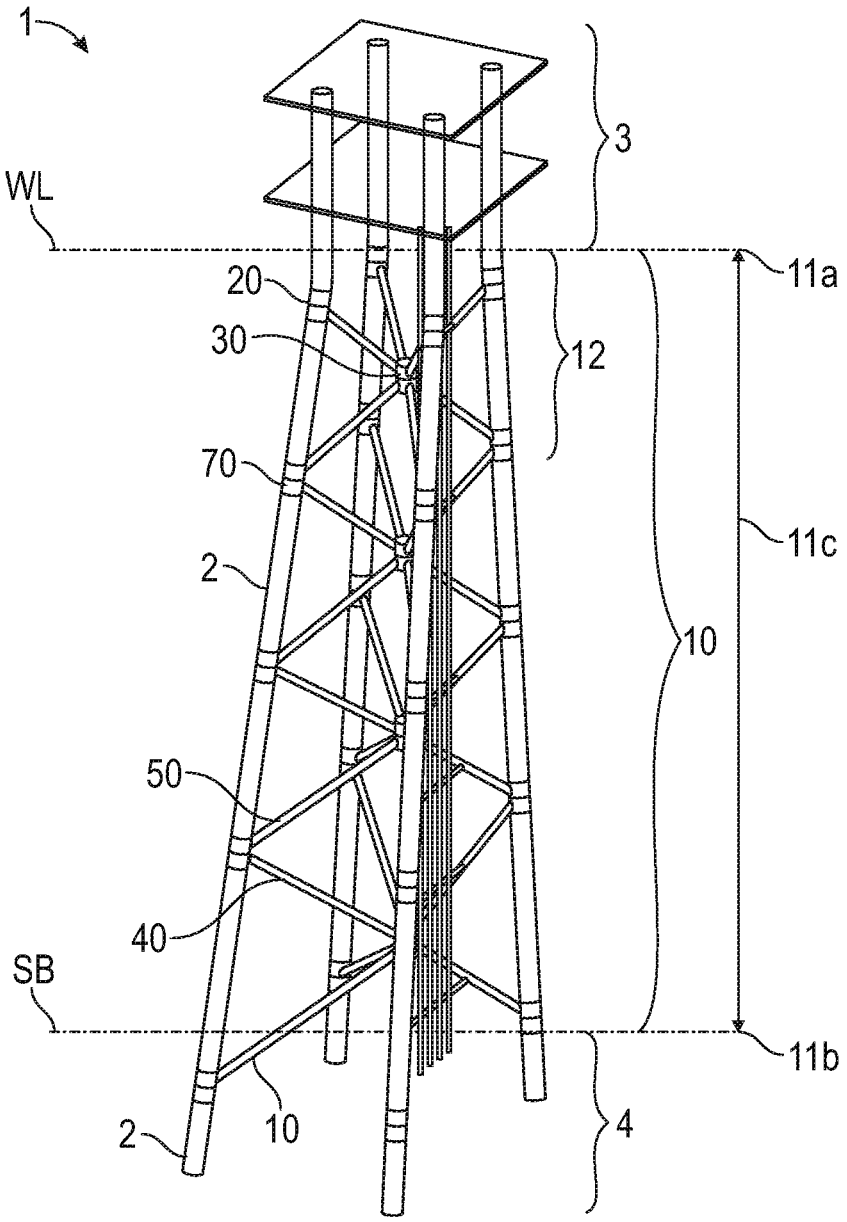
FIG. 2B is a schematic perspective depiction of a platform (here an oil and gas platform) employing a new jacket template structure according to one embodiment of the present disclosure.

Referring also to FIG. 2B, there is depicted an exemplary platform structure 1 (here, an offshore oil and gas platform) employing the new jacket template structure 10 according to one embodiment of the present disclosure. In this general illustration, the jacket template structure 10 supports the platform topsides section 3 above the waterline (WL), and extends downward to the seabed (SB) where it is secured into the seabed foundation 4. The jacket template 10 comprises one or more vertical bay modules 12 attached together in stacked fashion to achieve the desired jacket height 11*c*. In this particular illustration, three bay units 12 are employed, but as will be appreciated by those having the benefit of this disclosure, the jacket template structure 10 can be configured in many different ways employing one or more bay units 12, and, as described below, the configuration of each bay unit 12 can be customized.

As will be described in more detail below, each bay unit 12 comprises a central core member 30, two or more upper arms or braces 40 extending upwardly and outwardly from the core 30 to a desired length(s) 43, and two or more lower arms or braces 50 downwardly and outwardly from the core 30 at a desired length(s) 53. The length of the arms 40, 50 and angle of the arms 60, 63 will determine the overall height 14 of each bay unit. In this embodiment, the end of each upper arm or brace 40 comprises a structural can device 20 for receiving a pile 2 therethrough (via interior channel 23). Likewise, in this embodiment, the end of each lower arm or brace 50 comprises a structural can device 70 for receiving a pile 2 therethrough (via interior channel 73). The piles 2 run generally vertically (or in battered slope) from the top 11*a* of the jacket 10 through each of the cans 20, 70 aligned with such pile, to the bottom of the jacket 11*b* where the piles can be secured into the seabed (SB).

The desired platform topside section 3 (e.g., here depicted as an oil and gas platform deck and rig, etc.) is secured to the top end 11*a* of the jacket template using conventional techniques. Piles extend through the interior channels 23, 73 of cans 20, 70 on the jacket template and are secured into the seabed foundation 4.

Figure 2C:
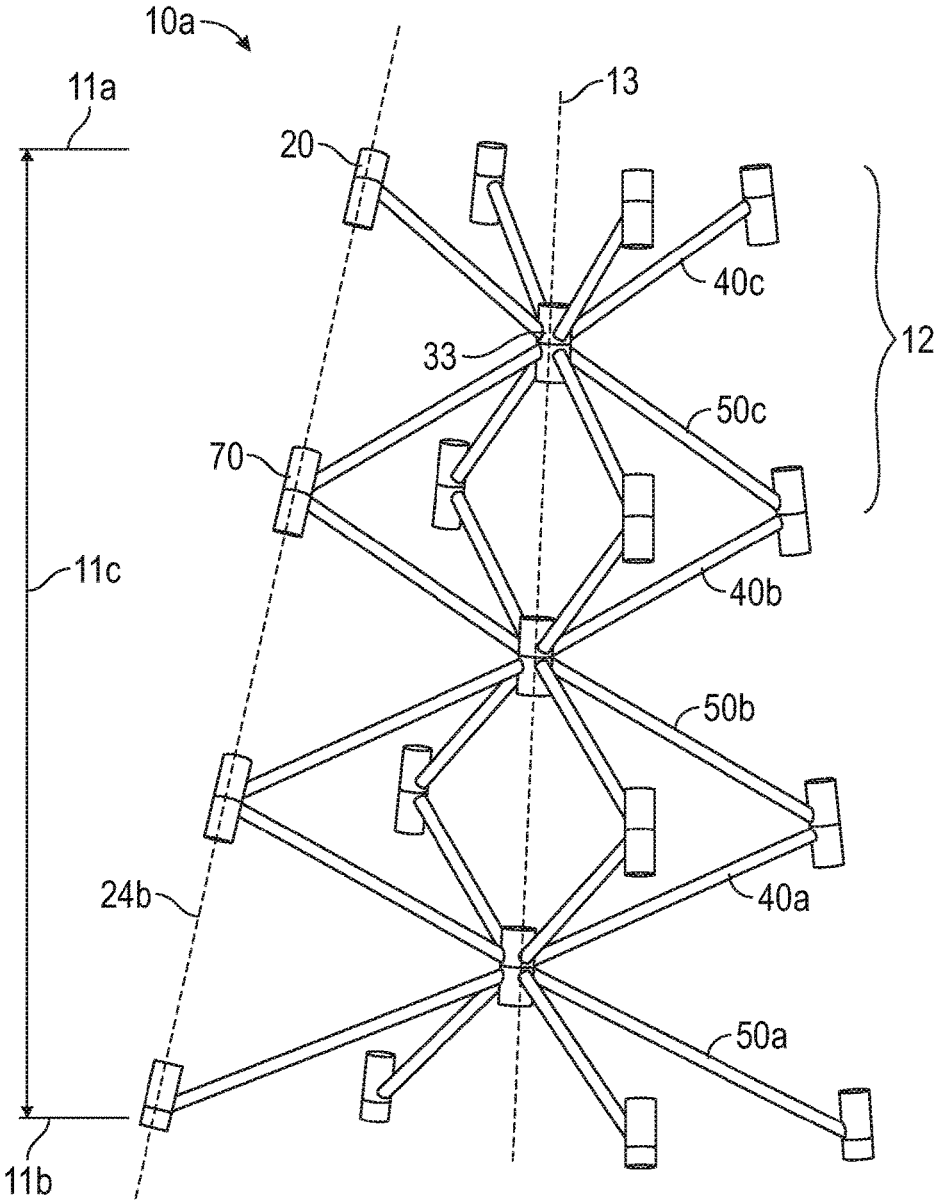
FIG. 2C illustrates an exemplary 4-legged style battered jacket template structure such as that generally depicted in the platform of FIG. 2B.

Referring now to FIG. 2C, there is illustrated an exemplary 4-legged style battered jacket template structure 10*a* such as that generally depicted in the platform of FIG. 2B. In this particular embodiment, each face of the jacket template 10*a* is sloped (battered). The jacket 10*a* has an upper end 11*a* and a lower end 11*b* defining an overall jacket height 11*c*. As will be seen, this particular embodiment employs three four-legged battered bay modules 12 joined together to form a unitary structure 10*a*. As shown, the upper and lower cans 20 of each bay 12 are aligned about a can/pile axis 24. Each bay unit 12 comprises a different size to create the battered faces (here, in this embodiment, generally resembling a truncated pyramid or trapezoidal prism shape). For example, as will be appreciated, in this embodiment, the upper most upper arms 40*c* will likely have a shorter length 43 than the length of the lower most upper arms 40*b*, 40*a* to provide the battering face, however, the battering face can also be created by altering the angles of the arms. The upper most lower arms 50*c* will likely have a shorter length 43 than the length of the lower most lower arms 50*b*, 50*a*, but such battering face can also be achieved by altering the arm angle.

This three level jacket template can be preassembled such that the lower cans 70 of one bay 12 are joined to the upper cans 40 of the bay 12 immediately underneath. In this embodiment, the central bay support member or core 30 of each stacked bay are aligned about a bay central vertical axis 13. The bay central core members 30 can be solid or can be tubular (i.e., having an apertured opening running therethrough along the vertical axis 13.

The overall height 14 and width 15 of each bay module 12 can be varied by, e.g., varying the lengths of the arms 40, 50 and their respective upward or downward angles 60, 63, respectively. Such flexibility also permits creating battered or unbuttered faces where, e.g., the bay structure has no battering (straight vertical sides), partial battering, or full battering (double battering).

Figure 3A:
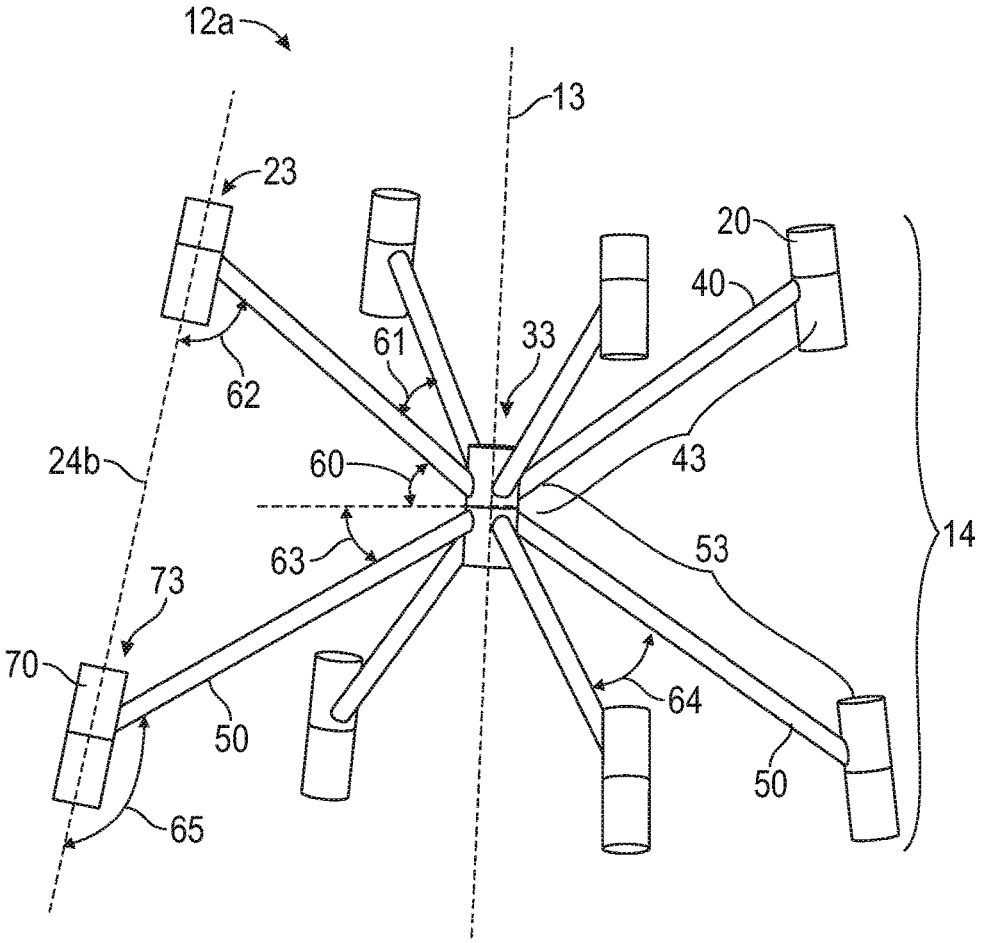
FIG. 3A is a perspective view of a 4-legged (4-pile) style, double battered (vertical), structural bay unit module according to one embodiment of the present disclosure.
Figure 3B:
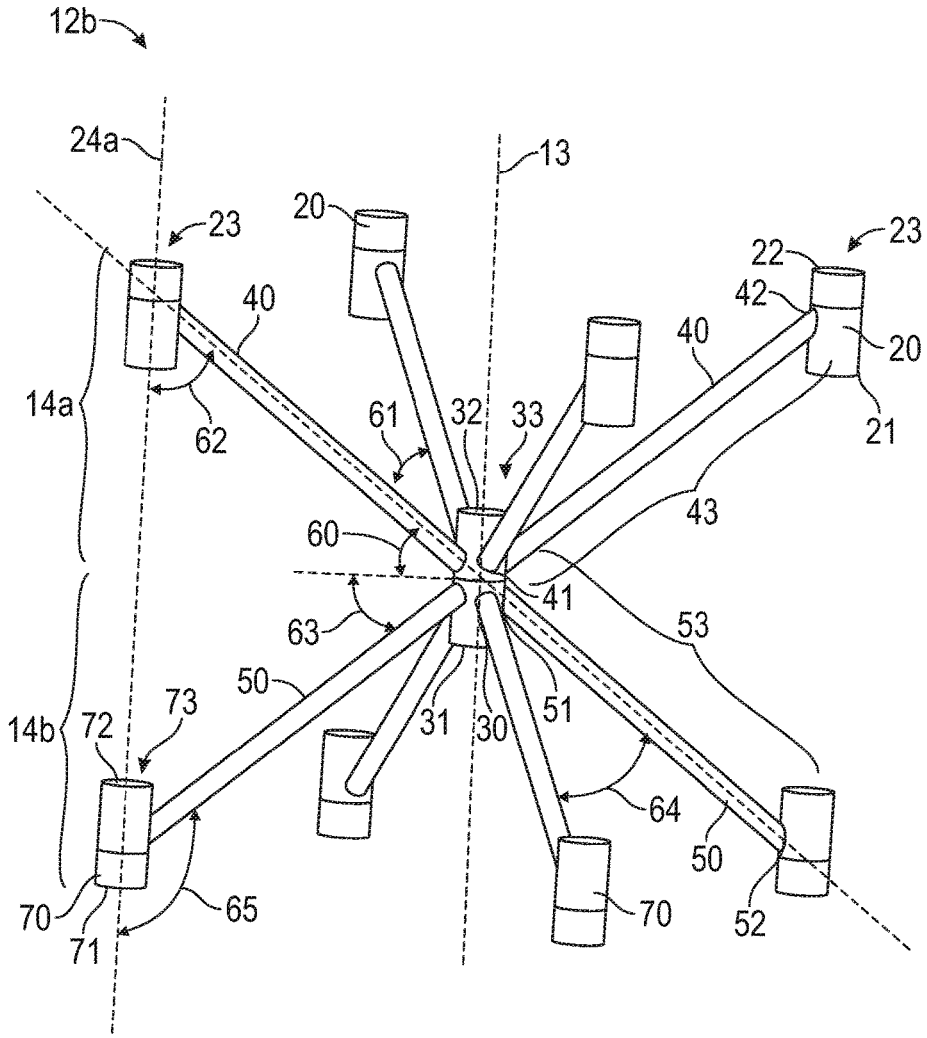
FIG. 3B is a perspective view of a 4-legged (4-pile) style, non-battered (vertical), structural bay unit module according to one embodiment of the present disclosure.
Figure 4:
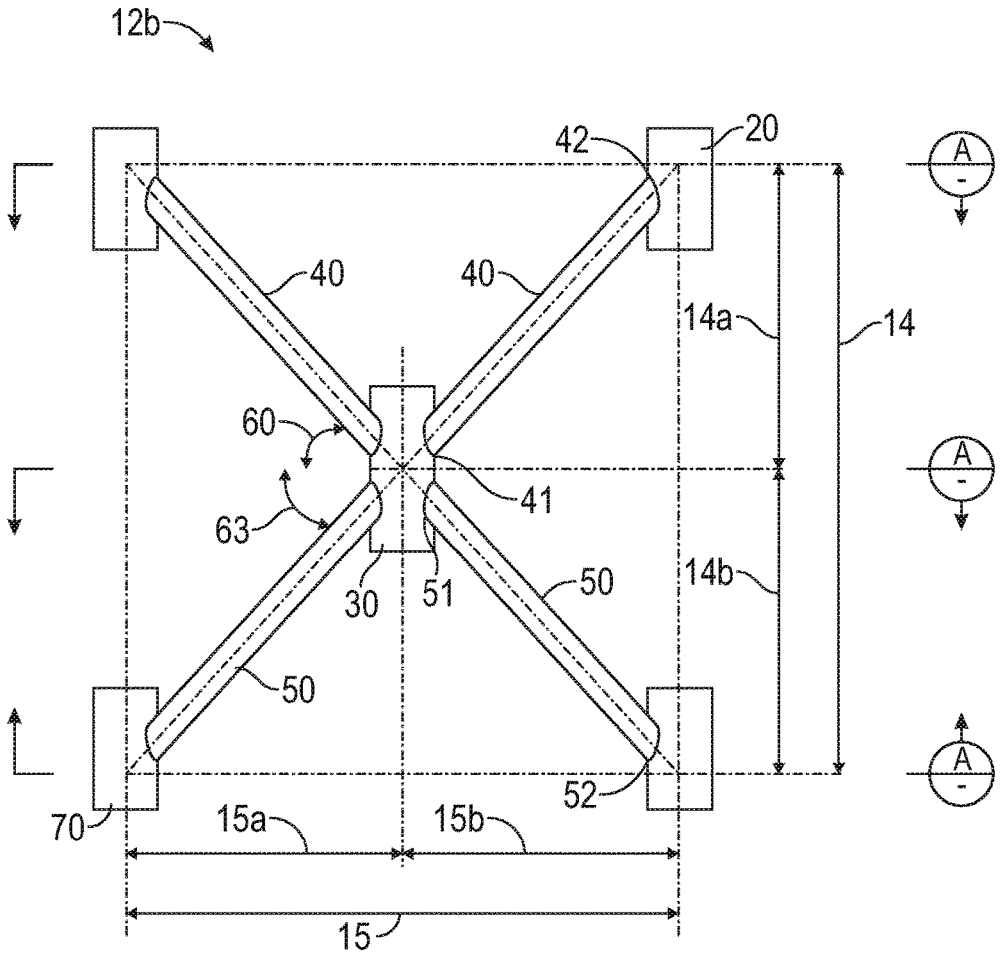
FIG. 4 is a side plan view of the non-battered structural bay unit of FIG. 3B.
Figure 4A:
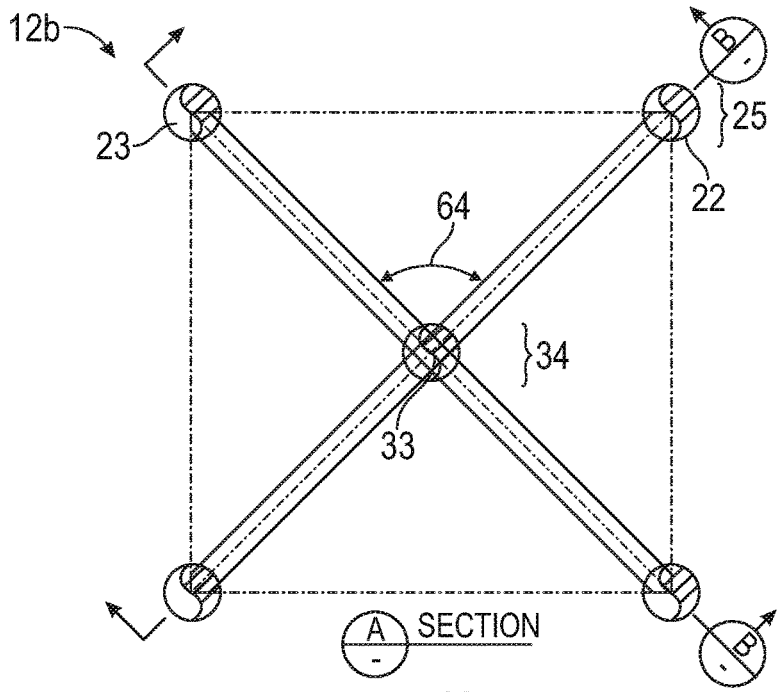
FIG. 4A is a cross-sectional view of the bay unit of FIG. 4 taken along lines 4A-4A.
Figure 4B:
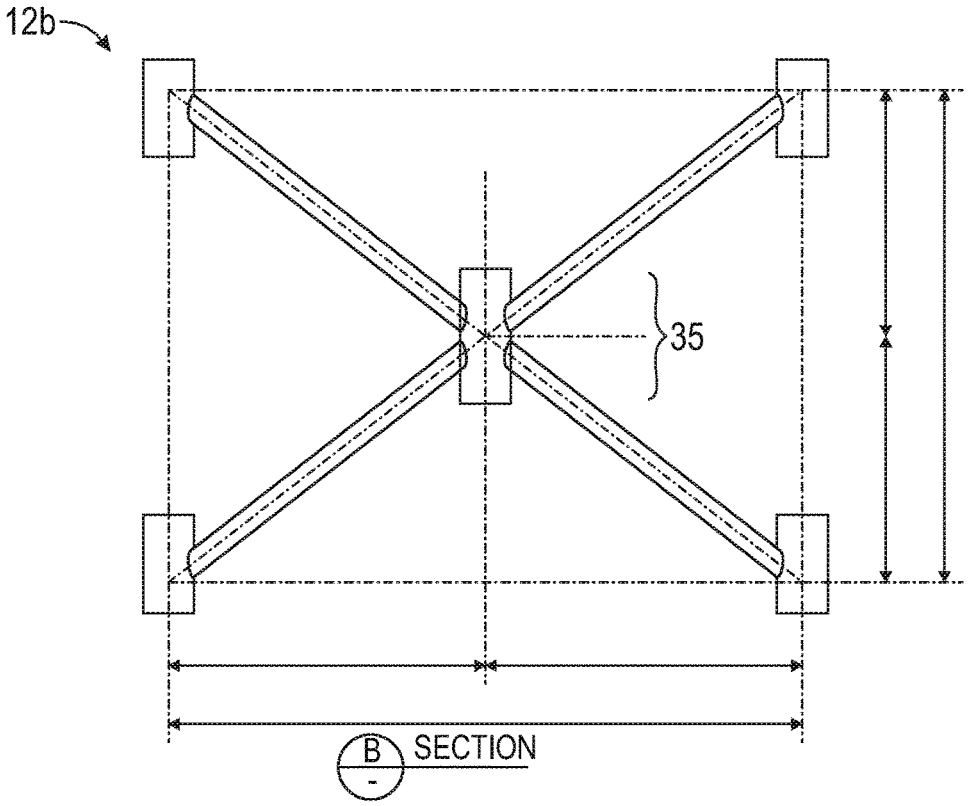
FIG. 4B is a cross-sectional view of the bay unit of FIG. 4A taken along lines 4B-4B.

Reference is now made to FIGS. 3A, 3B, 4, 4A and 4B for description of exemplary bays 12 according to embodiments of the present disclosure. FIG. 3A shows an exemplary 4-legged (4-pile) style, double battered (vertical), structural bay unit module 12*a*. FIG. 3B shows an exemplary 4-legged (4-pile) style, non-battered (vertical), structural bay unit module 12*b*. FIGS. 4, 4A and 4B show additional views of the nonbattered bay depicted in FIG. 3B.

The vertical bay unit 12*a*, 12*b* comprises a central core support member 30 having a lower end 31 and an upper end 32 defining a length ($L_C$) 35. The core member 30 may be tubular with an internal open annulus or channel 33 of a desired diameter ($D_A$) 34 and having a vertical axis 13, or can be of a solid construction, e.g. block, round stock, I-beam, etc.

Three or more upper structural braces 40 (of desired length 43) are attached (via known techniques, such as welding, molding, threading and the like) to the core 30 at the upper brace bottom ends 41 and extend outwardly and upwardly from the core 30 a desired length 43 to the upper brace upper end 42. This forms what may be referred to as the upper half 14*a* (or overall height of the upper bay half) of the bay 12, 12*a*, 12*b*. The upper braces 40 extend upwardly from the core 30 at a desired upward angle ($\theta_u$) 60 (relative to horizontal). Each bay upper structural brace 40 is preferably equally (radially) spaced apart about the vertical axis 13 from the adjacent braces 40 at a desired horizontal spacing angle ($\theta_h$) 62. Other spacing arrangements are possible. The upper braces 40 attach to the core 30 at their bottom ends 41 and extend a desired length 43 to their upper ends 42.

At the upper end 42 of each upper brace 40, a tubular upper can 20 is attached by known techniques. The tubular upper cans 20 comprise upper can bottom edge 21, upper can top edge 22, and upper can interior channel or annular space 23 having a can interior diameter 25. The cans 20 are capable of receiving a pile 2 (not shown) therethrough (via annular space 33).

Similarly, three or more lower structural braces 50 (of desired length 53) are attached (via known techniques, such as welding, molding, threading and the like) to the core 30 at the lower brace upper ends 51 and extend outwardly and downwardly from the core 30 a desired length 53 to the lower brace lower end 52. This forms what may be referred to as the lower half 14*b* (or overall height of the lower bay half) of the bay 12, 12*a*, 12*b*. The lower braces 50 extend downwardly from the core 30 at a desired downward angle ($\theta_d$) 63 (relative to horizontal). Each bay lower structural brace 50 is preferably equally (radially) spaced apart about the vertical axis 13 from the adjacent braces 50 at a desired horizontal spacing angle ($\theta_h$) 64. Other spacing arrangements are possible. The lower braces 50 attach to the core 30 at their top ends 51 and extend a desired length 53 to their lower ends 52.

At the lower end 52 of each lower brace 50, a tubular lower can 70 (similar to upper can 20) is attached by known techniques. The tubular lower cans 70 comprise lower can bottom edge 71, lower can top edge 72, and lower can interior channel or annular space 73 having a can interior diameter 25. The cans 70 are capable of receiving a pile 2 (not shown) therethrough (via annular space 73).

The upper and lower cans 20, 70 can be mounted to the respective support arm ends 42, 52 and be oriented at the appropriate can angle ($\theta_c$) 62, 65 to align the respective can interior channels 23, 73 along a desired can/pile axis 24. In the embodiment shown in FIG. 3A, the bay 12*b* is a double battered shape resulting in the pile axis 24*b* being angled at a downward and outward slope relative to the ground (seafloor). Each of the respective upper and lower cans 20, 70 (can sets) is aligned about its respective can axis 24*b*. In this embodiment, can axis 24*b* is not parallel to central core axis 13.

In the embodiment of FIG. 3B, the bay 12*b* is a non-battered configuration where the can sets (20, 70) align with each other in a substantially vertical orientation along can axis 24*a*. In this embodiment, can axis 24*a* is substantially parallel to central core axis 13.

As will be seen in the embodiments of FIGS. 3A and 3B, the bay top half 14*a* and bay bottom half 14*b* are depicted as being mirror images of each other, with each top can 20 being aligned along the same axis 24*a* or 24*b* as its counterpart lower can 70. In these particular embodiments, the a desired horizontal spacing angles ($\theta_{hl}$) 64 between the lower arms 50 and the desired horizontal spacing angles ($\theta_{hu}$) 61 between the upper arms is 90°. It is therefore preferred that the upper arms 40 be equally radially spaced apart from each other about the central core axis 13. Similarly, it is therefore preferred that the lower arms 50 be equally radially spaced apart from each other about the central core axis 13. These horizontal angles ($\theta_{hl}$, $\theta_{hu}$) could be varied on the top half 14*a* and correspondingly on the bottom half 14*b*.

The bays 12 can be extended or shortened in overall height 14 by adjusting the angle of the brace incidence at the central connection 30. Referring, for example, to FIG. 4, the height 14 can be divided into the upper arm section height

14*a* and the lower arm section height 14*b*, and overall height adjustment can be achieved by altering the upper arm section height 14*a* and/or the lower arm section height 14*b*. Similarly, the overall bay width 15 (divided into a left width 15*a* and right width 15*b*), can be varied by altering the right width 15*a* and/or the left width 15*b* (or via adjustment of the heights 14*a*, 14*b*).

Figure 17A:
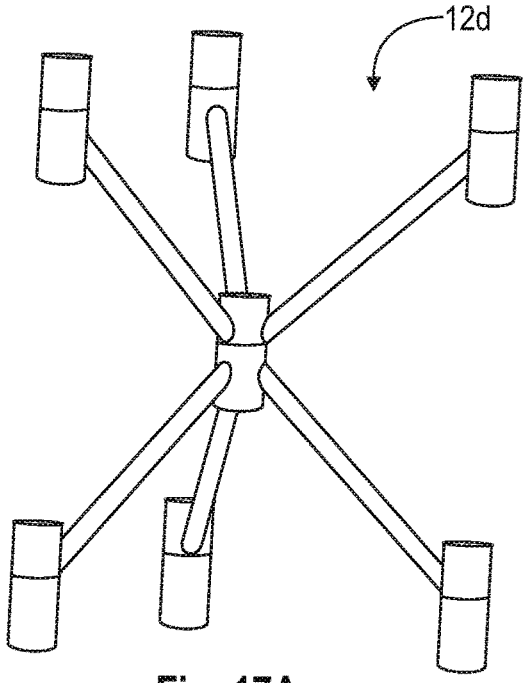
FIG. 17A is a perspective view of a 3-legged style, non-battered (vertical), single structural bay unit according to one embodiment of the present disclosure.
Figure 17B:
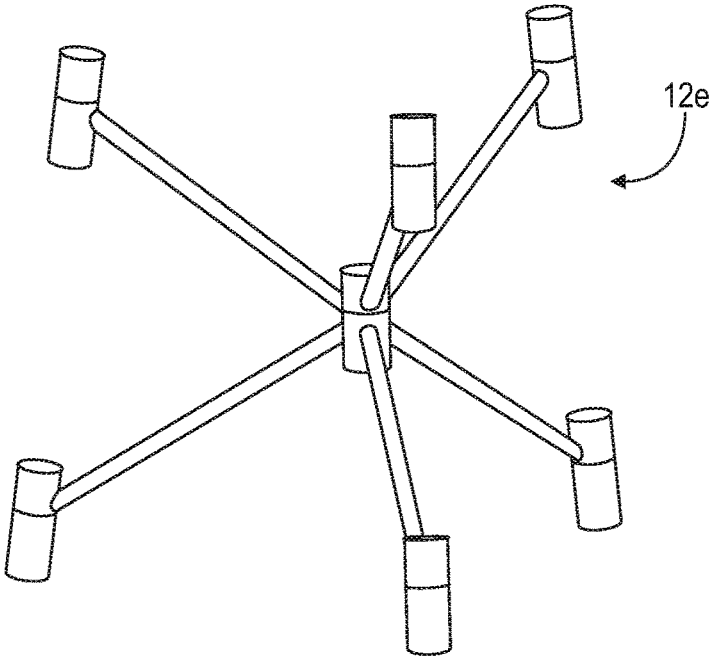
FIG. 17B is a perspective view of a 3-legged style battered, single structural bay unit according to one embodiment of the present disclosure.
Figure 28A:
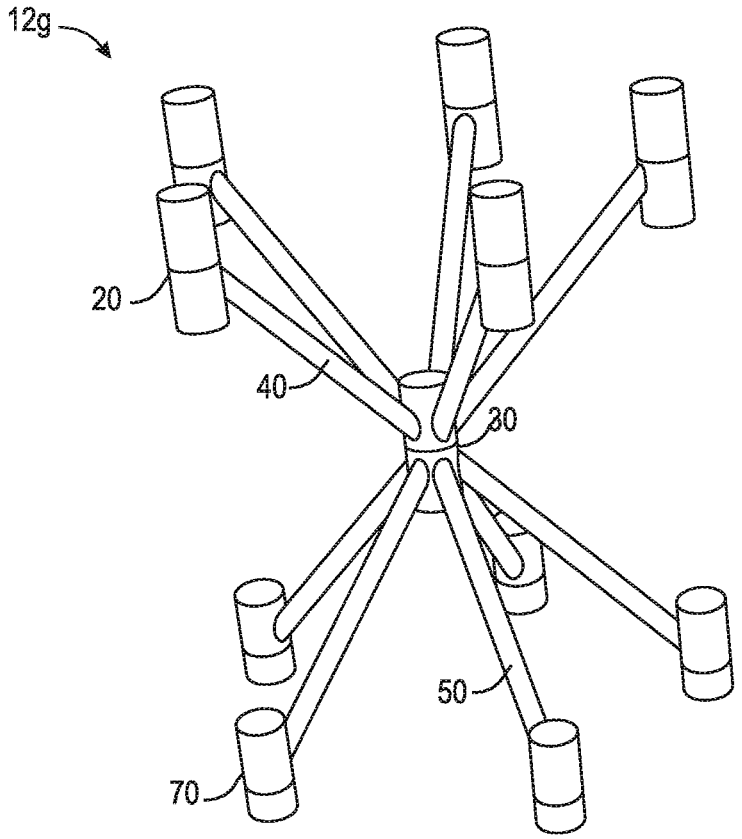
FIG. 28A is a perspective view of a 5-legged style, single structural bay unit according to one embodiment of the present disclosure.
Figure 28B:
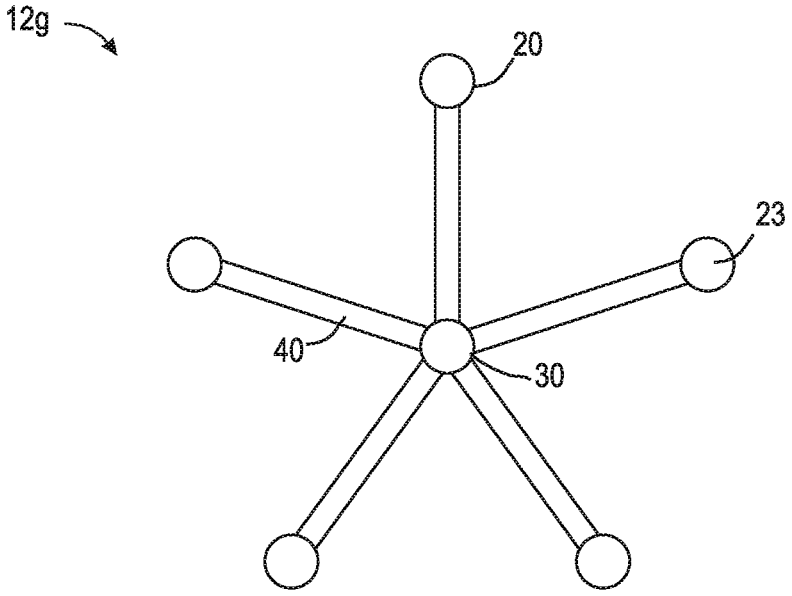
FIG. 28B is a top plan view of the 5-legged style, single structural bay unit of FIG. 28A.
Figure 29A:
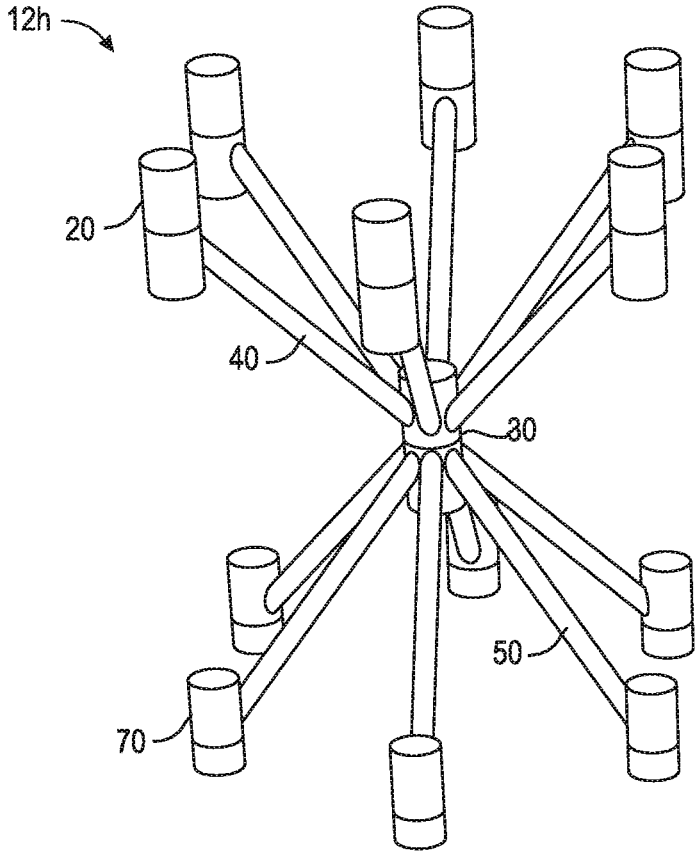
FIG. 29A is a perspective view of a 6-legged style, single structural bay unit according to one embodiment of the present disclosure.
Figure 29B:
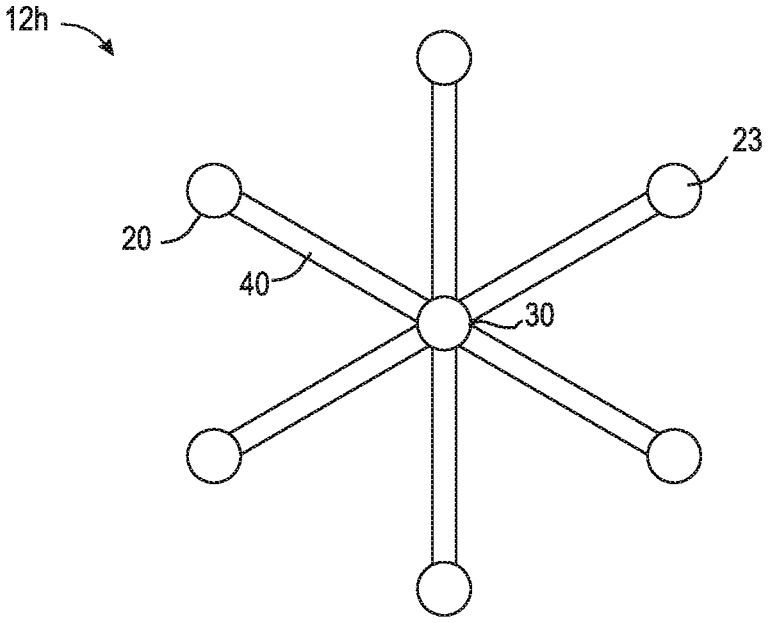
FIG. 29B is a top plan view of the 6-legged style, single structural bay unit of FIG. 29A.

Although the basic bay configurations shown in FIGS. 3A, 3B, 4, 4A and 4B depict the upper bay half comprising four upper arms 40 and four lower arms 50 (collectively referred to as a four legged or four pile style structure), the number of arms used can vary from three e.g., (FIGS. 17A, 17B, 18, 19 (three legged style bay)) to eight or more. For example, FIGS. 17A and 17B depict three legged single structural bay unit configurations 12*d*, 12*e*, FIGS. 28A and 28B depict a five legged bay unit configuration 12*g*, and FIGS. 29A and 29B depict a six legged bay unit configuration 12*h*. However, increasing the number of arms that extend from the central core 30 will decrease the openings between equally spaced arms and increase the weight of the bay.

Figure 20:
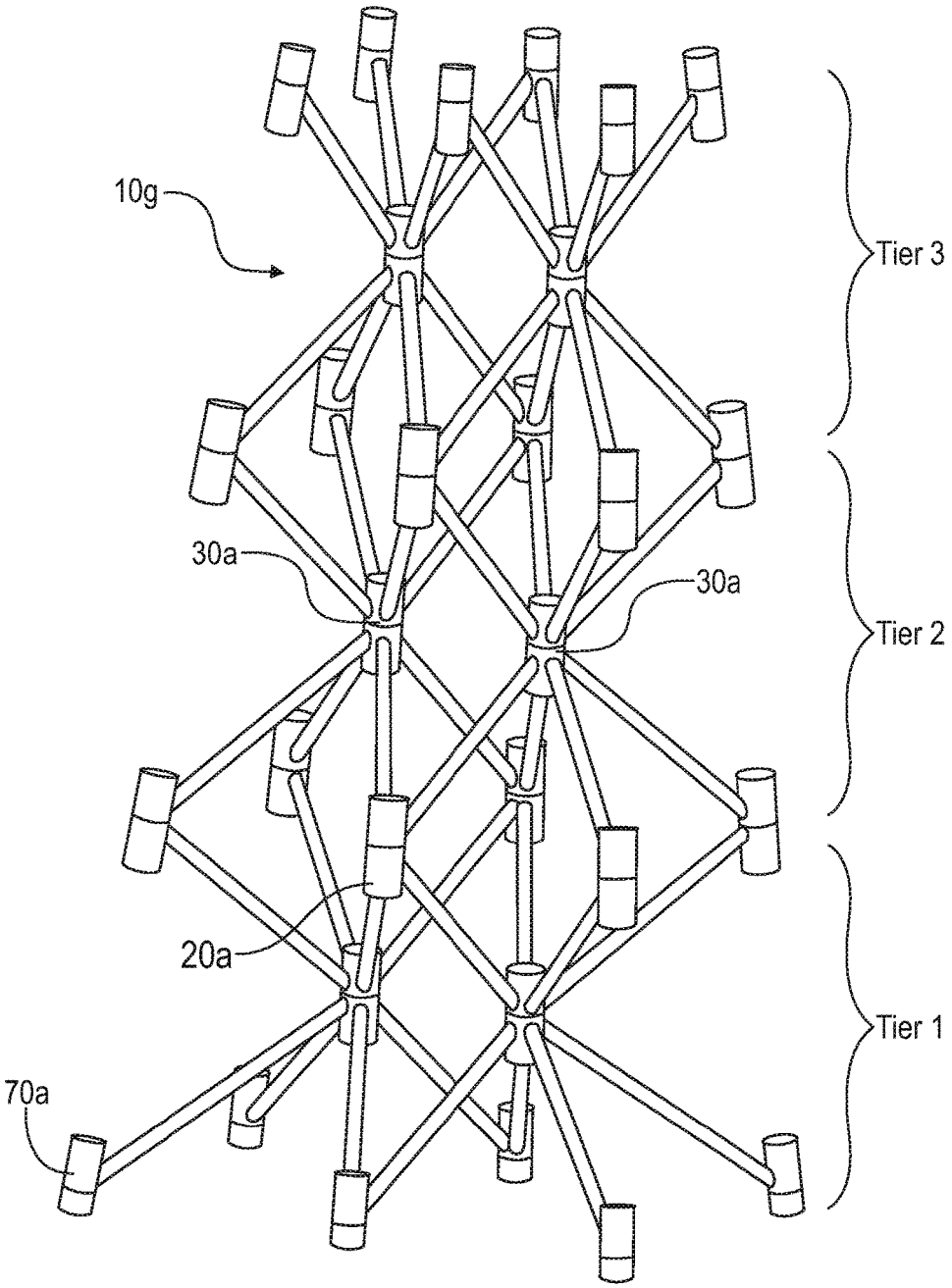
FIG. 20 is a perspective view of a vertically oriented 6-legged style double battered jacket template structure constructed of multiple, stacked bay units according to one embodiment of the present disclosure.
Figure 20A:
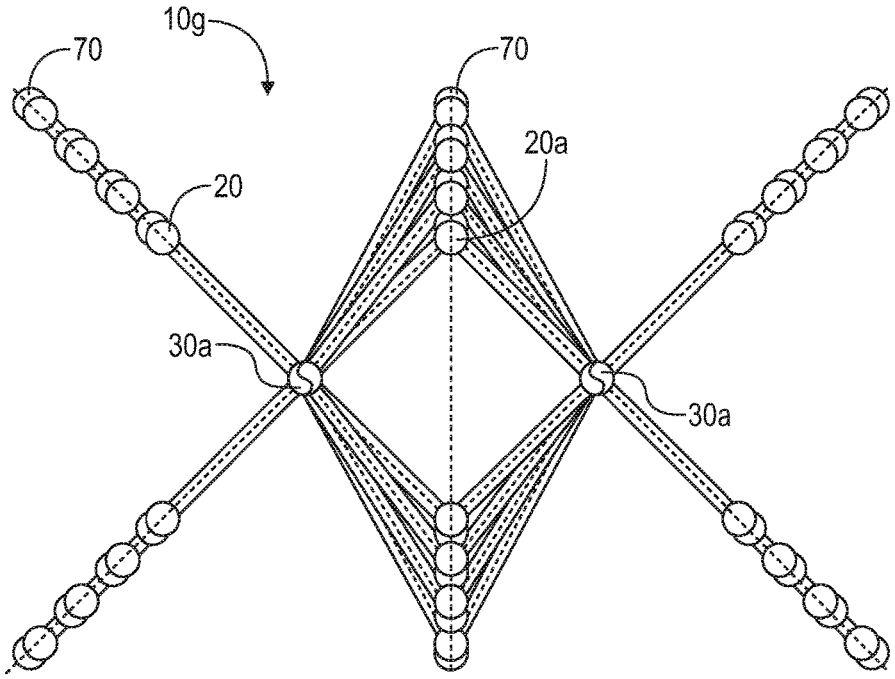
FIG. 20A is a top plan view of the structure of FIG. 20.
Figure 20B:
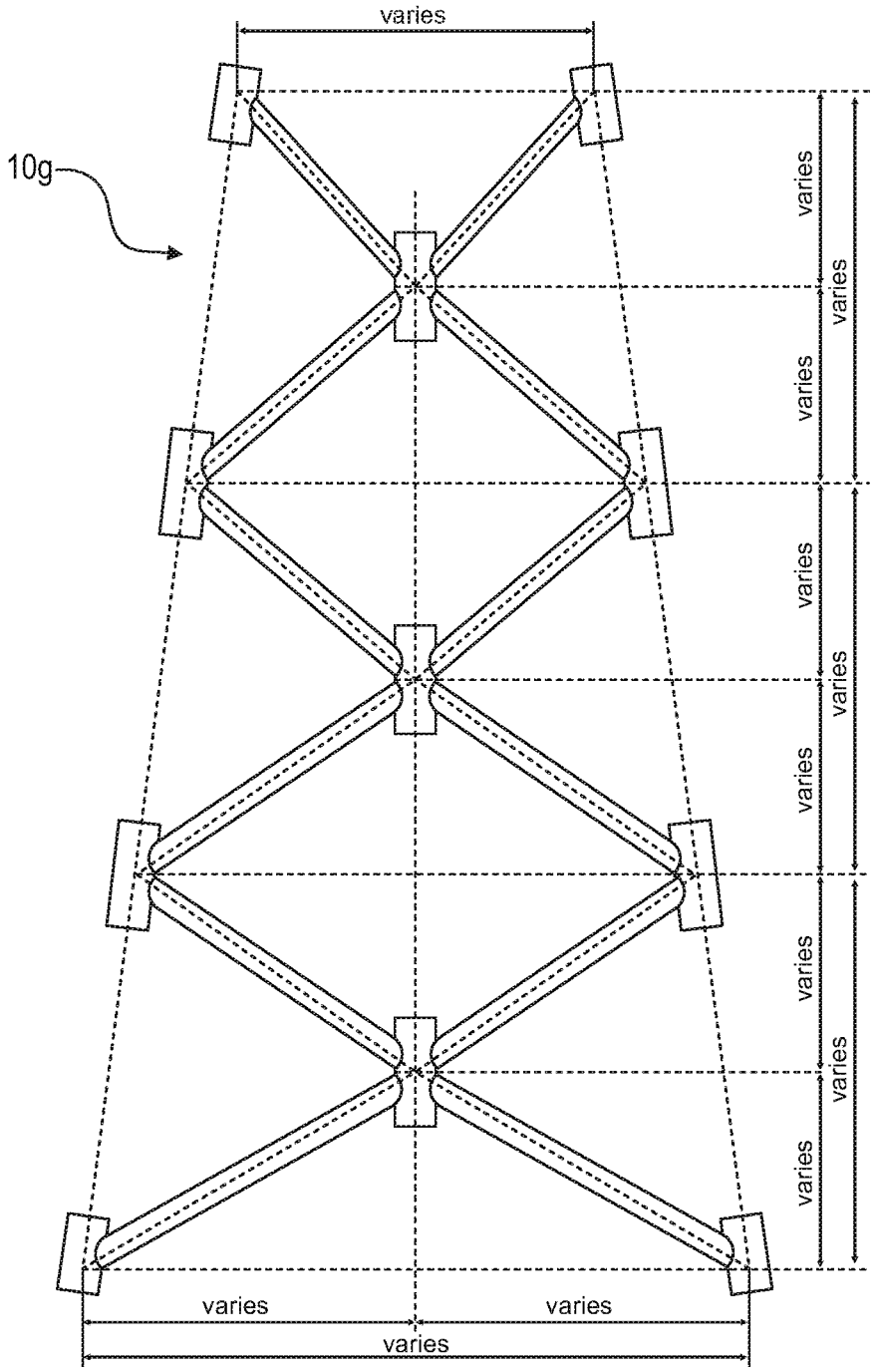
FIG. 20B is a side plan view of the structure of FIG. 20.
Figure 20C:
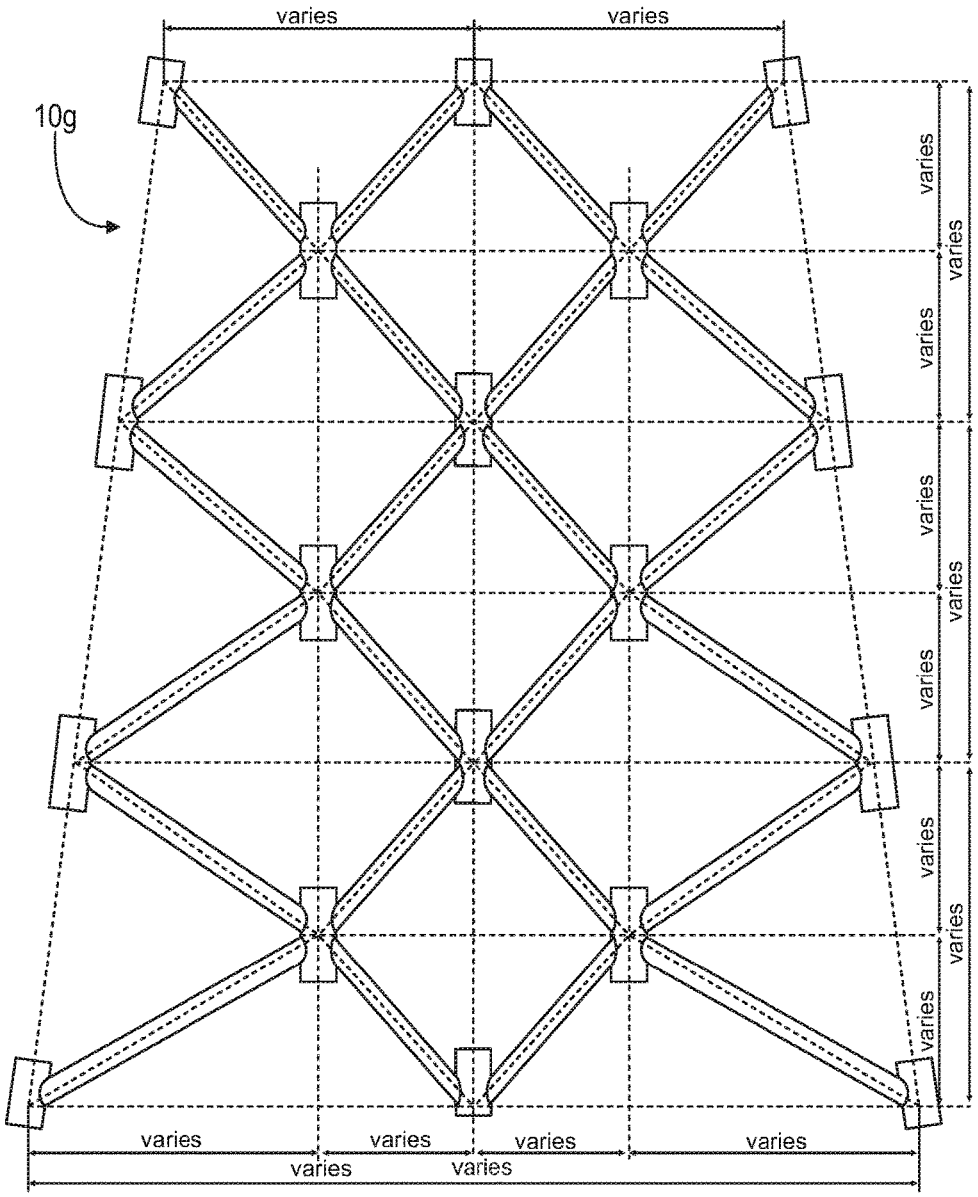
FIG. 20C is another side plan view of the structure of FIG. 20.
Figure 21:
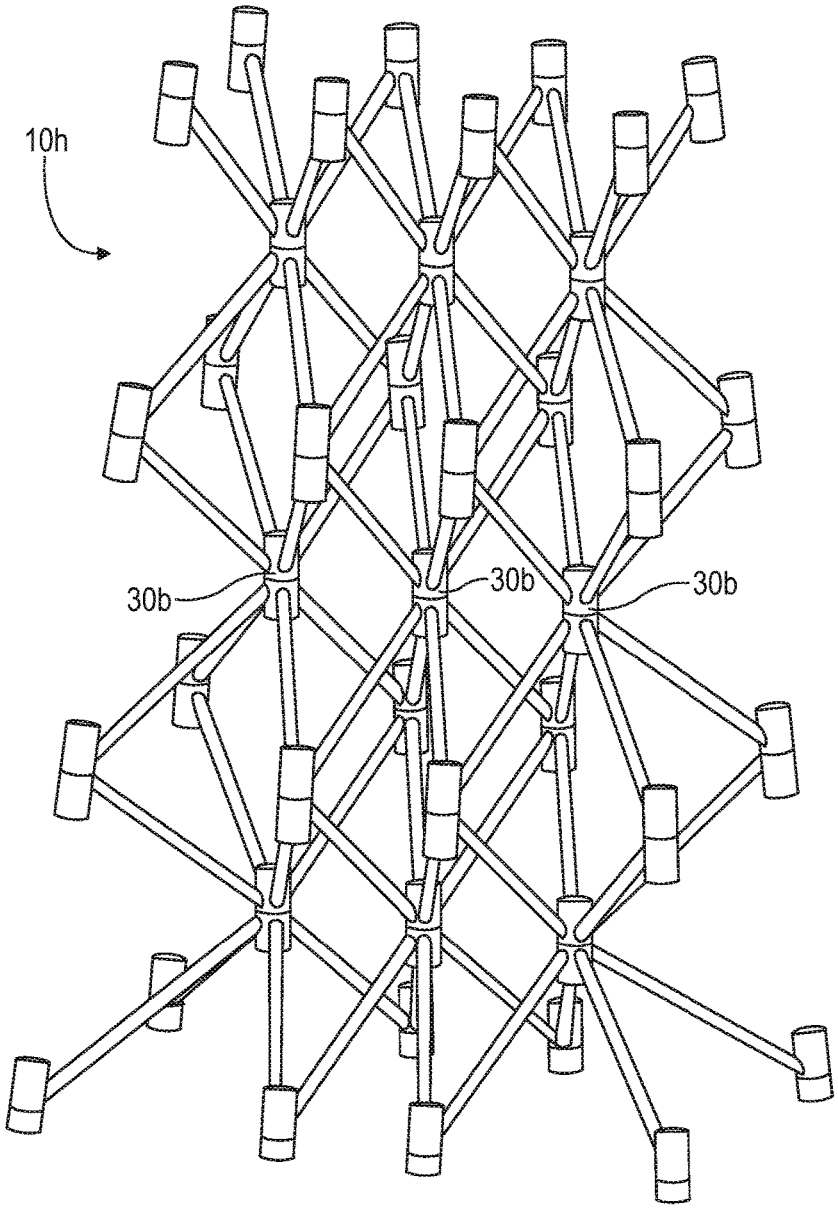
FIG. 21 is a perspective view of a vertically oriented 8-legged style double battered jacket template structure constructed of multiple, stacked bay units according to one embodiment of the present disclosure.
Figure 21A:
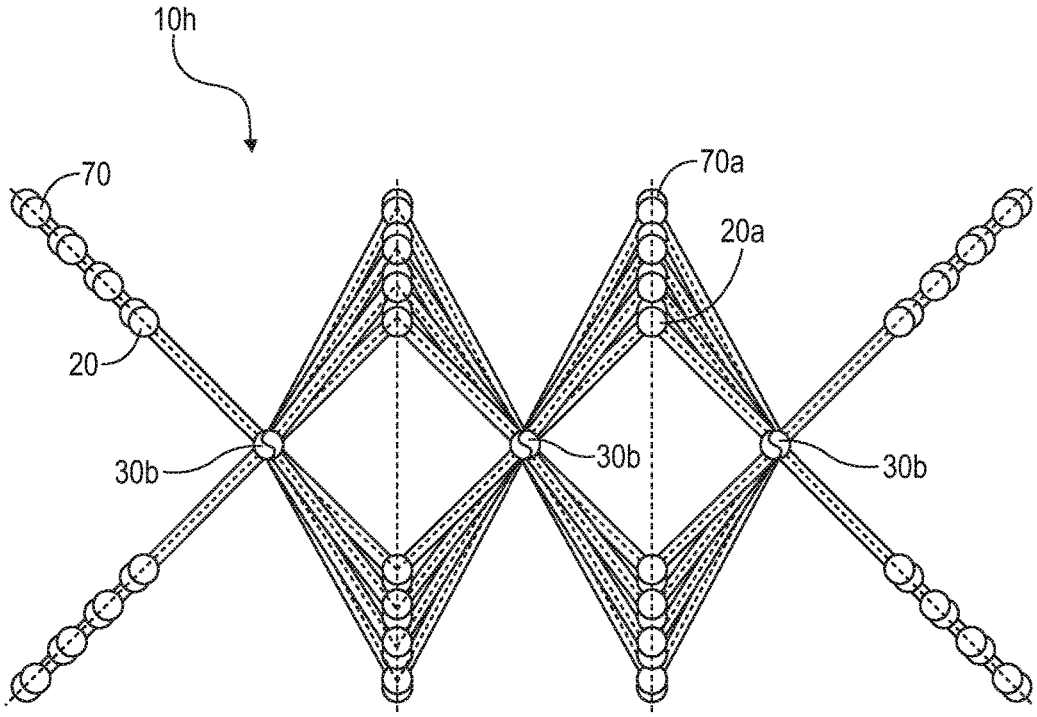
FIG. 21A is a top plan view of the structure of FIG. 21.
Figure 21B:
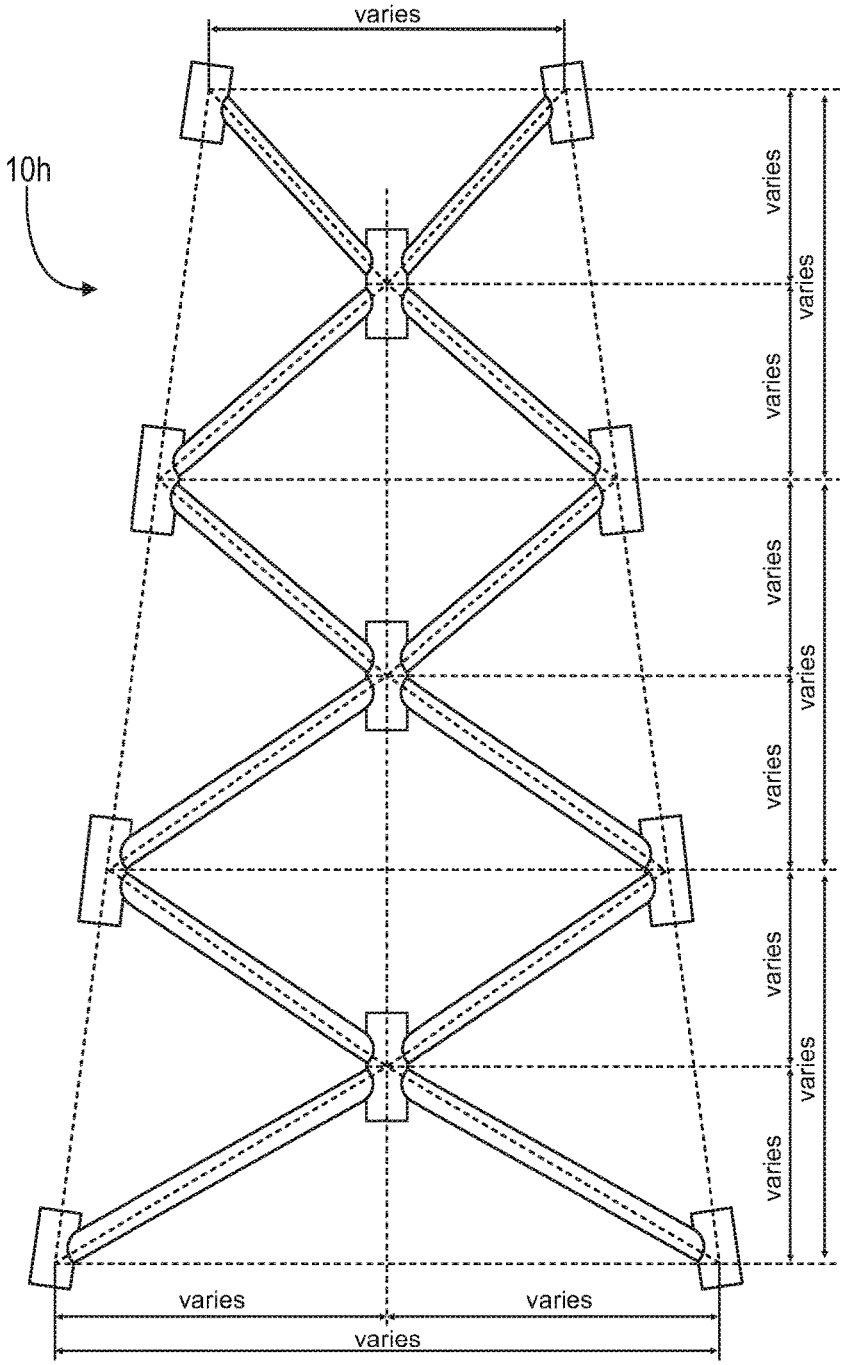
FIG. 21B is a side plan view of the structure of FIG. 21.
Figure 21C:
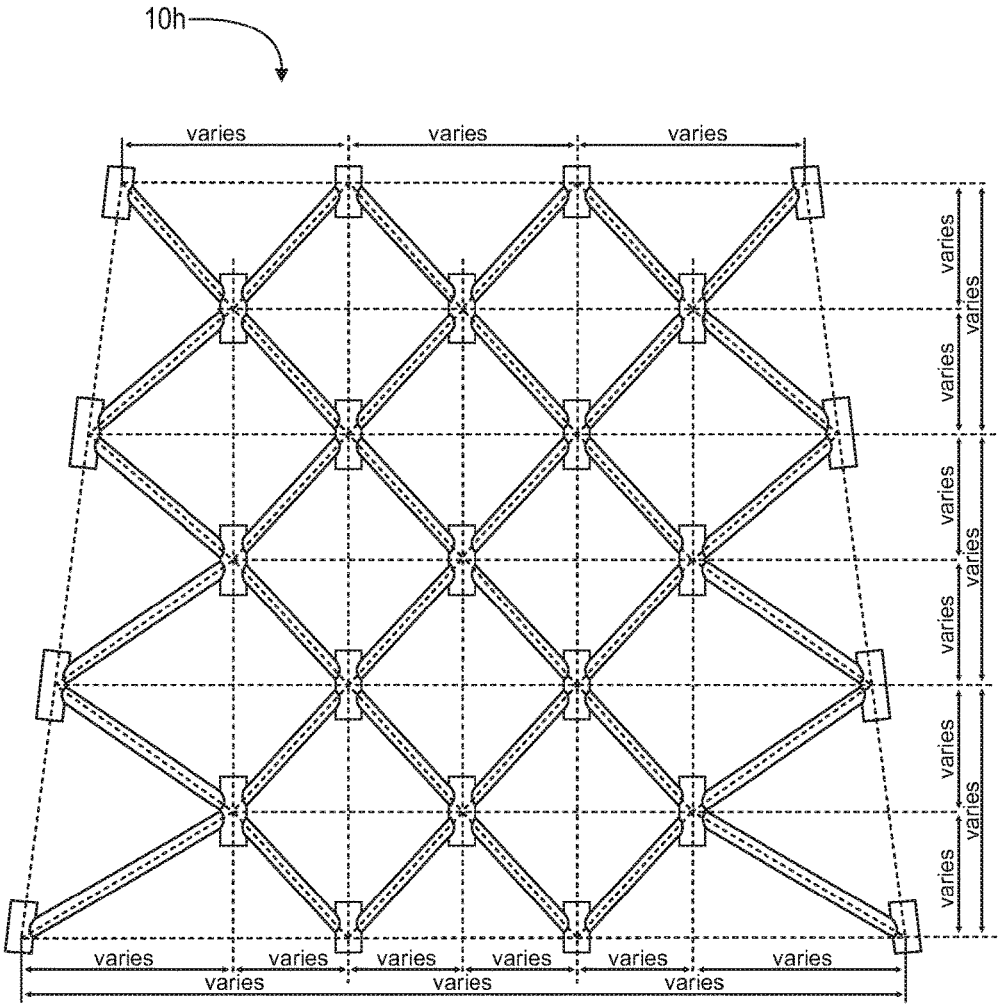
FIG. 21C is another side plan view of the structure of FIG. 21.

Additionally, as noted below, the bay module 12 can be modified to include more than one central core within the same horizontal plane. See discussion below regarding, e.g., FIGS. 20 and 21.

Figure 5:
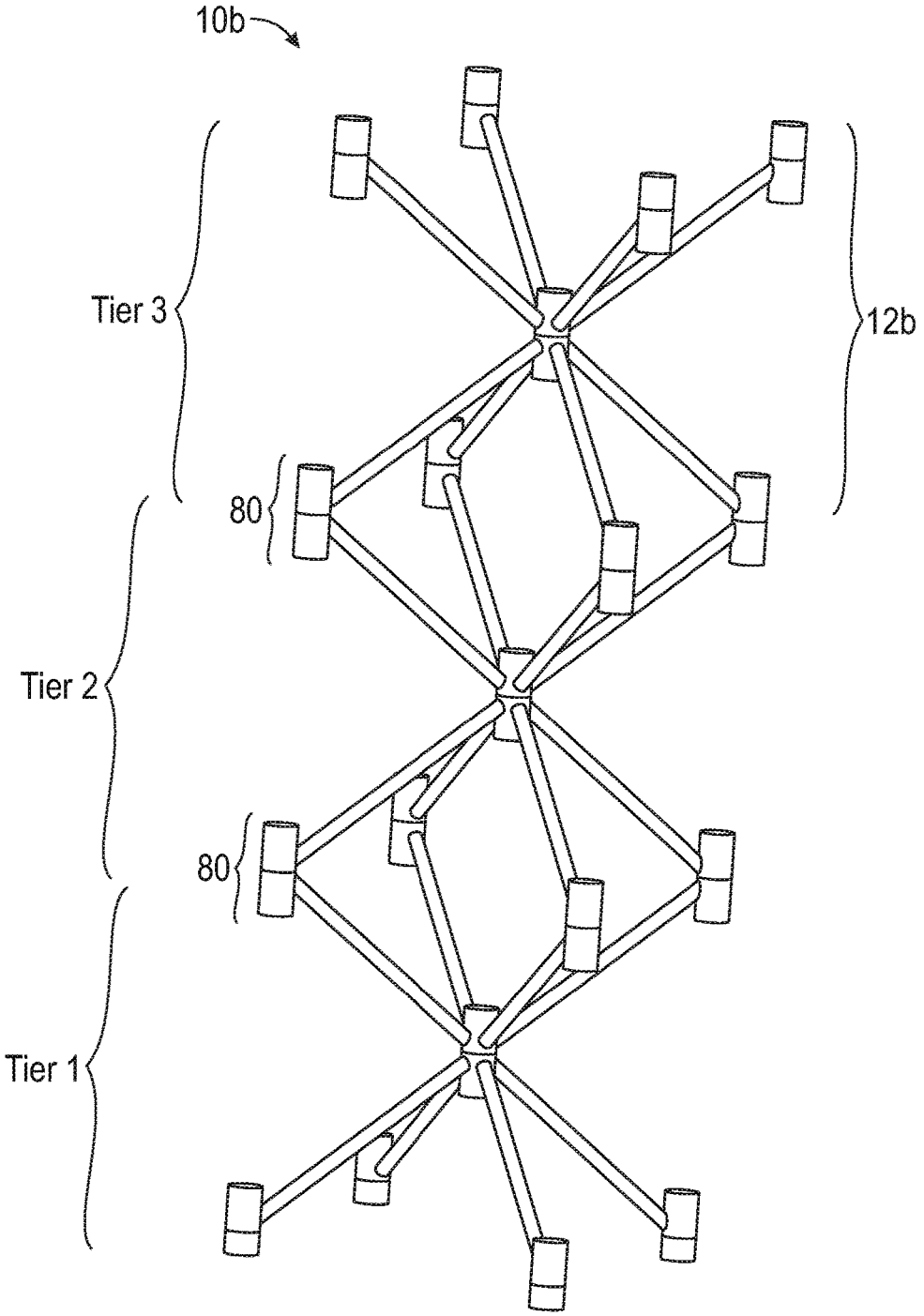
FIG. 5 is a perspective view of a single-lift, vertically oriented prefabricated 4-legged style jacket template structure constructed of multiple, stacked bay units, such as the bay unit module in FIG. 3B, according to one embodiment of the present disclosure.
Figure 6:
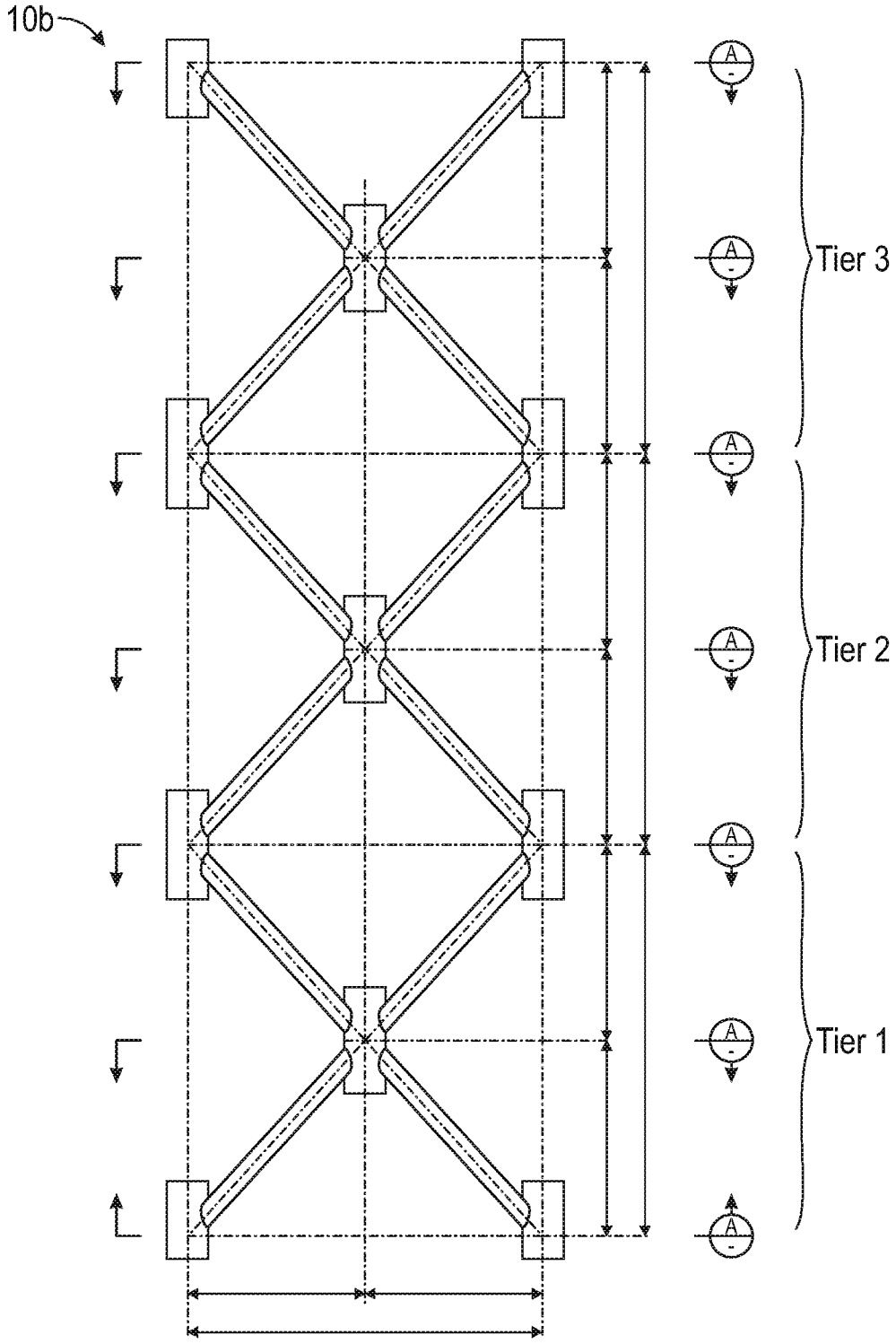
FIG. 6 is a side plan view of the structure of FIG. 5.
Figure 6A:
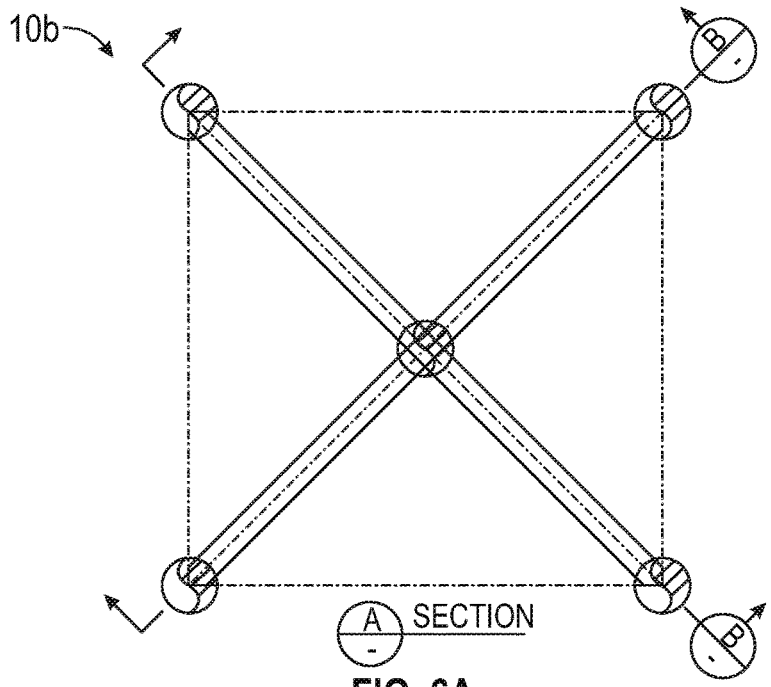
FIG. 6A is a cross-sectional view of the structure of FIG. 6 taken along lines 6A-6A.
Figure 6B:
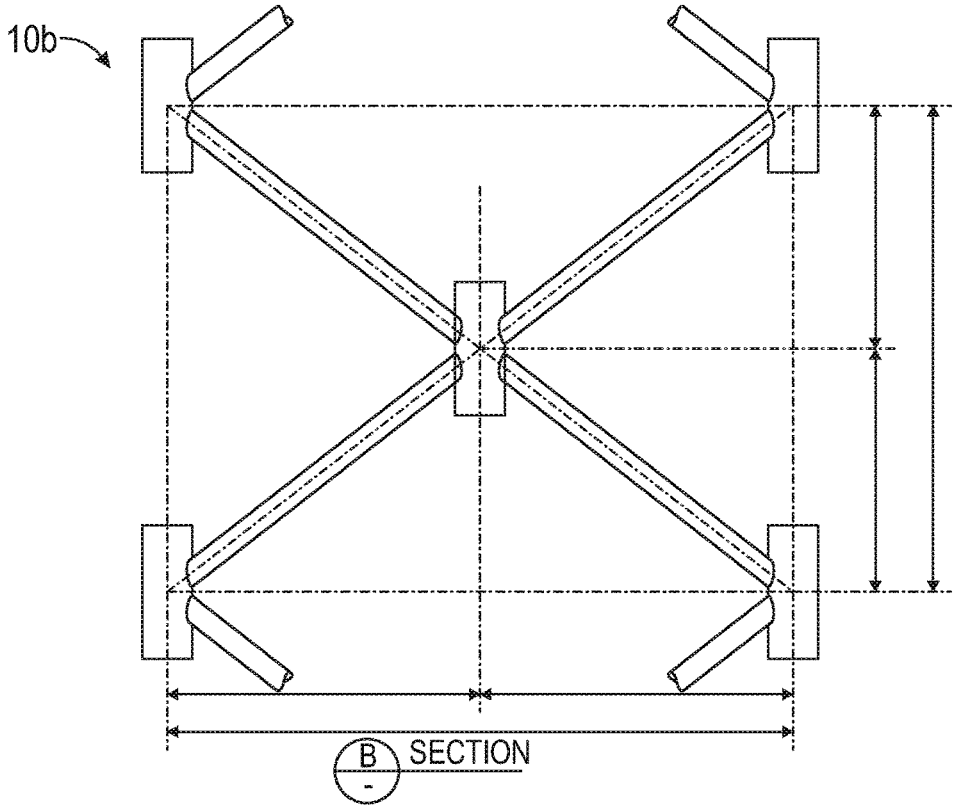
FIG. 6B is a cross-sectional view of the structure of FIG. 6A taken along lines 6B-6B.
Figure 7:
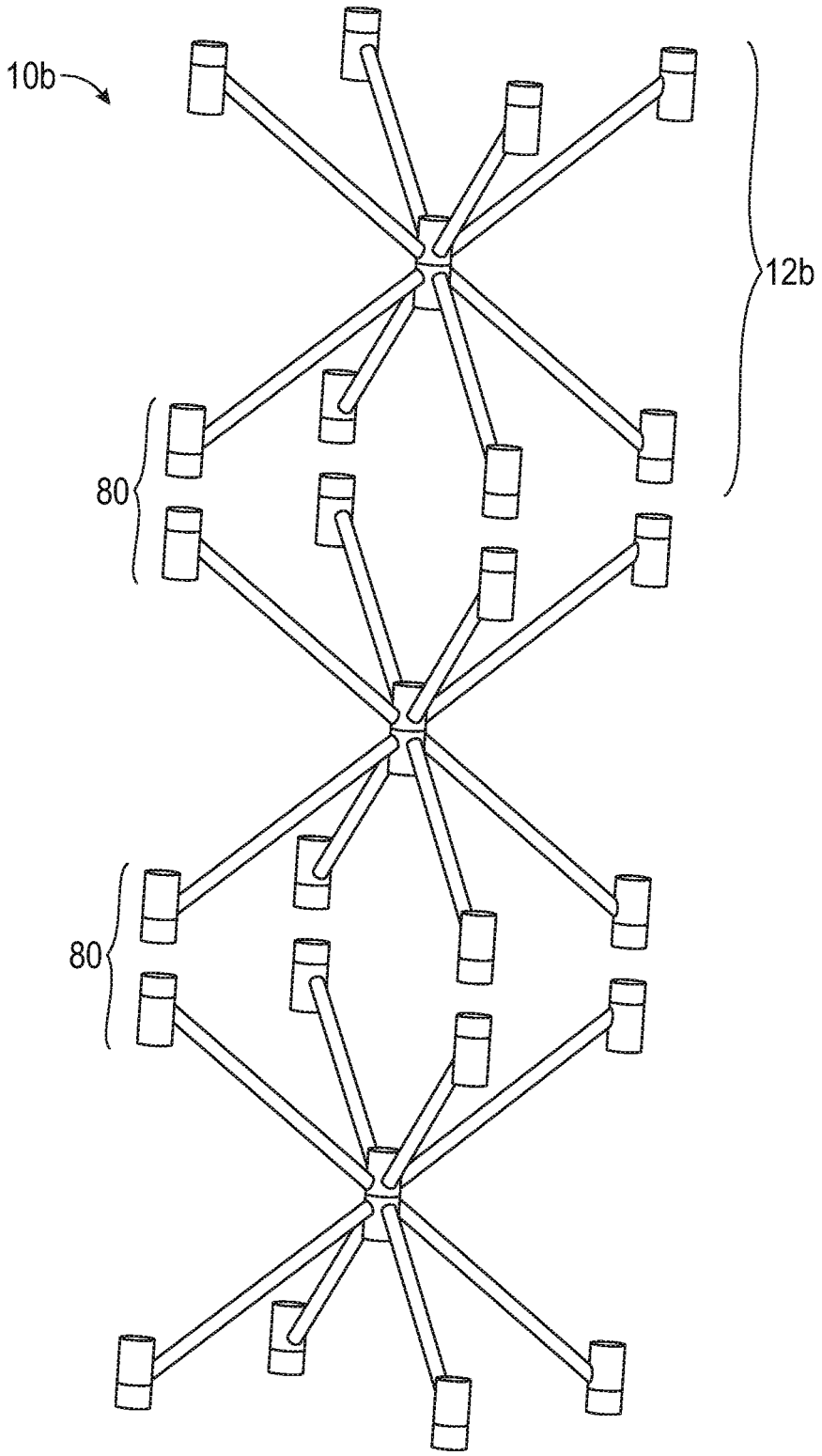
FIG. 7 is a perspective view of single-lift, vertically oriented prefabricated jacket template structure constructed on site out of a plurality of stacked bay units, such as the bay unit module in FIG. 3A, that are connected together according to one embodiment of the present disclosure.
Figure 8:
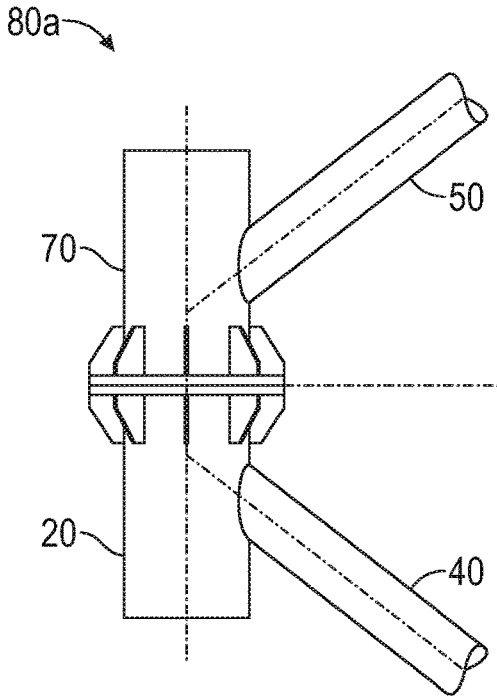
FIG. 8 illustrates one type of connection, here a flange connection, used to connection adjacent bays to each other according to one embodiment of the present disclosure.
Figure 8A:
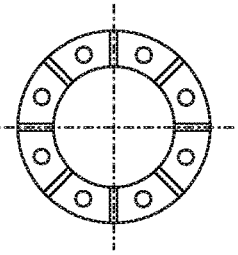
FIG. 8A is a cross-sectional view of the flange face from the upper bay can taken along lines 8A-8A of FIG. 8.
Figure 9:
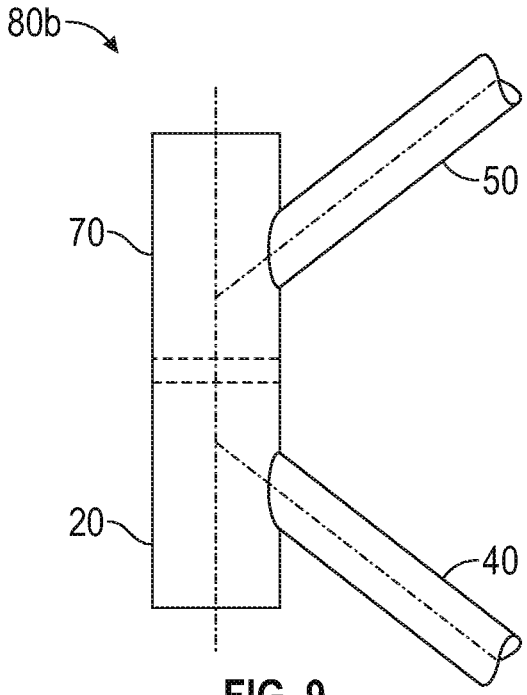
FIG. 9 illustrates another type of connection, here a zap-lock connection, used to connection adjacent bays to each other according to one embodiment of the present disclosure.
Figure 10:
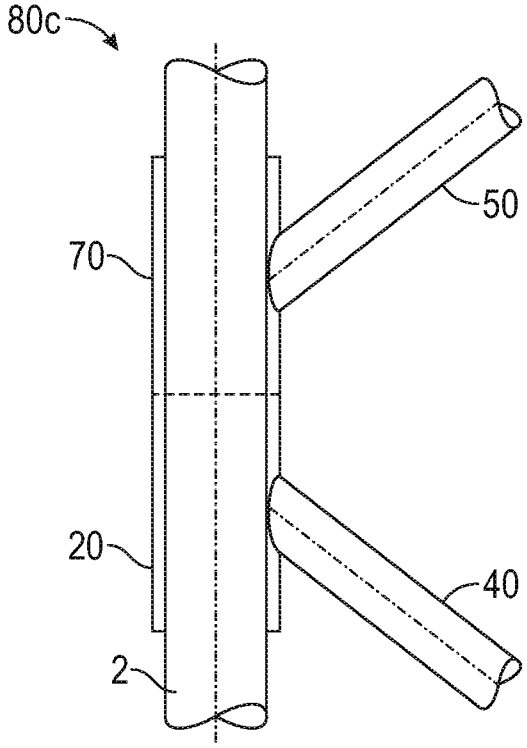
FIG. 10 illustrates another type of connection, here a grout connection, used to connection adjacent bays to each other according to one embodiment of the present disclosure.
Figure 11:
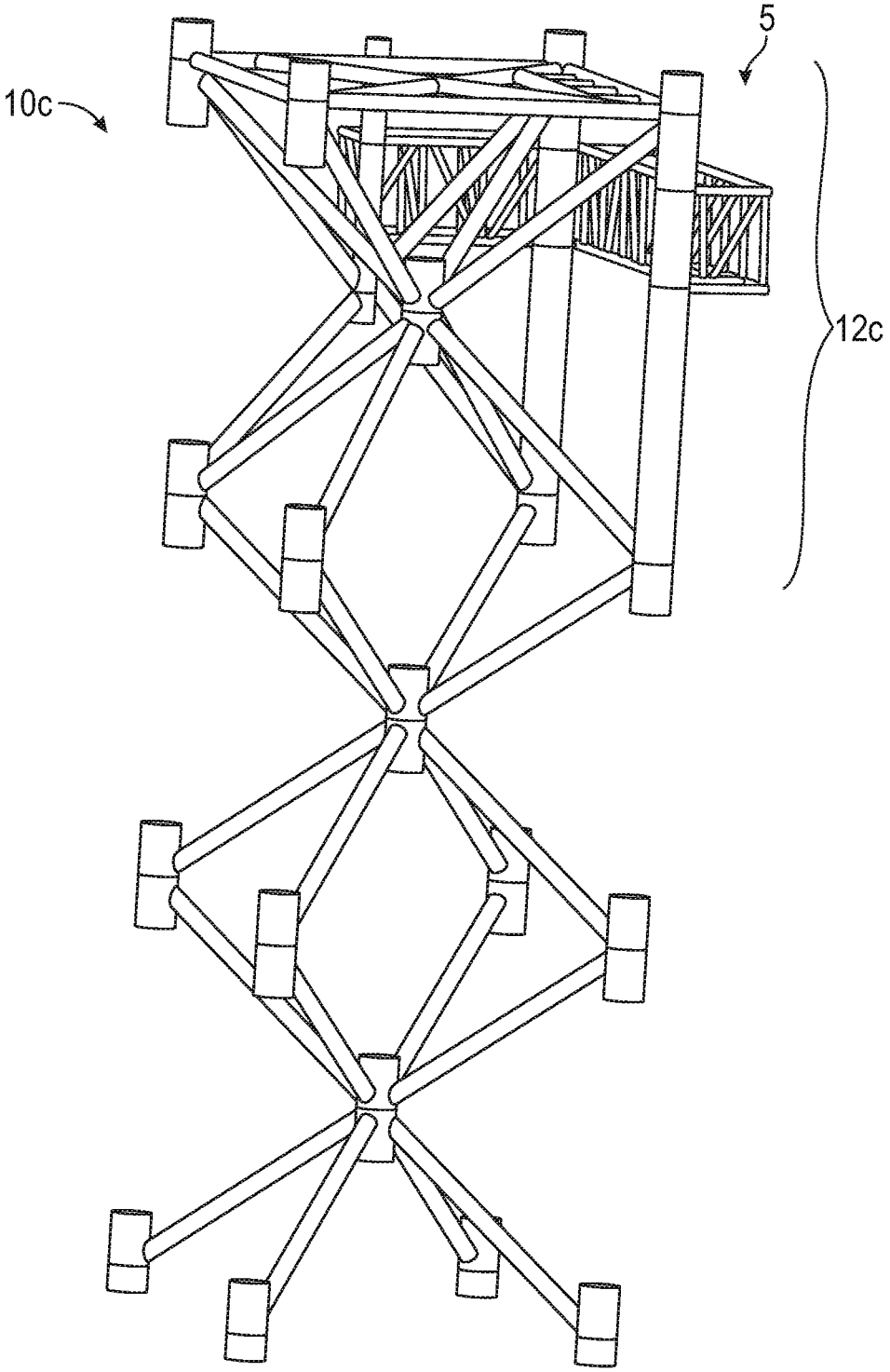
FIG. 11 is a perspective view of vertically oriented jacket template structure constructed of multiple, stacked bay units, including a hybrid top bay section, according to one embodiment of the present disclosure.
Figure 12:
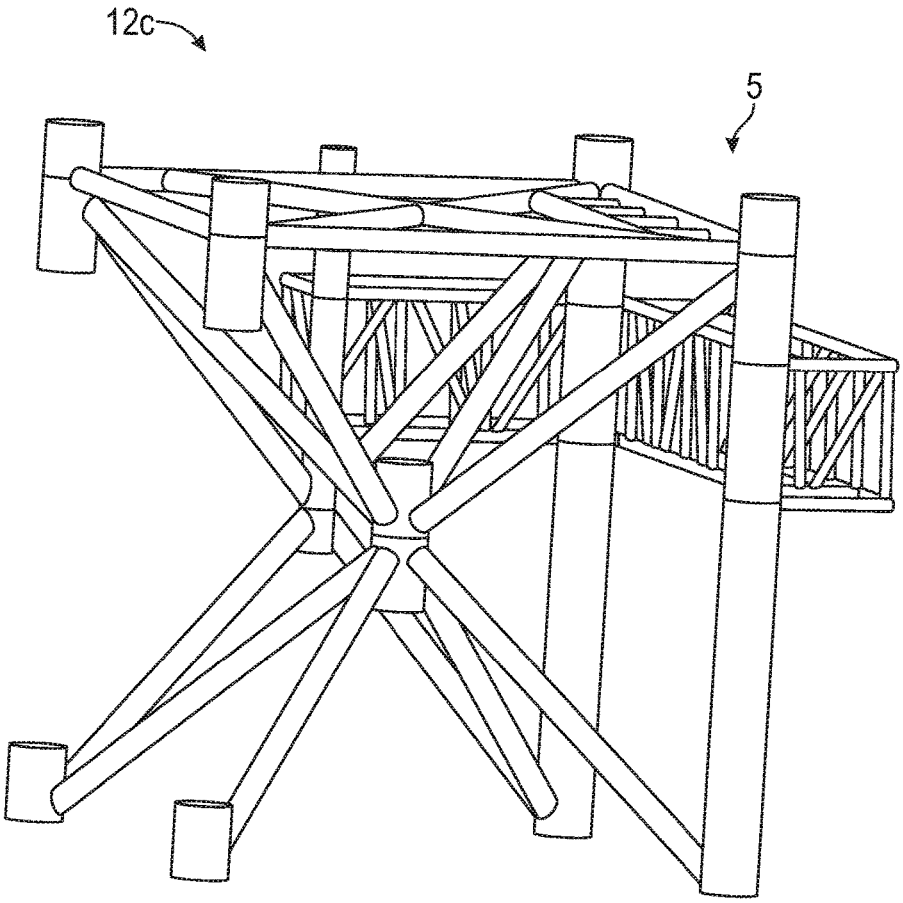
FIG. 12 is a perspective view of a hybrid top bay section, such as displayed in FIG. 11, according to one embodiment of the present disclosure.
Figure 13:
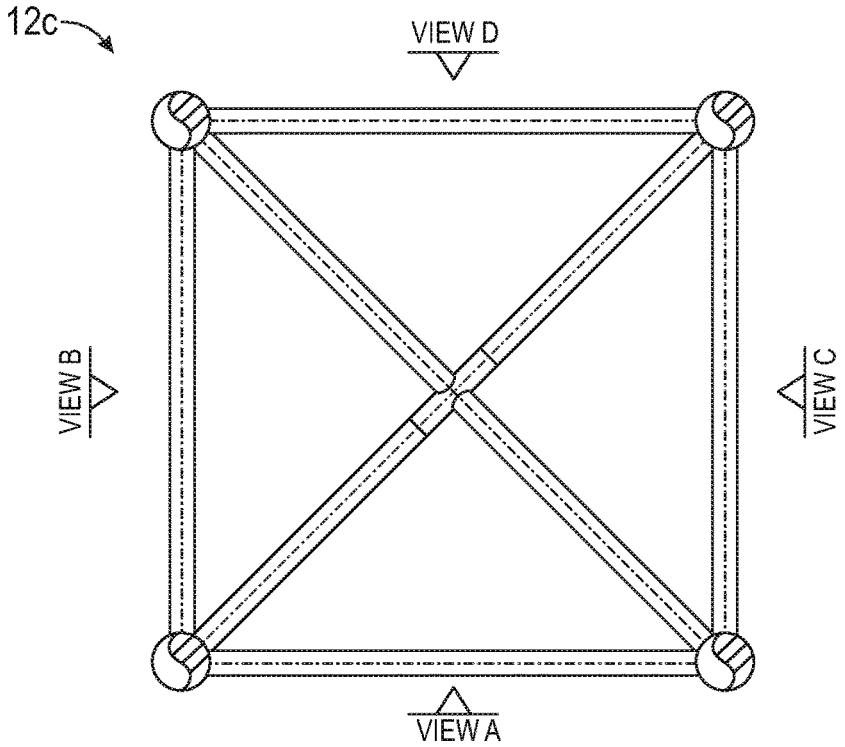
FIG. 13 is a top plan view of the structure of FIG. 11.
Figure 13A:
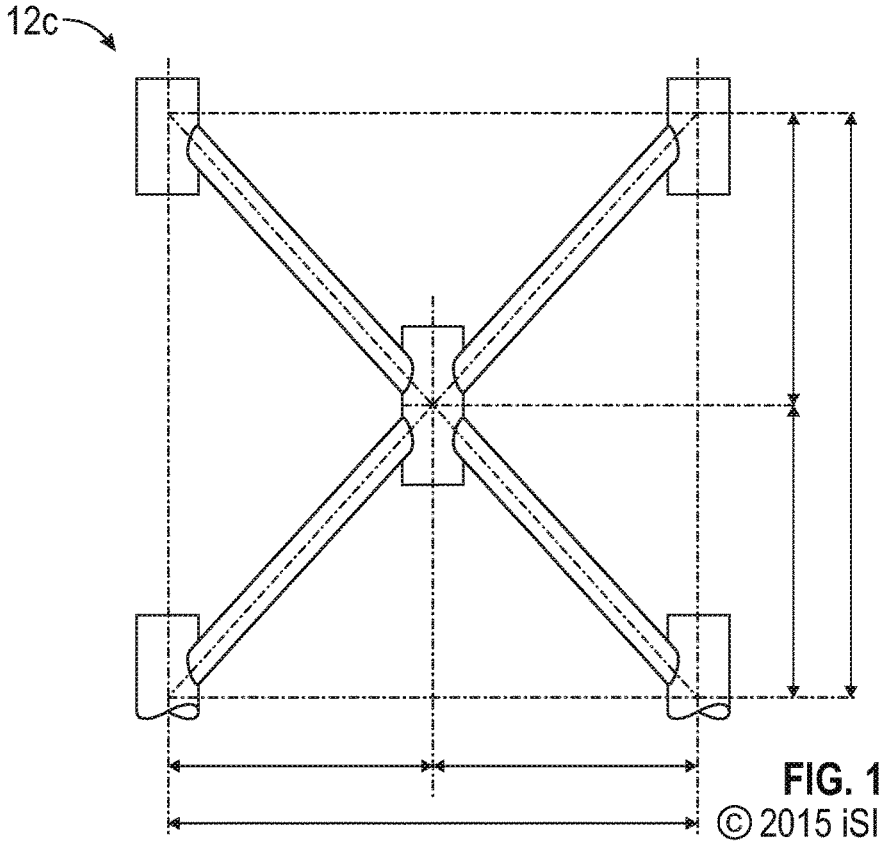
FIGS. 13A, 13B depict side plan views of the structure of FIG. 13 taken along sides 13A and 13B.
Figure 13B:
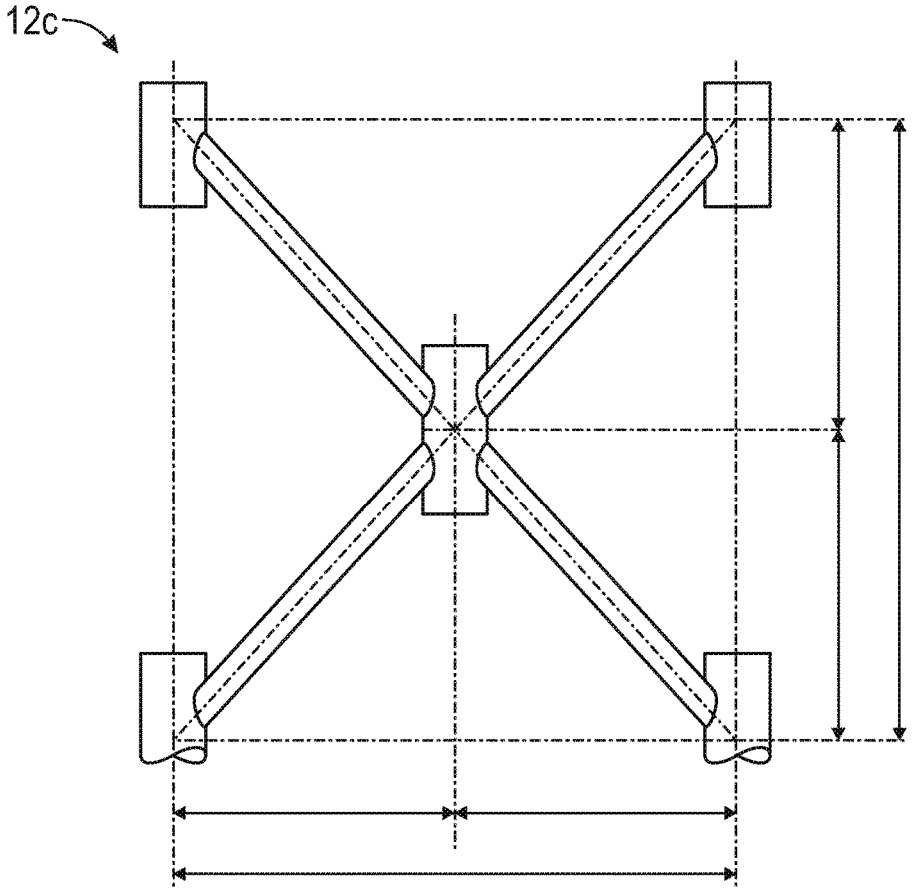
Figure 13C:
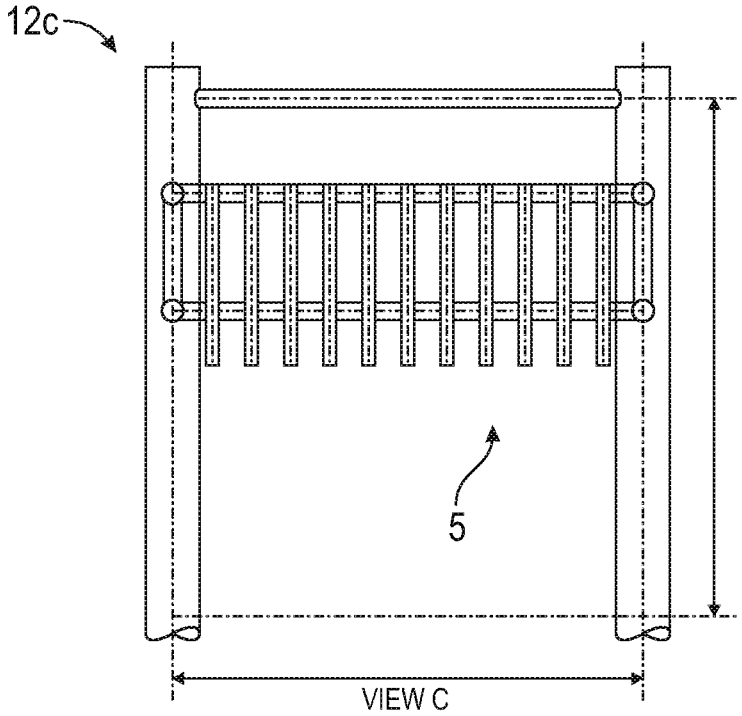
FIG. 13C depicts a side plan view of the structure of FIG. 13 taken along side 13C.
Figure 13D:
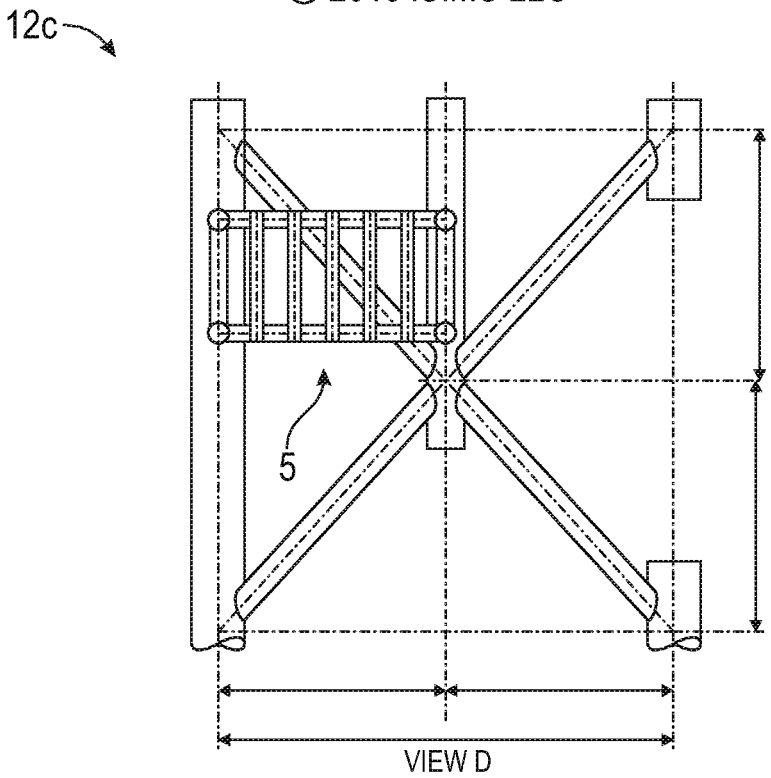
FIG. 13D depicts a side plan view of the structure of FIG. 13 taken along side 13D.
Figure 14:
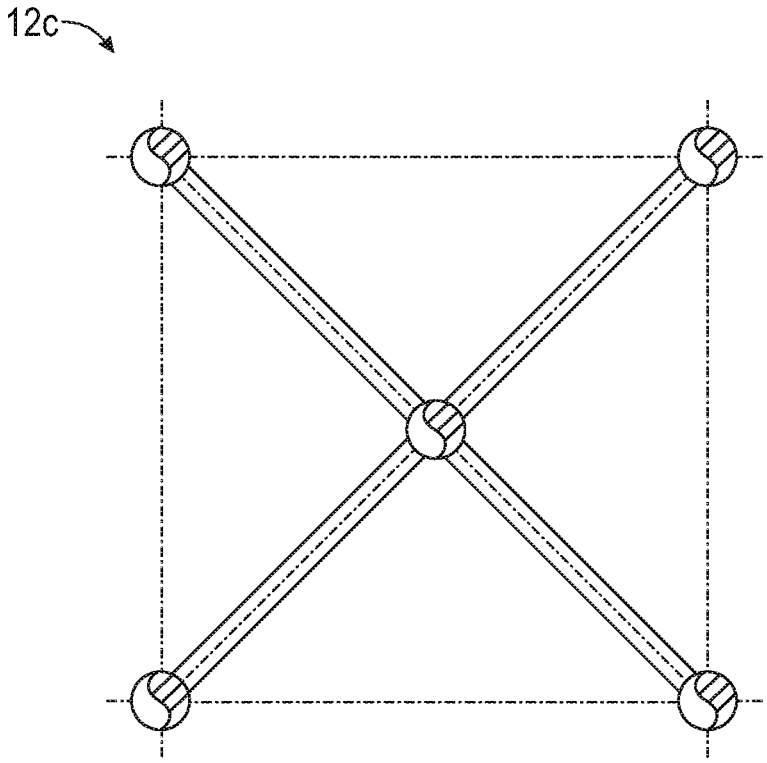
FIG. 14 is a bottom plan view of the structure of FIG. 11.

Two or more bays may be stacked to further increase the height of the structure. This can be done either at the time of construction (e.g., the jacket templates illustrated in FIGS. 5 and 15, 16, 18, 19, 20, 21, 22 are shown in completed construction and could be prefabricated onshore and then transported to the desired location) or during the installation of the structure at its final or interim location, e.g., the jacket template 10*b* illustrated in FIG. 7 illustrates how multiple separate bay units 12*b* could be connected together to form a non-battered jacket template such as shown in FIG. 5. FIG. 5 illustrates a single-lift, vertically oriented prefabricated 4-legged style jacket template structure 10*b* constructed of multiple, stacked bay units 12*b*, such as the bay unit module in FIG. 3B. FIGS. 6, 6A and 6B show additional views of the non-battered bay depicted in FIG. 5. Each of the vertically stacked bays constitutes a separate tier, e.g., Tier 1, Tier 2, Tier 3, and each tier lies in a separate horizontal plane.

Where the bays are connected in the field, a connection detail, such as 80, 80*a*, 80*b*, 80*c* is necessary. The connection detail may include any number of structural connections, such as, for example and without limitation: a castellated weld; a threaded (sleeve); a sleeve (welded); a grouted connection 80*c* (see FIG. 10) with or without beads; a full or part penetration weld; a 1-piece member extending through the central can; a swaged or force fit connection type; a bolted flange connection 80*a* (see FIGS. 8 and 8A); a Zap-Lok style telescoping interconnection 80*b* (see FIG. 9); epoxy/glue; and pre-drilled holes in central can that members can fit into (possibly threaded).

Figure 15:
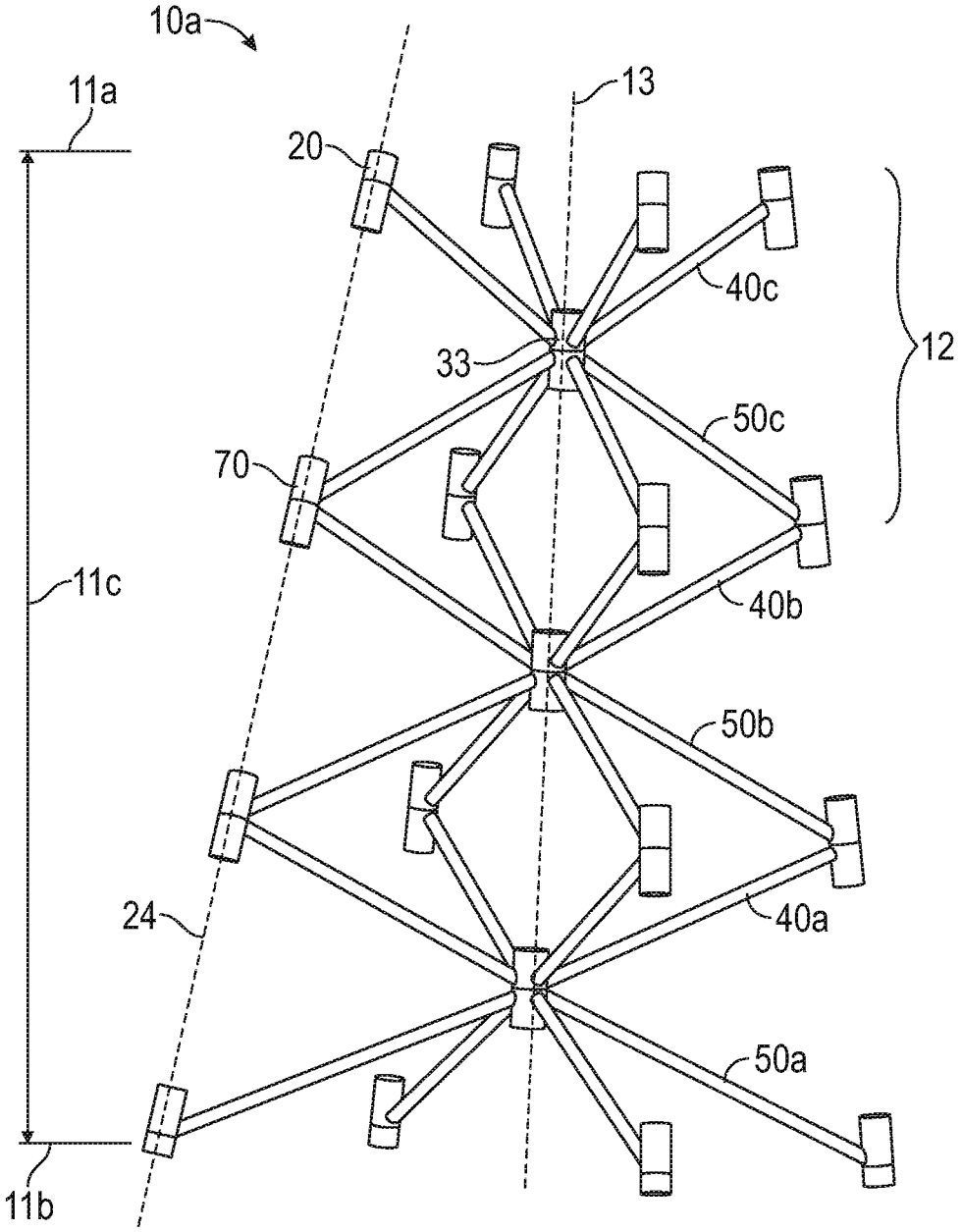
FIG. 15 is a perspective view of vertically oriented, double battered jacket template structure constructed of multiple, stacked bay units having battered faces according to one embodiment of the present disclosure.
Figure 15A:
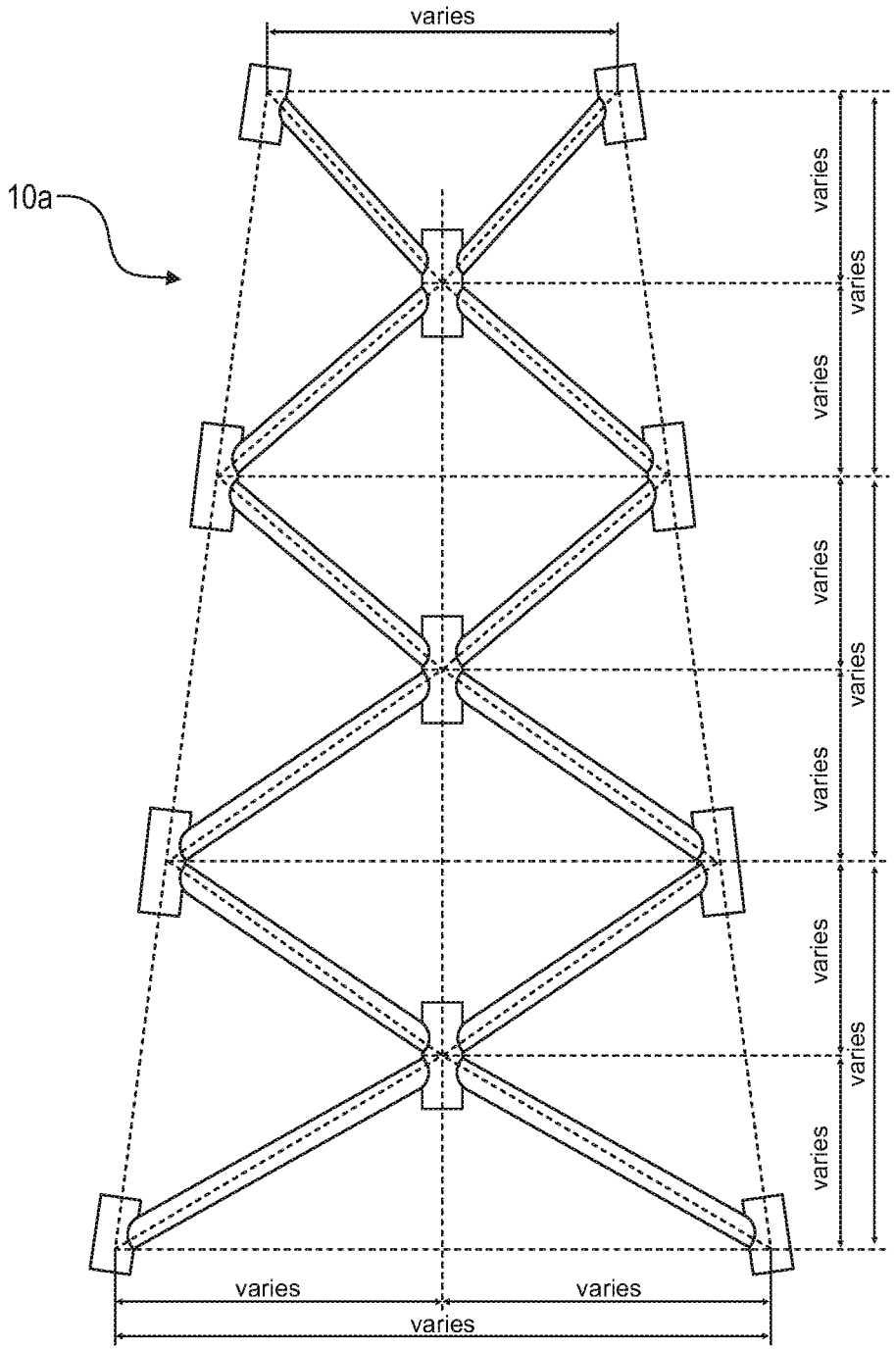
FIG. 15A is a side plan view of the battered structure of FIG. 13.
Figure 16:
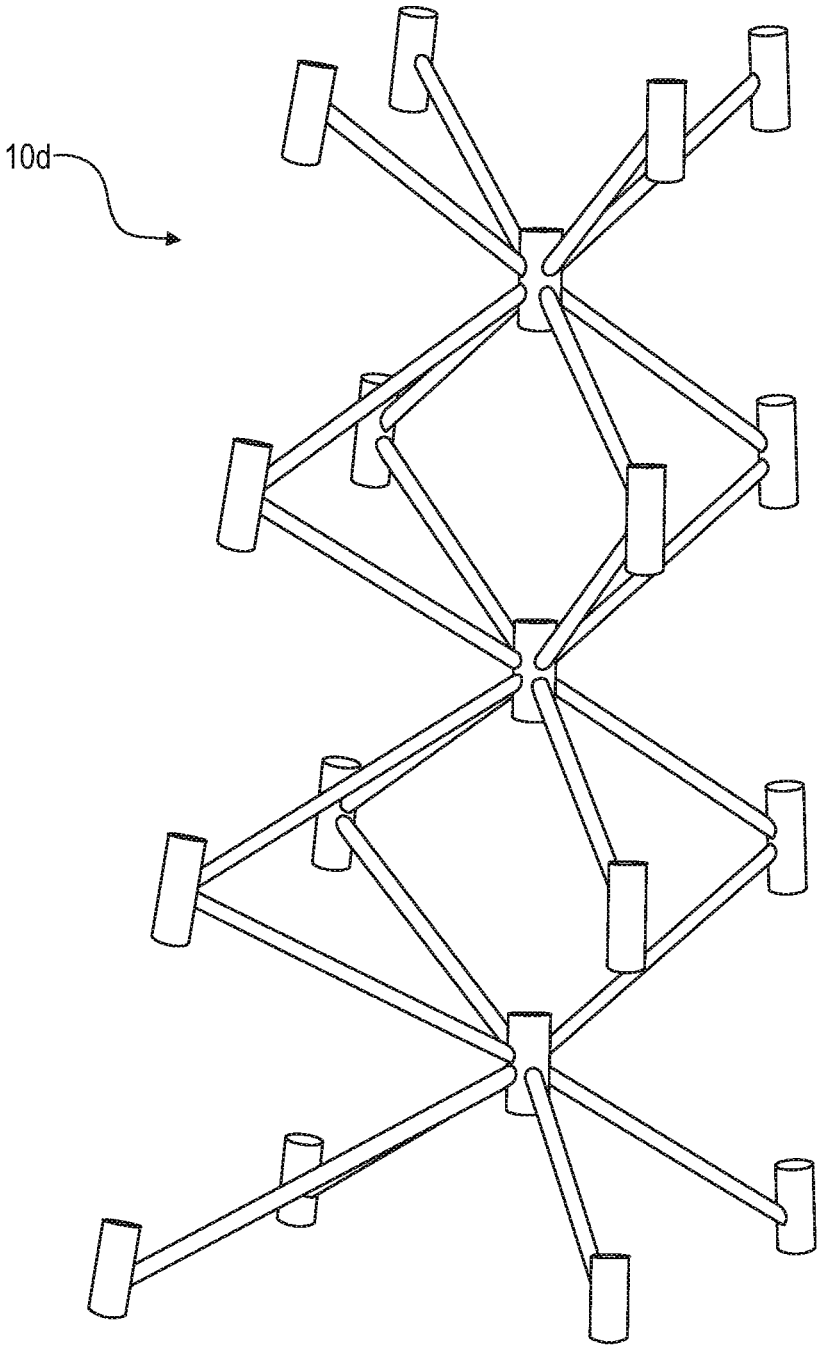
FIG. 16 is a perspective view of vertically oriented, 4-legged style jacket template structure constructed of multiple, stacked bay units employing battered and nonbattered (vertical) faces according to one embodiment of the present disclosure.
Figure 16A:
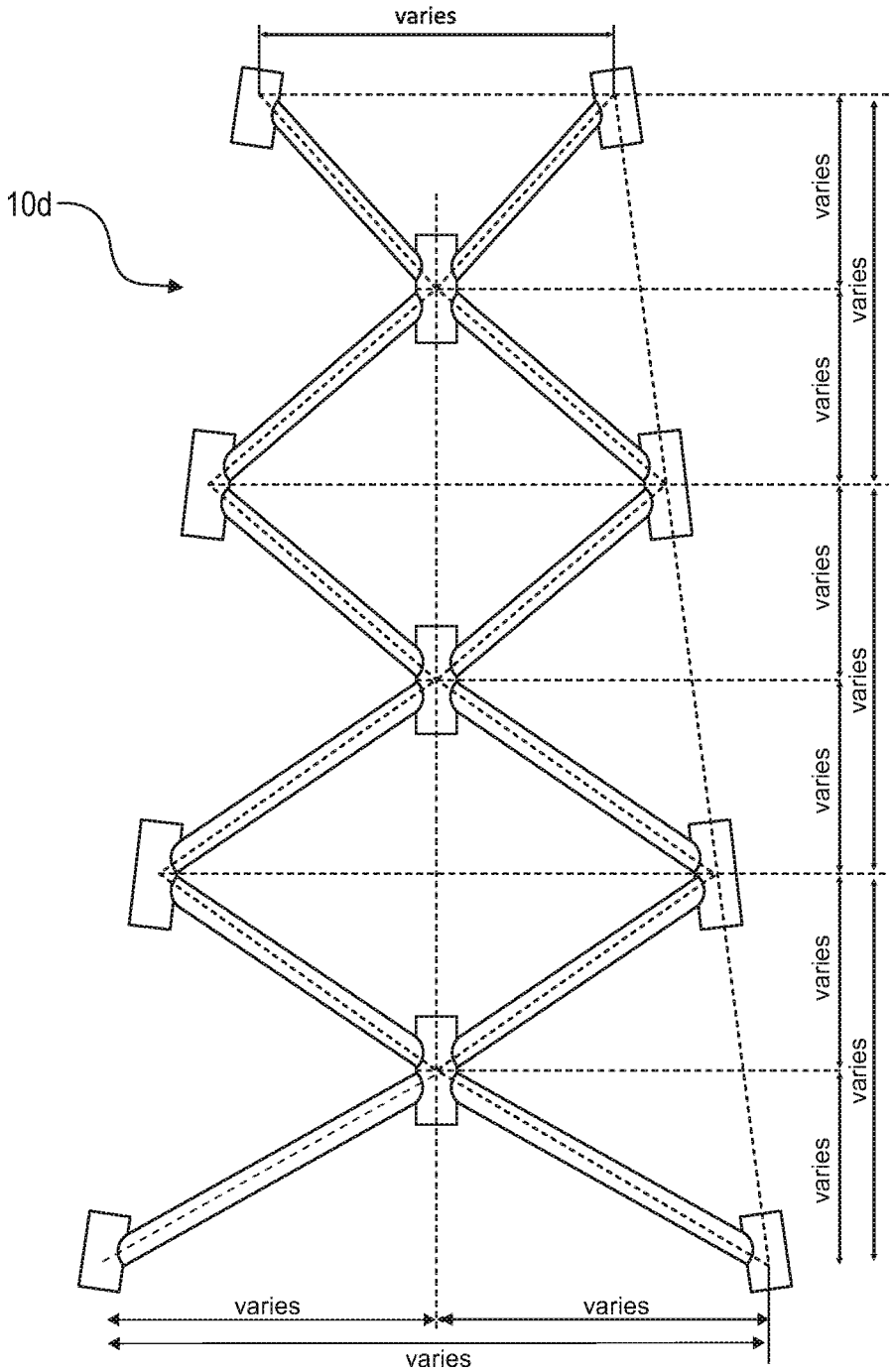
FIG. 16A is a side plan view of the battered structure of FIG. 16 showing face 16A.
Figure 16B:
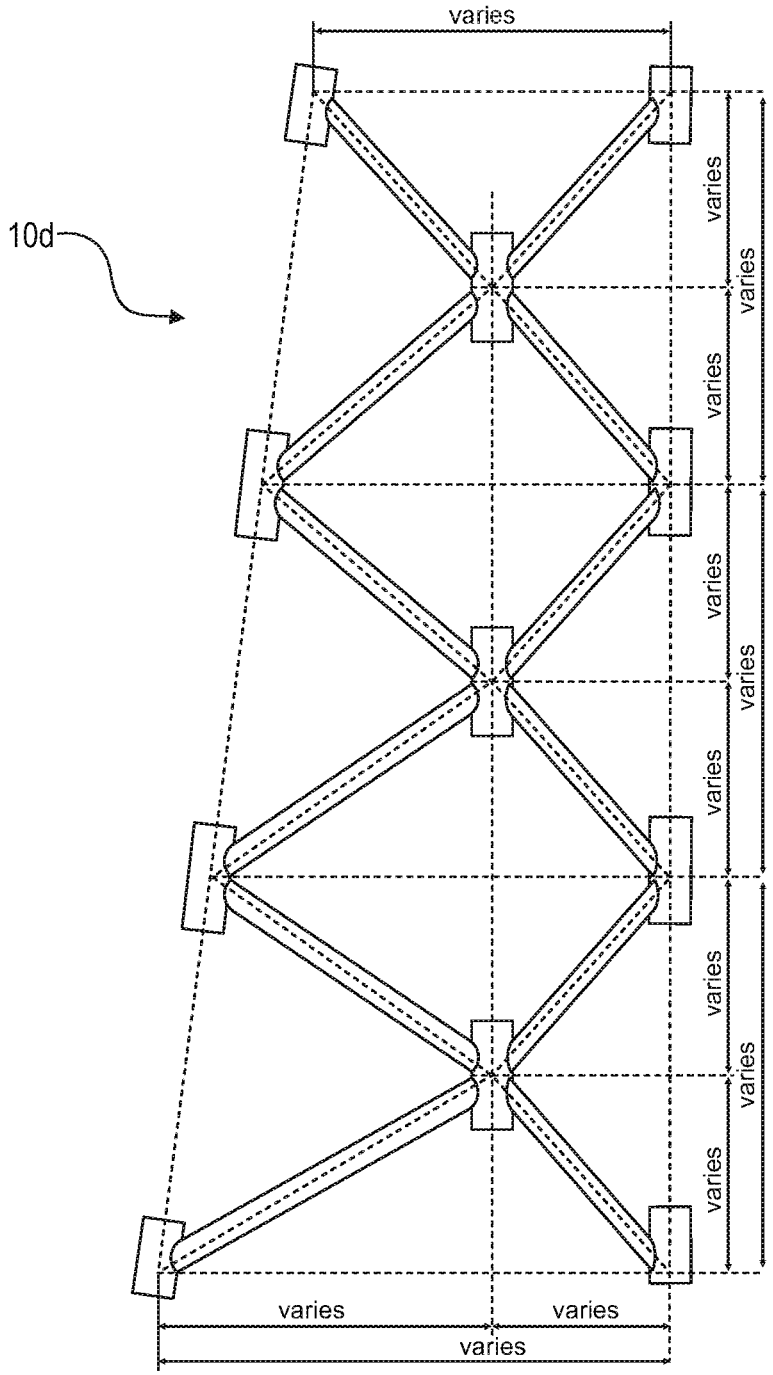
FIG. 16B is a side plan view of the battered structure of FIG. 16 showing face 16B.

In order to accommodate the connection of common appurtenances to structures such as access or egress platforms, boat landings, impact protection frames, etc., additional framing may be added to the bays, especially to the top bay one or more sides as required. For example, FIGS. 11-14, there is depicted a non-battered, four legged jacket template 10*c*, much like that illustrated in FIG. 5 where the topmost bay 12*c* is configured with various additional structural features, such as boat landings Bays may be connected in a multitude of patterns to develop large structures that will accommodate anywhere from three to an unlimited number of foundation piles. Referring to FIGS. 15 and 15A, there is shown a double battered jacket template section 10*a*, similar to that in FIG. 2C, and also similar to the non-battered jacket template section 10*b* of FIG. 5. FIGS. 16, 16A and 16B illustrate a 4-legged style jacket template structure 10*c* constructed of multiple, stacked bay units employing battered and non-battered (vertical) faces.

Figure 18:
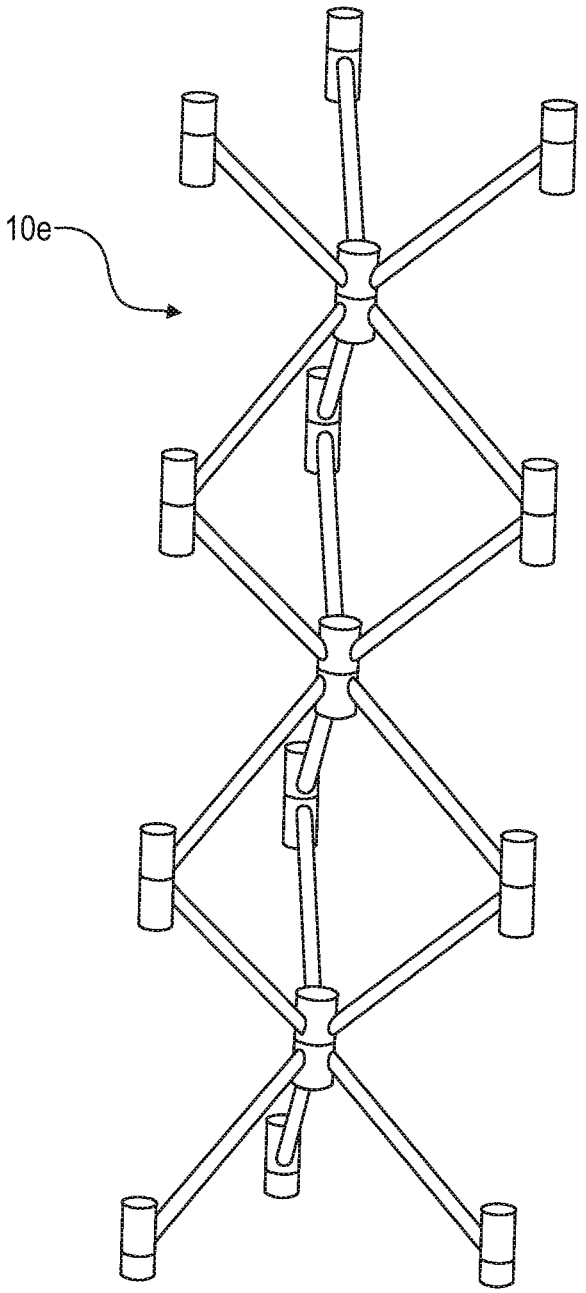
FIG. 18 is a perspective view of a vertically oriented 3-legged style nonbattered (vertical) jacket template structure constructed of multiple, stacked bay units according to one embodiment of the present disclosure.
Figure 19:
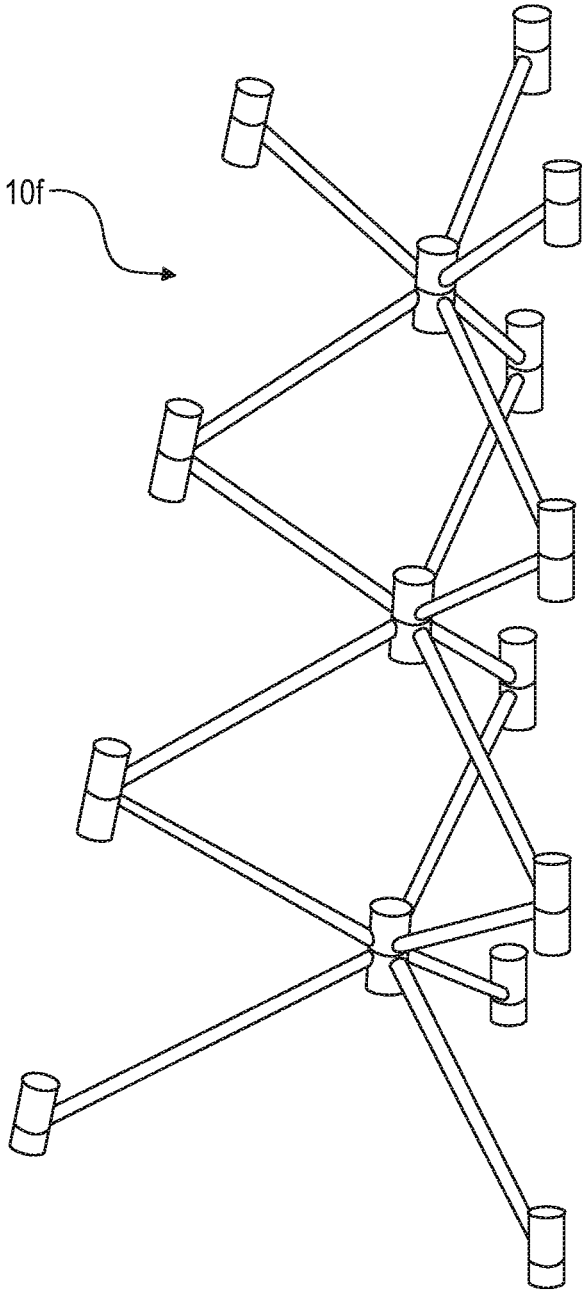
FIG. 19 is a perspective view of a vertically oriented 3-legged style double battered jacket template structure constructed of multiple, stacked bay units according to one embodiment of the present disclosure.

Much like with the four legged battered and non-battered bays of FIGS. 3A and 3B, FIG. 17A illustrates a three legged style, non-battered (vertical), single structural bay unit 12*d* and FIG. 17B illustrates a three legged battered (vertical), single structural bay unit 12*e*. FIG. 18 illustrates a vertically oriented 3-legged style non-battered (vertical) jacket template structure 10*e* constructed of multiple, stacked bay units (such as shown in FIG. 17A. FIG. 19 illustrates a vertically oriented 3-legged style battered (vertical) jacket template structure 10*f* constructed of multiple, stacked bay units (such as shown in FIG. 17B.

Additionally, as noted above, the bay module 12 can be modified to include more than one central core within the same horizontal plane. For example, FIGS. 20, 20A, 20B and 20C illustrate a multi-tiered (here, three-tiered) jacket template 10*g* where, within each tier, two, four legged bay units have been combined together in side-by-side fashion so that they share two of the upper and lower cans, 20*a*, 70*a*. In this embodiment, the jacket template 10*g* has six legs to accommodate 6 piers, and uses two central core units 30*a* disposed within the same horizontal plane. Each set of stacked bays constitutes a separate tier (Tier 1, Tier 2, Tier 3), and each tier lies in a separate horizontal plane.

Referring now to FIGS. 21, 21A, 21B, and 21C, there is shown a vertically oriented 8-legged style double battered jacket template structure 10*h* constructed of multiple, stacked bay units. In this embodiment, three standard four-legged bay units are joined together horizontally (sharing the cans between adjacent bay units) to form each of the stacked rows. In this embodiment, the jacket template 10*g* has eight legs to accommodate 8 piers, and uses three central core units 30*b* disposed within the same horizontal plane.

In some situations the legs, rather than being omitted entirely, may be replaced by buoyancy tanks used for the self-installation of the structure. The system may also be installed by controlled launch from a barge or lifting with a crane, floating and upending or floating on a suction foundation system. When the individual bays are installed onsite, a smaller crane can be employed than that required if lifting a preassembled jacket template.

Figure 22:
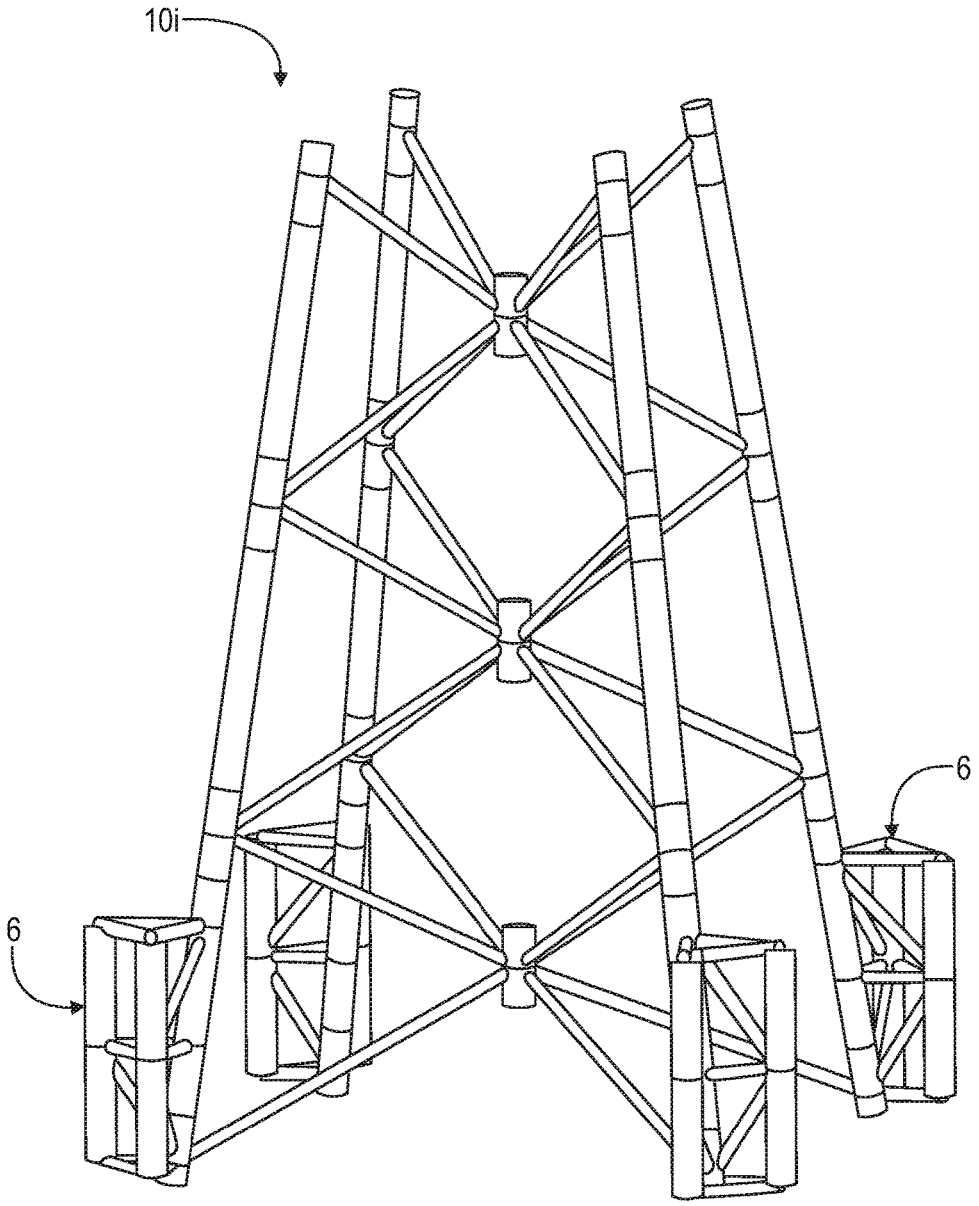
FIG. 22 is a perspective view of vertically oriented, battered jacket template structure constructed of multiple, stacked bay units having battered faces and also employing skirt piles according to one embodiment of the present disclosure.
Figure 23:
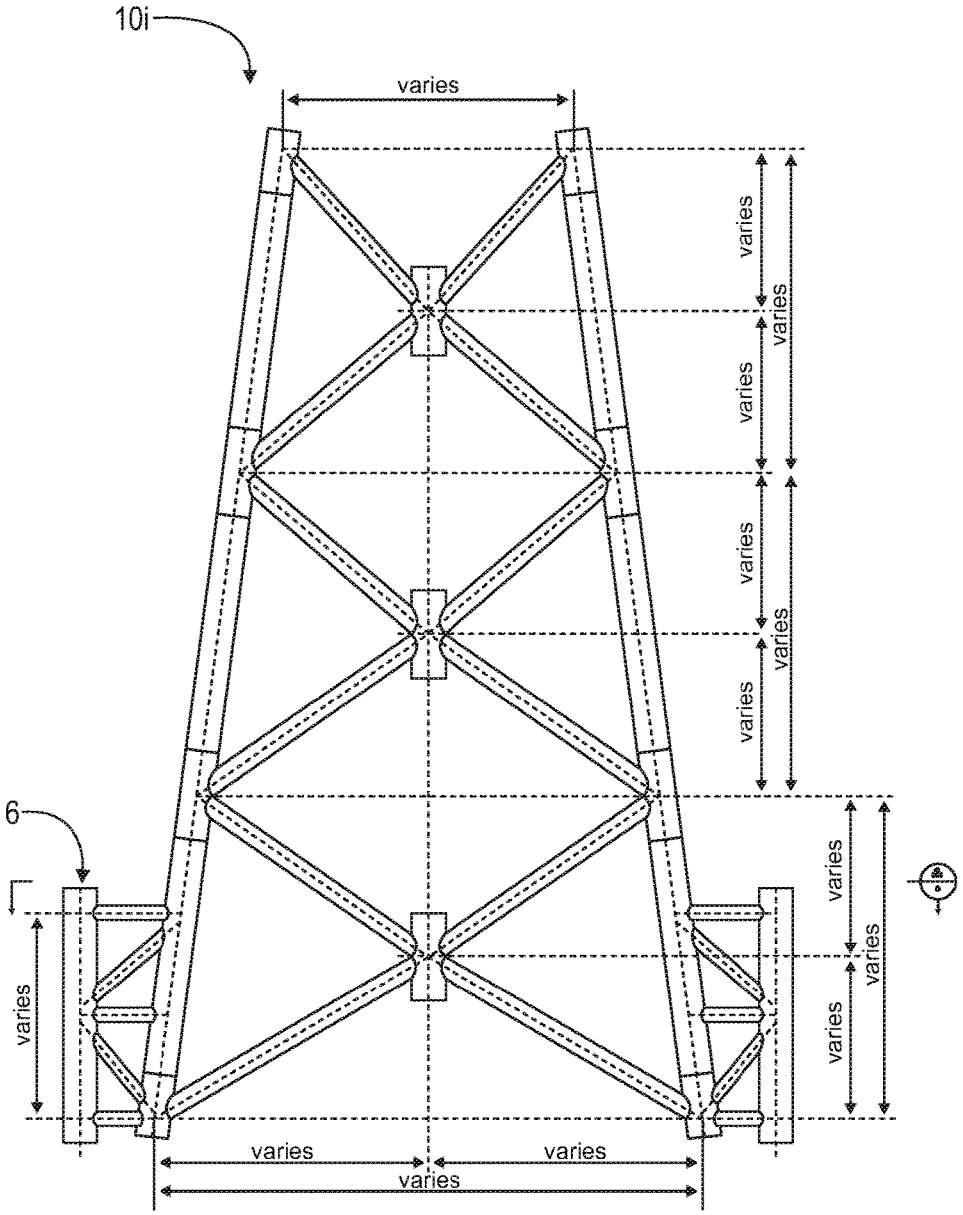
FIG. 23 is a side plan view of the structure of FIG. 22.
Figure 23A:
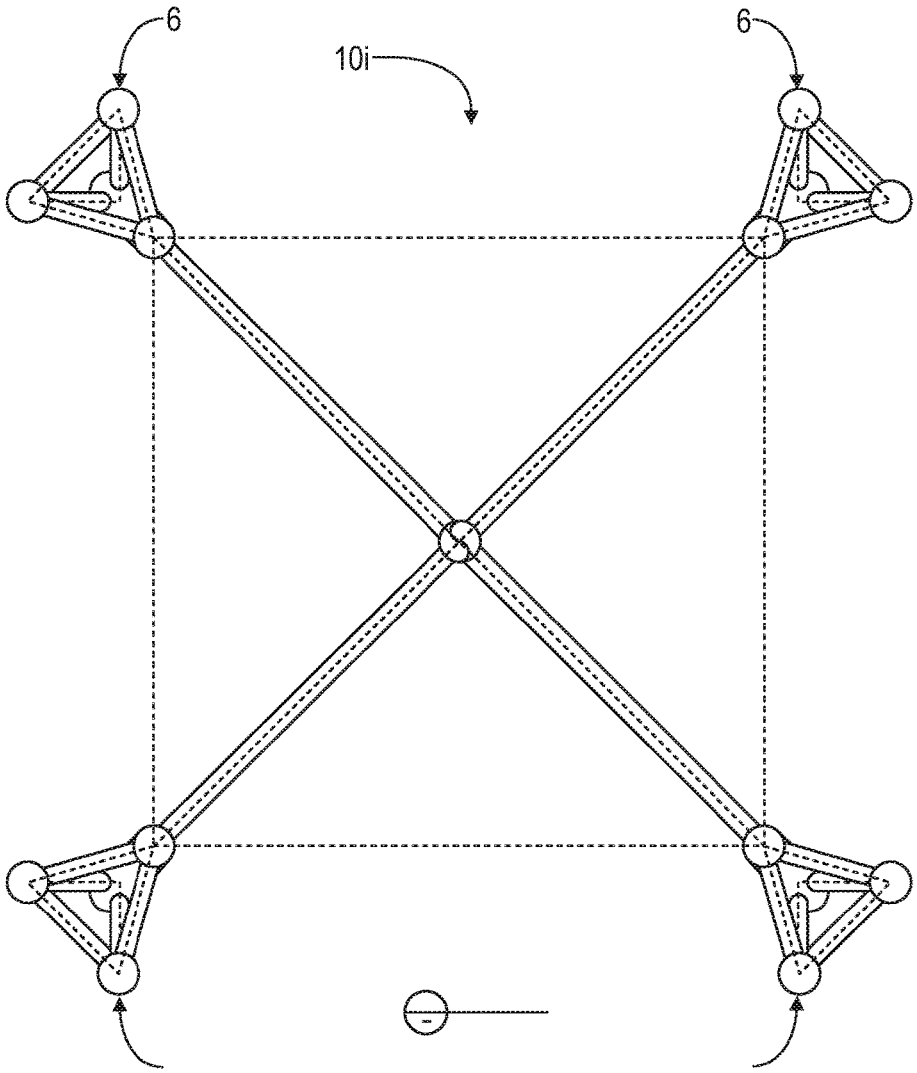
FIG. 23A is a cross-sectional view of the structure of FIG. 23 taken along lines 23A-23A.
Figure 24:
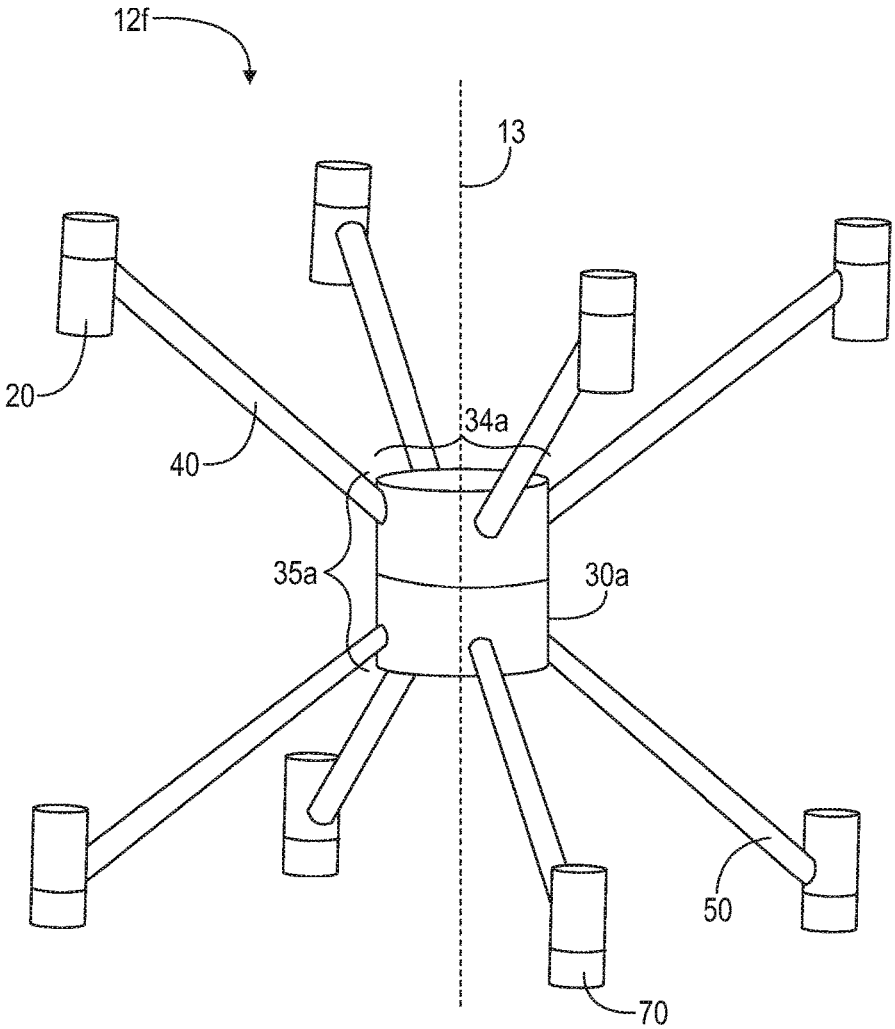
FIG. 24 is a perspective view of a 4-legged (4-pile) style, non-battered (vertical), structural bay unit module according to another embodiment of the present disclosure. This embodiment illustrates that the central bay support member can vary in its outer diameter to permit the support member interior channel to permit passage of equipment, tubulars, and other items that may be lowered or otherwise mounted between the upper and lower ends of the platform jacket template.
Figure 25:
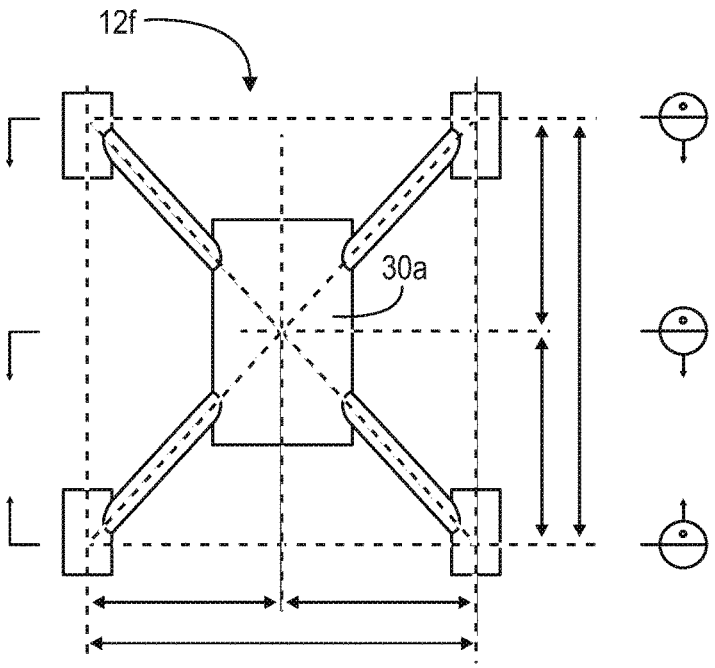
FIG. 25 is a side view of a typical bay configuration according to one embodiment of the present disclosure illustrated in FIG. 24.
Figure 25A:
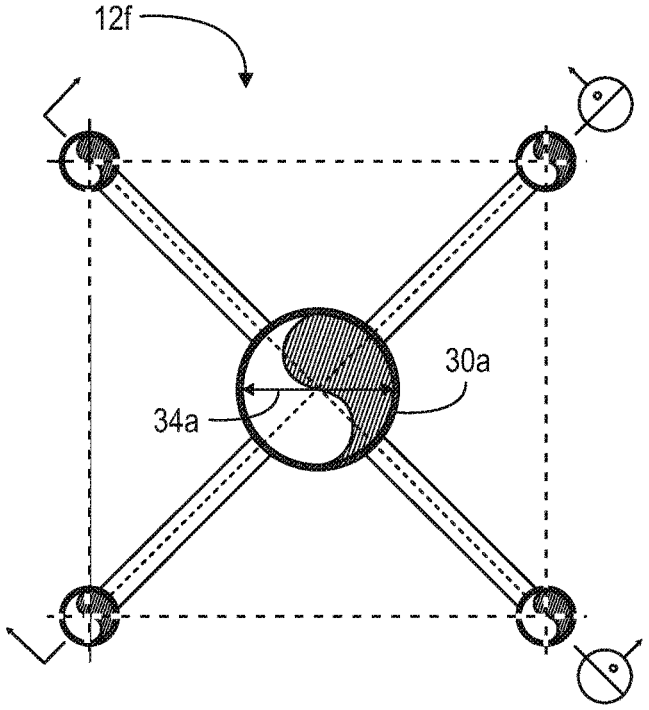
FIG. 25A is a sectional view taken along lines 25A-25A of FIG. 25.
Figure 25B:
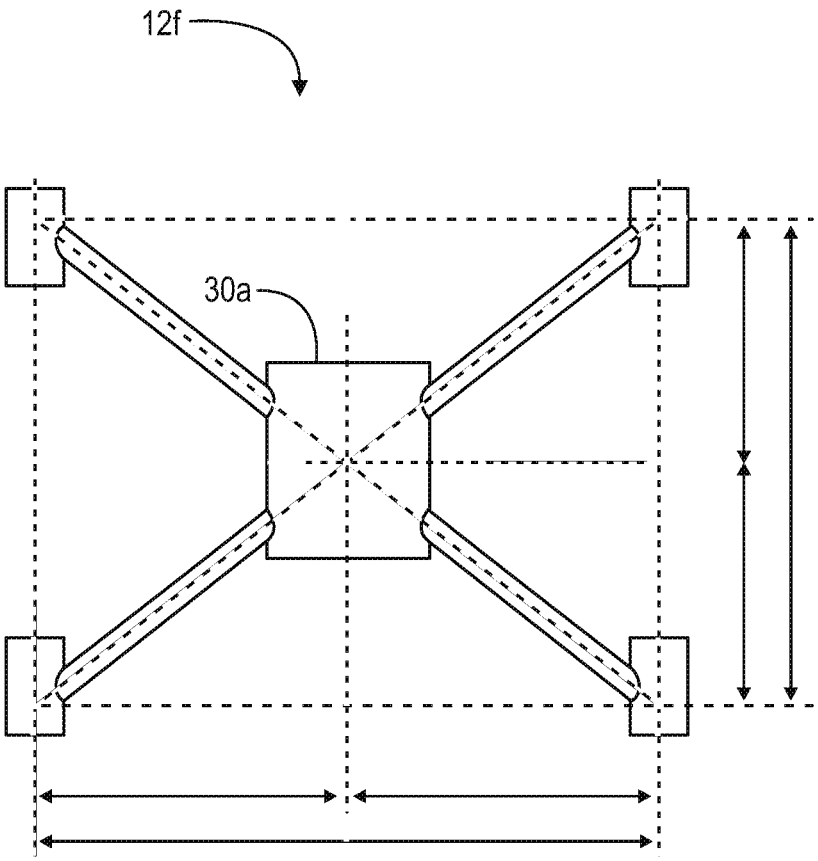
FIG. 25B is a sectional view taken along lines 25B-25B of FIG. 25A.

The structure can be fixed to the ground (sea floor) with conventional vertical or raked piles or with an alternative foundation such as a gravity base or suction pile(s). Mud mats may be required to provide on-bottom stability during installation. Referring to FIGS. 22, 23 and 23A, there is depicted a vertically oriented, battered jacket template structure 10*i* constructed of multiple, stacked bay units having battered faces and also employing skirt piles 6.

For certain onshore applications where interior space within the structure may be advantageous, bays may be optimized to create additional space. Structural framing may be added to make each 'triangular area' (seen in plan-view of the bay) a full square to provide larger internal space.

Variations of the central core connections 30 (from the hollow can style illustrated) may exist to provide a larger central conduit 30*a* through the structure where this may be beneficial to the design, e.g., passage of pipeline risers, umbilicals, production or injection wells, power cables or other appurtenances to the facility requiring structural support and/or protection. For example, referring now to FIGS. 24, 25, 25A and 25B, there is depicted a non-battered, 4 legged bay module 12*f* similar to that in FIG. 3B employing a larger core structural member 30*a*. In this embodiment, the core 30 may be tubular with a large internal diameter 34*a* to permit, for example, ingress and egress of equipment. The central connection system 30, 30*a* may therefore comprise, for example: various shapes and sizes of hollow or stiffened cans; multiple connected cans; a multisided framed structure; or other connection type.

The system of the present disclosure is designed to provide a modular bay design and jacket template design that is low mass, high ductility, lightweight, ideal seismic performance qualities, and flexible for use on land and offshore. The capability of having multi-piece construction of the template jacket, for e.g., construction of an offshore oil and gas platform permits the use of smaller crane units (that have significantly lower day rates than the larger cranes) which in turn provides cost/weight savings. The variability of the angles and arm lengths on the modules provides great flexibility in designing the overall height of the jacket template required at the place of installation, e.g., based on the water depth for an offshore installation.

Figure 26:
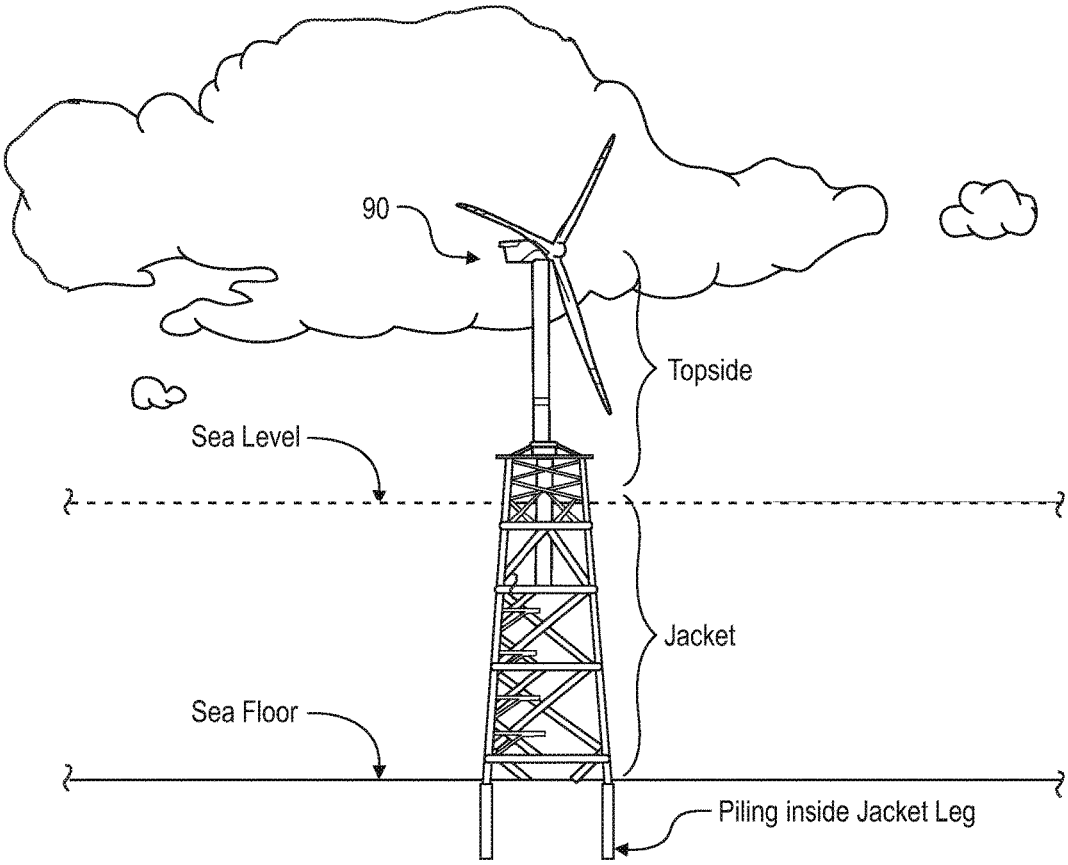
Fig. 26 (Prior Art)
FIG. 26 is a schematic depiction of a conventional, prior art offshore wind turbine installation.
Figure 27:
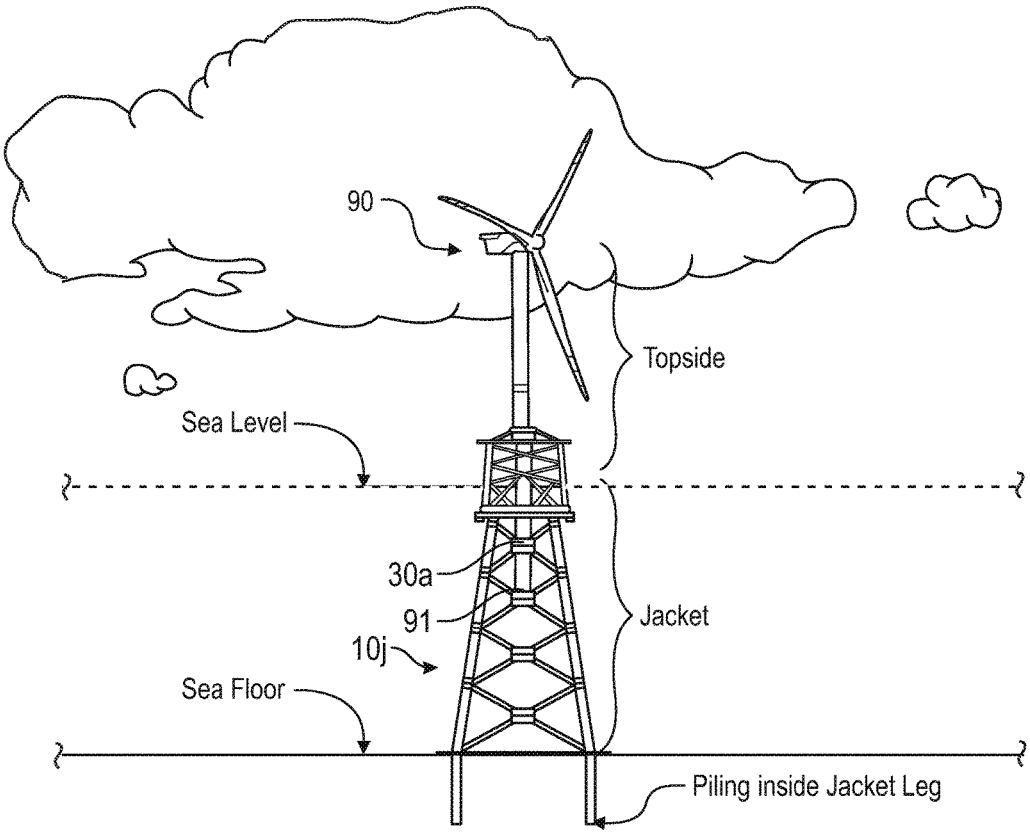
FIG. 27 is a schematic depiction of an installed platform structure (depicted here as an offshore wind energy platform housing a wind turbine) employing a new jacket template structure according to one embodiment of the present disclosure.

The new jacket template structure disclosed herein has many applications as will be appreciated by those having the benefit of the present disclosure. As just one additional example, the new jacket template design can be used for the installation of offshore wind turbines. Referring to FIG. 26, there is shown a schematic depiction of a conventional offshore wind turbine installation known in the art where the jacket bracing also serves to stabilize a submerged portion of the turbine tower. Between the topside section and the sea floor is a conventional structural jacket used for installation of offshore wind turbines as is known in the art. FIG. 27 provides an illustration where, with reference to the conventional wind turbine depicted in FIG. 26, a new jacket template structure 10*j* is depicted. Referring also back to FIGS. 24, 25, 25A, 25B, it can be appreciated that the central core 30*a* of one or more of the vertically aligned bays can be designed to have a large inner diameter 34*a* and enhanced height 35*a* to accommodate and secure to the outer diameter of the tower section 91 of the wind turbine. In one embodiment, the core members 30*a* extend and are attached to each other to create an extended vertical tubular structure extending between two vertically adjacent bay members. This extended tubular core member (not shown) could be employed in any of the jacket designs described herein, including being employed to receive a lower portion of a wind turbine tower section.

Additionally, associated energy transmission platforms could likewise employ the new jacket template design described herein.

Typical jacket construction (of the prior art types disclosed in FIGS. 1A and 1B), requires manufacturing and assembly onshore at a facility that is close to the point of installation since the actual template structure it too large to transport over land. As such, for off-shore template jacket structures of the prior art, they require manufacture and assembly on shore at a coastal location so that the completed template jacket can be floated (or barged) to the offshore location. This adds time, complexity and cost to the manufacturing process for these prior art jacket templates. This time, complexity and cost becomes magnified when it is desired to install an elaborate field of jacket template structures, such as with an offshore wind farm where there may be tens if not hundreds of jacket templates required. Thus, there exists a need to streamline the manufacturing process for these jacket structures.

Those having the benefit of the present disclosure will recognize that the structural building jacket designs described herein provide great flexibility, cost savings and time savings when it comes to designing, manufacturing, assembling and installing the jackets. The structural building jacket designs comprise a low number of basic building block component parts (e.g., tubular steel nodes) used to assemble the jacket, e.g., upper and lower tubular nodes (20, 70), central bay support nodes (30), and connecting structural braces (40, 50). Other ancillary parts, such as boat landings (5), skirt piles (6), and pilings are readily available. As such, these primarily tubular steel (or other suitable material) building block component parts can be produced at any convenient location, and can be mass-produced. Mass production/rapid production of these component parts becomes particularly important where there exists a planned installation of multiple jacket structures, e.g., for an extensive offshore windfarm installation comprising many separate jacket structures, such wind farms including arrays of tens if not hundreds of wind turbines each mounted on a separate jacket template.

Not only are these component parts capable of mass production, they can be manufactured using known manufacturing techniques, such as forgings, castings, robotics, automated welding, use of high quality indoor fabrication/manufacturing facilities. It is also envisioned that these component parts are susceptible to manufacture using 3D printing (a.k.a. Direct Digital Manufacturing) technologies.

Large-scale forgings and castings can take many, many months to complete. However, given the simplicity of the design of the component parts of the jackets described herein, it appears highly feasible and preferable to manufacture these component parts using faster manufacturing technology such as 3D printing technology. For example, one exemplary 3D printing system is the Electron Beam Additive Manufacturing (EBAM™) technology offered by Sciaky Inc. (Chicago, Ill.) (www.sciaky.com) under the brand names EBAM™ 300, EBAM™ 1500, EBAM™ 110, EBAM™ 88, and EBAM™ 68. The EBAM system is a 3D printing technology that is capable of producing high quality, high value, large-scale metal parts and structures (e.g., up to 19 feet in length), out of, e.g., titanium, tantalum, and nickel-based alloys in a matter of days, with very little material waste. These systems all combine computer-aided design (CAD), electron beam directed energy deposition, and layer-additive processing. For example, with the Sciaky EBAM system, one starts with a 3D model from a CAD program. The EBAM electron beam (EB) gun deposits metal (via wire feedstock), layer by layer, until the part reaches near-net shape and is ready for finish machining. The Sciaky EBAM system also employs the IRISS™ (Interlayer Real-time Imaging & Sensing System), a patented closed-loop control that provides consistent part geometry, mechanical properties, microstructure, metal chemistry over the course of operation. Gross deposition rates range from 7 to 20 lbs. (3.18 to 9.07 kg) of metal per hour, depending upon the selected material and part features.

Additionally, with an EBAM dual wirefeed system, one can combine two different metal alloys into a single melt pool, managed with independent program control, to create "custom alloy" parts or ingots. One also has the option to change the mixture ratio of the two materials, depending upon the features of the part that you are building, to create "graded" parts or structures. Furthermore, one can alternate between different wire gauges for finer deposition features (thin wire) and gross deposition features (thick wire). These benefits may be provided by the Sciaky, Inc. EBAM™ dual wirefeed process.

According to Sciaky, Inc., parts and structures up to 19 ft.×4 ft.×4 ft. (5.79 m×1.22 m×1.22 m)—or round parts up to 8 ft. (2.44 m) in diameter—can be produced with Sciaky's EBAM™ machines. Although the EBAM™ system is ideal for large-part additive manufacturing, it can also be effective for smaller-scale parts and applications, too. In general, parts starting around 8 in.$^3$ (203$^3$ mm) and larger are the best candidates for the EBAM™ process. The best material candidates for EBAM™ applications are weldable metals that are available in wire feedstock. These materials include: Titanium and Titanium alloys; Inconel 718, 625; Tantalum; Tungsten; Niobium; Stainless Steels (300 series); 2319, 4043 Aluminum; 4340 Steel; Zircalloy; 70-30 Copper Nickel; and 70-30 Nickel Copper.

Use of the EBAM additive manufacturing technology has benefits, including: reducing material costs, lead times, and machining times (as much as 80%) vs. conventional manufacturing; the fast, cost-effective additive manufacturing process in the market for producing large metal parts; the Sciaky IRISS™ Closed-Loop Control Technology ensures process repeatability and traceability; the Sciaky technology offers a large build envelope for 3D printed metal parts and a wide variety of commercially available metal 3D printing systems (in terms of work envelope scalability). The EBAM system's dual wirefeed process allows one to combine two different metal alloys into a single melt pool to create "custom alloy" parts or "graded" material parts, as well as switch between fine (thin wire) deposition features and gross (thick wire) deposition features. Unlike powder additive manufacturing processes, the Sciaky EBAM™ system works with refractory alloys and it produces significantly less material waste—plus, wire feedstock is not highly flammable like some powder feedstocks.

In addition to the Sciaky EBAM™ systems described above, other 3D printers on the market may likewise provide suitable manufacturing capabilities for the component parts of the jackets disclosed herein. A non-extensive listing includes: the VX4000 sand casting process by Voxeljet AG (Friedberg, Germany); the Objet 1000 polyjet process by Statasys Ltd. (Eden Prairie, Minn.); the Lens 850-R laser process by Optomec Inc. (Albuquerque, N. Mex.); the Project 5000 multijet printing process by 3D Systems Corporation (Rock Hill, S.C.); the M400 laser process by EOS Gmbh (Munich, Germany); and the Arcam Q20 electron beam melting process by Arcam AB (Mölndal, Sweden).

The above-referenced 3D printing technologies are incorporated herein by reference and are thought to be well-suited for use in the rapid, cost effective manufacturing of the component parts for the jacket designs disclosed herein. In particular, it is envisioned that a 3D printing facility could be located proximate the point of final assembly of the jacket (such as, for example, near a seaport where jackets are being assembled onshore for transport and installation offshore).

Also, it may be advantageous to provide such 3D printing capabilities on a mobile unit, such as one that could be taken offshore to print component parts "on site" as needed for the desired jacket assembly. In this embodiment, the raw materials would likewise be transported offshore so that the mobile offshore 3D printing facility could manufacture the jacket component parts on an as needed basis.

Thus, the component parts for the template jackets can be mass produced in any location, and then shipped by conventional means to a desired location for final assembly of the jacket structures. Additionally, the jacket component parts could be manufactured in the same location as for the final assembly. Such final assembly can be onshore (with the final templates then floated, barged or otherwise transported to the offshore location) or the component parts can be delivered to the offshore location for final assembly offshore. Additionally, as noted above, the entire jacket manufacturing and assembly process could be offshore.

The jacket templates themselves are of a lower overall weight than a traditional prior art jacket template; therefore, this alone provides cost savings in connection with the material, manufacturing, assembly and transport costs. Additionally, mass production of the parts, 3D printing of the parts, etc., lowers waste, improves fatigue performance and increases environmental protection.

Furthermore, the jacket structures of the present disclosure also provide for faster, more cost effective installation than with traditional jacket structures. For example, with traditional prior art jackets, installation requires use of a heavy weight certified lifting crane vessel to pick up the heavy jacket structure and place it on the surface to be installed (e.g., seabed for offshore installation), and to then install all of the permanent piles (e.g., driving multiple piles into the seabed) to secure the prior art jacket in place. This in turn occupies the use of this heavy lifting crane, which itself carries a much higher day rate cost to operate than a lighter weight crane vessel, for the duration of the jacket installation process thereby increasing day rate costs.

Because the jackets of the present disclosure are much lighter in weight than the prior art jacket structures, initial cost savings can also be enjoyed in that a smaller crane vessel may be employed to pick up and place the jacket template in place. However, owing to the unique design of the new jacket templates described herein, there exists further cost savings in the installation, particularly the offshore installation as follows: First, a low cost pile driving vessel can first install into, e.g., the seabed, a first location pile (using standard pile driving techniques). This pre-installed location pile will be installed at a pre-determined desired location (using a low day rate pile driving vessel), and will serve as one of the, e.g., four permanent piles used to secure the jacket in place (e.g., to the seabed). As such, with the pre-installation pile in place, the crane can then be used to install the pre-assembled jacket template over the pre-installation permanent pile, for example, by lowering the jacket template with can sets (20, 70) and can axis 24*a* aligned with the preinstalled location pile. Once so lowered, the jacket template design permits the jacket template to remain stable and in place over this single location pile until a separate, lower day rate pile driving vessel completes the securing of the jacket to, e.g., the seabed by driving in the remaining, e.g., 3 of 4 permanent piles. Therefore, the more expensive day rate lifting crane vessel, after lowering the jacket template over the initial location pile can then be freed up to efficiently perform other crane work, such as installing yet another jacket template on yet another nearby pre-installed location pile.

This installation process is particularly cost effective when a large number of jacket templates must be installed, e.g., in an offshore wind farm. In such scenario, a series of location piles would be installed ahead of the time when the heavy crane would be used to lower the jacket templates into place. This series of location piles would be installed by, e.g., a routine pile driving vessel. The heavy crane vessel could then be efficiently used to lower a first jacket over a first location pile, then move to the next location to lower a second jacket over a second location pile, etc., until all such jackets were placed over the applicable location piles. A separate pile driving vessel is used, following behind the lifting crane, to complete the installation of all permanent piles on each jacket. In these installation scenarios, it is envisioned that logistical planning would account for anticipated weather conditions so that the follow-on pile driving vessel's work would be completed for each jacket previously lowered in place by the crane vessel prior to any weather conditions arising that could potentially adversely impact a jacket that had not yet been fully secured with all permanent piles.

As such, the new jacket template design of the present disclosure provides cost savings in terms of material, manufacturing time, assembly time, and vessel/crane day rate and time.

In view of the above disclosure, it will be apparent that once successfully installed, the new jacket template design 10 disclosed herein offers a number of benefits and efficiencies through its service life and extending into its eventual decommissioning and either re-use or disposal.

In-Service Inspection/Repair: Unlike a conventional, prior art jacket structure, the 3-dimensional nature of the jacket framing design disclosed herein allows access by un-manned inspection tools referred to as Remotely Operated Vehicles (ROVs) or Autonomous Un-manned Vehicles (AUV). The underwater vehicles can access all the structural connections (joints) in the jacket framing for the purposes of critical in-service inspection as part of the life-cycle integrity management of the structure. This is not normally possible in a conventional jacket as the ROV or AUV is at serious risk of entanglement within the confines of the 2-dimensional framing walls of the jacket. The modular, open structure also lends itself to easier in-service repairs.

Decommissioning/Reuse: At the end of life of the jacket structures disclosed herein, the very same features that made the installation of the jacket so efficient also contribute to the ease of its removal. The lighter weight opens up the market for smaller lift vessels. The avoidance of grouting or any other underwater connections allows for safer and more rapid removal of the structure. The ability to cut the piles below mudline with internal cutting tools allows for the efficient removal of the piles and the jacket structure itself, making reuse of the facility (jacket structure) at another location a real and attractive possibility.

As such, the novel jacket structures disclosed herein provide advantages during the entire lifecycle of this type of structure: at the manufacturing stages, during the installation stages, during its intended use, during inspections of the structure throughout the duration of its intended use, during removal of the structure for decommissioning or reuse.

All references referred to herein are incorporated herein by reference. While the apparatus, systems and methods of this invention have been described in terms of preferred or illustrative embodiments, it will be apparent to those of skill in the art that variations may be applied to the process and system described herein without departing from the concept and scope of the invention. All such similar substitutes and modifications apparent to those skilled in the art are deemed to be within the scope and concept of the invention. Those skilled in the art will recognize that the method and apparatus of the present invention has many applications, and that the present invention is not limited to the representative examples disclosed herein. Moreover, the scope of the present invention covers conventionally known variations and modifications to the system components described herein, as would be known by those skilled in the art.

We claim:

1. A vertically-oriented structural building module comprising:

a. a central core member aligned along a central core vertical axis, the core structure comprising an upper end, a lower end, and an outer surface;

b. three or more upper structural arms each having lower and upper ends defining an upper arm length, the lower ends of the upper arms being fixably attached to the core outer surface in radially spaced relationship about the vertical axis, each upper arm extending outwardly and upwardly from the core its own vertical plane at a desired angle $\theta_u$ relative to the horizontal;

c. three or more lower structural arms each having lower and upper ends defining a lower arm length, the upper ends of the lower arms being fixably attached to the core outer surface in radially spaced relationship about the vertical axis, each lower arm extending outwardly and downwardly from the core at a desired angle $\theta_d$ relative to the horizontal;

d. upper tubular cans attached to the upper ends of the upper arms, the upper tubular cans each comprising an outer surface, an annular interior space oriented about a can axis and having an inner diameter, and upper and lower ends defining a can length, each of the upper tubular cans being attached to the upper arms in a substantially vertical orientation to align the annular interior space of each of the cans at a desired can angle $\theta_c$ relative to horizontal; and e. lower tubular cans attached to the lower ends of the lower arms, the lower tubular cans each comprising an outer surface, an annular interior space oriented about a can axis and having an inner diameter, and upper and lower ends defining a can length, each of the lower tubular cans being attached to the lower arms in a substantially vertical orientation to align the annular interior space of each of the cans at a desired can angle $\theta_c$ relative to horizontal;

wherein each respective upper arm is aligned within the same vertical plane with a corresponding one of the respective lower arms to form an upper lower arm pair, and wherein the upper and lower cans of each of the respective arm pairs is aligned about the same can axis to form an arm pair can axis.

2. The building module of claim 1 wherein at least one arm pair can axis is substantially parallel with the core vertical axis.

3. The building module of claim 1 wherein at least one arm pair can axis is substantially vertical.

4. The building module of claim 1 wherein each arm pair can axis is substantially vertical.

5. The building module of claim 1 wherein there are three upper structural arms and three lower structural arms.

6. The building module of claim 1 wherein there are four upper structural arms and four lower structural arms.

7. The building module of claim 1 wherein there are five upper structural arms and five lower structural arms.

8. The building module of claim 1 wherein there are six upper structural arms and six lower structural arms.

9. The building module of claim 1 wherein the core structure is solid.

10. The building module of claim 1 wherein the core structure further comprises an annular interior space having an inner diameter.

11. The building module of claim 10 wherein the core structure comprises a tubular material.

12. The building module of claim 1 wherein the upper arms are all of the same length.

13. The building module of claim 1 wherein the lower arms are all of the same length.

14. The building module of claim 1 wherein at least one of the upper arms is of a different length from the lengths of the other upper arms.

15. The building module of claim 1 wherein at least one of the lower arms is of a different length from the lengths of the other upper arms.

16. The building module of claim 1 further comprising two or more adjacent central core members horizontally spaced apart from each other within the same horizontal plane so that one adjacent core member has an adjacent face facing an adjacent face of another adjacent core member;

wherein the upper tubular cans of two of the upper arms extending upwardly from one of the core member adjacent faces are connected to the respective upper ends of two of the upper arms extending upwardly from the adjacent face of the other core member so that these upwardly extending arms share common upper tubular cans, wherein the lower tubular cans of two of the lower arms extending downwardly from one of the core member adjacent faces are connected to the respective lower ends of two of the lower arms extending downwardly from the adjacent face of the other core member so that these downwardly extending arms share common lower tubular cans, and wherein the upper arms sharing common upper tubular cans are aligned with the lower arms sharing common lower tubular cans, and wherein each respective upper arm sharing common upper tubular cans is aligned within the same vertical plane with a corresponding one of the respective lower arms sharing common lower tubular cans to form to form a shared upper lower arm pair.

17. A multi-tiered, vertically-oriented structural building jacket template for building a vertical structure comprising:

a. a bottom tier vertically-oriented structural building module having a lower end capable of resting on a foundation and an upper end opposite thereto, b. one or more upper tier vertically-oriented structural building modules each having lower ends and upper ends, the lower end of a first of the one or more upper tier modules being fixably attached to the upper end of the bottom tier, the lower end of any additional one of the one or more upper tier modules being fixably attached to the upper end of the module in the tier immediately below;

c. wherein each vertically-oriented structural building module comprises:

i. a central core member aligned along a central core vertical axis, the core structure comprising an upper end, a lower end, and an outer surface;

ii. three or more upper structural arms each having lower and upper ends defining an upper arm length, the lower ends of the upper arms being fixably attached to the core outer surface in radially spaced relationship about the vertical axis, each upper arm extending outwardly and upwardly from the core its own vertical plane at a desired angle $\theta_u$ relative to the horizontal;

iii. three or more lower structural arms each having lower and upper ends defining a lower arm length, the upper ends of the lower arms being fixably attached to the core outer surface in radially spaced relationship about the vertical axis, each lower arm extending outwardly and downwardly from the core at a desired angle $\theta_d$ relative to the horizontal, iv. upper tubular cans attached to the upper ends of the upper arms, the upper tubular cans each comprising an outer surface, an annular interior space oriented about a can axis and having an inner diameter, and upper and lower ends defining a can length, each of the upper tubular cans being attached to the upper arms in a substantially vertical orientation to align the annular interior space of each of the cans at a desired can angle $\theta_c$ relative to horizontal; and v. lower tubular cans attached to the lower ends of the lower arms, the lower tubular cans each comprising an outer surface, an annular interior space oriented about a can axis and having an inner diameter, and upper and lower ends defining a can length, each of the lower tubular cans being attached to the lower arms in a substantially vertical orientation to align the annular interior space of each of the cans at a desired can angle $\theta_c$ relative to horizontal, wherein each respective upper arm is aligned within the same vertical plane with a corresponding one of the respective lower arms to form an upper lower arm pair, and wherein the upper and lower cans of each of the respective arm pairs is aligned about the same can axis to form an arm pair can axis;

d. connections connecting the lower cans of the lower end of the first of the one or more upper tier modules to the upper cans of the bottom tier; and e. connections connecting the lower end of any additional one of the one or more upper tier modules to the upper end of the module in the tier immediately below;

f. an overall height defined as the distance from the bottom of the bottom tier to the top of the topmost of the upper tiers;

wherein the upper and lower cans of each of the respectively attached module tiers remain aligned about the same respective can axis from the top of the jacket template to the bottom of the jacket template, and wherein the central core members in each of the module tiers remain aligned along the central core vertical axis.

18. The structural building jacket template of claim 17 comprising two tiers.

19. The structural building jacket template of claim 17 comprising three tiers.

20. The structural building jacket template of claim 17 comprising four tiers.

21. The structural building jacket template of claim 17 wherein the top of the top tier is capable of receiving deck structure.

22. The structural building jacket template of claim 17 wherein the interior diameter of the cans is sufficient to permit passage of a pile therethrough.

23. The structural building jacket template of claim 17 wherein the foundation is the seafloor, the ground, a concrete pad, or another structure.

24. The structural building jacket template of claim 17 wherein the building module further comprising two or more adjacent central core members horizontally spaced apart from each other within the same horizontal plane so that one adjacent core member has an adjacent face facing an adjacent face of another adjacent core member;

wherein the upper tubular cans of two of the upper arms extending upwardly from one of the core member adjacent faces are connected to the respective upper ends of two of the upper arms extending upwardly from the adjacent face of the other core member so that these upwardly extending arms share common upper tubular cans, wherein the lower tubular cans of two of the lower arms extending downwardly from one of the core member adjacent faces are connected to the respective lower ends of two of the lower arms extending downwardly from the adjacent face of the other core member so that these downwardly extending arms share common lower tubular cans, and wherein the upper arms sharing common upper tubular cans are aligned with the lower arms sharing common lower tubular cans, and wherein each respective upper arm sharing common upper tubular cans is aligned within the same vertical plane with a corresponding one of the respective lower arms sharing common lower tubular cans to form to form a shared upper lower arm pair.

25. The structural building jacket template of claim 17 wherein the vertical structure is an oil and gas platform.

26. The structural building jacket template of claim 17 wherein the vertical structure is a wind energy platform.

27. An oil and gas platform comprising:

a. a multi-tiered, vertically-oriented structural building jacket template as in claim 17 or claim 24 having an upper end and a lower end, the lower end being secured to a foundation;

b. a deck structure mounted to the upper end of the jacket template; and c. piles extending through the interior annular space of each of the top and bottom tubular cans that are aligned along each respective can axis, the piles having an upper end and a lower end defining a pile length sufficient to extend along each can axis from the upper end of the jacket template into the foundation to a desired depth.

28. The oil and gas platform of claim 27 further comprising skirt piles.

29. The oil and gas platform of claim 27 wherein the jacket template is battered.

30. The oil and gas platform of claim 27 wherein the jacket template is non-battered.

31. A wind energy platform comprising:

a. a multi-tiered, vertically-oriented structural building jacket template as in claim 17 or claim 24 having an upper end and a lower end, the lower end being secured to a foundation;

b. a deck structure mounted to the upper end of the jacket template; and c. piles extending through the interior annular space of each of the top and bottom tubular cans that are aligned along each respective can axis, the piles having an upper end and a lower end defining a pile length sufficient to extend along each can axis from the upper end of the jacket template into the foundation to a desired depth.

32. The wind energy platform of claim 31 further comprising skirt piles.

33. The wind energy platform of claim 31 wherein the jacket template is battered.

34. The wind energy platform of claim 31 wherein the jacket template is non-battered.

35. The wind energy platform of claim 31 wherein the building module central core member further comprises a tubular material having an annular interior space having an inner diameter and wherein one or more of the vertically aligned central core members of adjacent modules at the top of the jacket receive a portion of a tower of a wind turbine.

36. A method for installing a platform structure comprising the steps of:

a. assembling a multi-tiered, vertically-oriented structural building jacket template vertical structure having an upper end and a lower end capable of being secured to a foundation, the jacket template vertical structure comprising:

i. a bottom tier vertically-oriented structural building module having a lower end capable of resting on a foundation and an upper end opposite thereto, ii. one or more upper tier vertically-oriented structural building modules each having lower ends and upper ends, the lower end of a first of the one or more upper tier modules being fixably attached to the upper end of the bottom tier, the lower end of any additional one of the one or more upper tier modules being fixably attached to the upper end of the module in the tier immediately below;

wherein each vertically-oriented structural building module comprises:

1. a central core member aligned along a central core vertical axis, the core structure comprising an upper end, a lower end, and an outer surface;

2. three or more upper structural arms each having lower and upper ends defining an upper arm length, the lower ends of the upper arms being fixably attached to the core outer surface in radially spaced relationship about the vertical axis, each upper arm extending outwardly and upwardly from the core its own vertical plane at a desired angle $\theta_u$ relative to the horizontal;

3. three or more lower structural arms each having lower and upper ends defining a lower arm length, the upper ends of the lower arms being fixably attached to the core outer surface in radially spaced relationship about the vertical axis, each lower arm extending outwardly and downwardly from the core at a desired angle $\theta_d$ relative to the horizontal, 4. upper tubular cans attached to the upper ends of the upper arms, the upper tubular cans each comprising an outer surface, an annular interior space oriented about a can axis and having an inner diameter, and upper and lower ends defining a can length, each of the upper tubular cans being attached to the upper arms in a substantially vertical orientation to align the annular interior space of each of the cans at a desired can angle $\theta_c$ relative to horizontal; and 5. lower tubular cans attached to the lower ends of the lower arms, the lower tubular cans each comprising an outer surface, an annular interior space oriented about a can axis and having an inner diameter, and upper and lower ends defining a can length, each of the lower tubular cans being attached to the lower arms in a substantially vertical orientation to align the annular interior space of each of the cans at a desired can angle $\theta_c$ relative to horizontal, wherein each respective upper arm is aligned within the same vertical plane with a corresponding one of the respective lower arms to form an upper lower arm pair, and wherein the upper and lower cans of each of the respective arm pairs is aligned about the same can axis to form an arm pair can axis;

iii. connections connecting the lower cans of the lower end of the first of the one or more upper tier modules to the upper cans of the bottom tier; and iv. connections connecting the lower end of any additional one of the one or more upper tier modules to the upper end of the module in the tier immediately below;

v. an overall height defined as the distance from the bottom of the bottom tier to the top of the topmost of the upper tiers;

wherein the upper and lower cans of each of the respectively attached module tiers remain aligned about the same respective can axis from the top of the jacket template to the bottom of the jacket template, and wherein the central core members in each of the module tiers remain aligned along the central core vertical axis;

b. vertically positioning the jacket template structure so that its lower end rests on the foundation; and c. securing the jacket template structure to the foundation by installing piles extending through the interior annular space of each of the top and bottom tubular cans that are aligned along each respective can axis, the piles having an upper end and a lower end defining a pile length sufficient to extend along each can axis from the upper end of the jacket template into the foundation to a desired depth.

37. The method of claim 36 wherein the jacket template further comprises deck structure mounted to the upper end of the jacket template, or wherein the method further comprises the step of mounting deck structure to the upper end of the jacket template.

38. The method of claim 36 wherein the building module further comprises two or more adjacent central core members horizontally spaced apart from each other within the same horizontal plane so that one adjacent core member has an adjacent face facing an adjacent face of another adjacent core member;

wherein the upper tubular cans of two of the upper arms extending upwardly from one of the core member adjacent faces are connected to the respective upper ends of two of the upper arms extending upwardly from the adjacent face of the other core member so that these upwardly extending arms share common upper tubular cans, wherein the lower tubular cans of two of the lower arms extending downwardly from one of the core member adjacent faces are connected to the respective lower ends of two of the lower arms extending downwardly from the adjacent face of the other core member so that these downwardly extending arms share common lower tubular cans, and wherein the upper arms sharing common upper tubular cans are aligned with the lower arms sharing common lower tubular cans, and wherein each respective upper arm sharing common upper tubular cans is aligned within the same vertical plane with a corresponding one of the respective lower arms sharing common lower tubular cans to form to form a shared upper lower arm pair.

39. The method of claim 37 further comprising the steps of installing equipment for using the platform as an oil and gas platform.

40. The method of claim 39 wherein the platform is installed in an offshore location in a water body having a sea level and a seabed, wherein the deck structure is located above sea level, and wherein the seabed serves as the foundation.

41. The method of claim 40 wherein the method further comprises the steps of inspecting the structure below sea level using remotely operated vehicles or autonomous unmanned vehicles.

42. The method of claim 37 further comprising the steps of installing equipment for using the platform as a wind energy platform.

43. The method of claim 42 wherein the platform is installed in an offshore location in a water body having a sea level and a seabed, wherein the deck structure is located above sea level, and wherein the seabed serves as the foundation.

44. The method of claim 43 wherein the method further comprises the steps of inspecting the structure below sea level using remotely operated vehicles or autonomous unmanned vehicles.

* * * * *